US010646737B2

(12) United States Patent
Publicover et al.

(10) Patent No.: US 10,646,737 B2
(45) Date of Patent: May 12, 2020

(54) LOW MASS TRAMPOLINE ENCLOSURE SYSTEM

(71) Applicants: Mark W. Publicover, Saratoga, CA (US); William Knight Foster, Saratoga, CA (US); Kevin Benjamin Charles, Millbrae, CA (US); James Chau, Saratoga, CA (US)

(72) Inventors: Mark W. Publicover, Saratoga, CA (US); William Knight Foster, Saratoga, CA (US); Kevin Benjamin Charles, Millbrae, CA (US); James Chau, Saratoga, CA (US)

(73) Assignee: JumpSport, Inc., Saratoga, CA (US)

( * ) Notice: Subject to any disclaimer, the term of this patent is extended or adjusted under 35 U.S.C. 154(b) by 0 days.

(21) Appl. No.: 16/114,080

(22) Filed: Aug. 27, 2018

(65) Prior Publication Data

US 2018/0369629 A1 Dec. 27, 2018

Related U.S. Application Data

(63) Continuation of application No. PCT/US2018/045283, filed on Aug. 3, 2018, which is a continuation-in-part of application No. PCT/US2018/039619, filed on Jun. 26, 2018, which is a continuation-in-part of application No. PCT/US2018/039619, filed on Jun. 26, 2018.

(60) Provisional application No. 62/590,528, filed on Nov. 24, 2017, provisional application No. 62/590,528, filed on Nov. 24, 2017, provisional application No.

(Continued)

(51) Int. Cl.

| | |
|---|---|
| ***A63B 5/11*** | (2006.01) |
| ***A63B 71/02*** | (2006.01) |
| *A63B 21/02* | (2006.01) |

(52) U.S. Cl.

CPC ..... *A63B 5/11* (2013.01); *A63B 71/022* (2013.01); *A63B 21/023* (2013.01); *A63B 21/026* (2013.01); *A63B 2209/00* (2013.01); *A63B 2210/50* (2013.01); *A63B 2210/54* (2013.01)

(58) Field of Classification Search

CPC ..... A63B 5/11; A63B 5/00–166

See application file for complete search history.

(56) References Cited

U.S. PATENT DOCUMENTS 5,399,132 A 3/1995 Bailey
6,053,845 A 4/2000 Publicover et al.

(Continued)

FOREIGN PATENT DOCUMENTS

WO WO 2009/098324 A2 8/2009

OTHER PUBLICATIONS

World Intellectual Property Organization, International Search Report and Written Opinion, dated Oct. 28, 2018, issued in International Application No. PCT/US2018/039619.

(Continued)

*Primary Examiner* — Nyca T Nguyen

(74) *Attorney, Agent, or Firm* — Klarquist Sparkman, LLP

(57) ABSTRACT

A lightweight trampoline enclosure system has a bed subsystem and an enclosure subsystem. The enclosure subsystem comprises netting suspended from a plurality of flexible poles. Upon a jumper's impact into the surrounding enclosure subsystem, the energy of the jumper's impact is absorbed and distributed outward and away from the location of impact and into the trampoline bed subsystem.

26 Claims, 49 Drawing Sheets

Related U.S. Application Data

62/541,653, filed on Aug. 4, 2017, provisional application No. 62/525,141, filed on Jun. 26, 2017.

(56) References Cited

U.S. PATENT DOCUMENTS

| | | | | |
|---|---|---|---|---|
| 6,135,922 | A | 10/2000 | Nissen | |
| 6,450,187 | B1 | 9/2002 | Lin et al. | |
| 7,611,443 | B2 | 11/2009 | Publicover | |
| 7,708,667 | B2 | 5/2010 | Alexander | |
| 7,758,471 | B2 | 7/2010 | Nelson | |
| 7,766,795 | B2 | 8/2010 | Publicover | |
| 7,909,703 | B1 * | 3/2011 | Semrau | A63G 31/00 446/487 |
| 7,918,764 | B2 | 4/2011 | VanElverdinghe | |
| 8,197,390 | B2 | 6/2012 | Ikegami | |
| 8,221,294 | B2 | 7/2012 | Publicover | |
| 8,585,557 | B2 | 11/2013 | Ikegami | |
| 8,652,011 | B2 | 2/2014 | VanElverdinghe et al. | |
| 8,920,290 | B2 | 12/2014 | Stokes et al. | |
| 9,855,452 | B2 | 1/2018 | Chen | |
| 2002/0137598 | A1 * | 9/2002 | Publicover | A63B 5/11 482/27 |
| 2004/0121883 | A1 * | 6/2004 | Publicover | A63B 5/11 482/29 |
| 2007/0004560 | A1 | 1/2007 | Nelson | |
| 2008/0269020 | A1 * | 10/2008 | Alexander | A63B 5/11 482/29 |
| 2009/0023558 | A1 | 1/2009 | VanElverdinghe | |
| 2009/0062078 | A1 | 3/2009 | VanElverdinghe | |
| 2011/0256985 | A1 | 10/2011 | Mann et al. | |
| 2012/0252634 | A1 | 10/2012 | Ikegami | |
| 2017/0319886 | A1 | 11/2017 | Chen | |
| 2017/0326399 | A1 * | 11/2017 | Woodman | A63B 5/11 |
| 2018/0036569 | A1 | 2/2018 | Chen | |
| 2018/0326244 | A1 * | 11/2018 | Andon | A63B 21/026 |

OTHER PUBLICATIONS

World Intellectual Property Organization, International Search Report and Written Opinion, dated Nov. 6, 2018, issued in International Application No. PCT/US2018/045283.

* cited by examiner

| | Mass of Frame (lb) | Mass of Safety Net System (lb) | Ratio | Trampoline Weight Rating (lb) | Ratio |
|---|---|---|---|---|---|
| JumpSport SkyBounce with Original Safety Net System | 105.1 | 42.2 | 40.1% | 220 | 19.2% |
| JumpSport SkyBounce with New Enclosure Subsystem | 105.1 | 15.4 | 14.7% | 169 | 9.1% |
| *Veriflex Airzone* | 87.7 | 34.3 | 39.1% | | |
| *AlleyOOP Double Bed* | 194.3 | 83.9 | 43.2% | 250 | 33.6% |
| *Springfree Large Square* | 192.2 | 37.1 | 19.3% | 250 | 14.8% |
| *JumpSport Elite* | 117.5 | 88.2 | 75.1% | 240 | 36.8% |
| *Magic Circle* | 126.9 | 77.8 | 61.3% | 450 | 17.3% |
| *JumpSport StagedBounce* | 96.1 | 65.9 | 68.6% | 240 | 27.4% |
| *Airmaster* | 108.8 | 50.4 | 46.3% | 250 | 20.1% |
| *Propel* | 73.5 | 28.2 | 38.4% | 275 | 10.3% |
| *Ultega* | 74.9 | 31.6 | 35.2% | < 199 | 15.9% |
| *Orbounder* | 94.7 | 27.2 | 28.7% | 220 | 12.3% |
| *Skywalker 15* | 107.5 | 34.2 | 31.8% | 200 | 17.1% |
| *Exacme* | 87.1 | 35.6 | 38.4% | < 250 | 14.2% |
| *Homcom Aosom* | 71.0 | 39.2 | 55.2% | 330 | 11.9% |
| *PureFun* | 84.1 | 39.7 | 47.2% | 250 | 15.9% |
| *Sky Walker 14* | 88.8 | 28.1 | 31.7% | 200 | 14.1% |
| *Bounce Pro* | 86.9 | 33.7 | 38.7% | 220 | 15.3% |
| *JumpZone* | 86.2 | 59.1 | 68.5% | 220 | 26.8% |
| *Vuly Thunder* | 168.0 | 96.4 | 57.4% | 330 | 29.2% |

FIG. 23

| Trampoline System Geometry | Standardized Mass of Bed Subsystem (lb) |
|---|---|
| Circular – 8-foot diameter frame | 19.1 |
| Circular – 10-foot diameter frame | 25.8 |
| Circular – 12-foot diameter frame | 32.8 |
| Circular – 14-foot diameter frame | 40.2 |
| Circular – 15-foot diameter frame | 44.0 |
| Circular – 16-foot diameter frame | 47.8 |
| Rectangular – 10' × 17' frame | 48.1 |
| Square – 15' × 15' frame | 56.0 |
| Square – 13' × 13' frame | 46.4 |

FIG. 24

| | Standardized Mass of Bed Subsystem (lb) | Mass of Safety Net System (lb) | Ratio |
|---|---|---|---|
| JumpSport SkyBounce with Original Safety Net System | 40.2 | 42.2 | 105.0% |
| JumpSport SkyBounce with New Enclosure Subsystem | 40.2 | 15.4 | 38.3% |
| *Veriflex Airzone* | 40.2 | 34.3 | 85.3% |
| *AlleyOOP Double Bed* | 40.2 | 83.9 | 208.7% |
| *Springfree Large Square* | 56.0 | 37.1 | 92.3% |
| *JumpSport Elite* | 40.2 | 88.2 | 219.4% |
| *Magic Circle* | 40.2 | 77.8 | 193.5% |
| *JumpSport StagedBounce* | 40.2 | 65.9 | 163.9% |
| *Airmaster* | 40.2 | 50.4 | 125.4% |
| *Propel* | 40.2 | 28.2 | 70.1% |
| *Ultega* | 40.2 | 31.6 | 78.6% |
| *Orbounder* | 40.2 | 27.2 | 67.7% |
| *Skywalker 15* | 44.0 | 34.2 | 77.7% |
| *Exacme* | 40.2 | 35.6 | 88.6% |
| *Homcom Aosom* | 40.2 | 39.2 | 97.5% |
| *PureFun* | 40.2 | 39.7 | 98.8% |
| *Sky Walker 14* | 40.2 | 28.1 | 69.9% |
| *Bounce Pro* | 40.2 | 33.7 | 83.8% |
| *JumpZone* | 40.2 | 59.1 | 147.0% |
| *Vuly Thunder* | 40.2 | 96.4 | 239.8% |

FIG. 25

| | Gross Shipping Weight (lb) | Mass of Safety Net System (lb) | Ratio | Standardized Gross Shipping Weight (lb) | Ratio |
|---|---|---|---|---|---|
| JumpSport SkyBounce with Original Safety Net System | 204.0 | 42.2 | 20.7% | 202.0 | 20.9% |
| JumpSport SkyBounce with New Enclosure Subsystem | 172.5 | 15.4 | 8.9% | 197.3 | 7.8% |
| *Veriflex Airzone* | 164.5 | 34.3 | 20.8% | 170.4 | 20.1% |
| *AlleyOOP Double Bed* | 445.8 | 83.9 | 18.8% | 402.1 | 20.9% |
| *Springfree Large Square* | 308.9 | 37.1 | 12.0% | 327.8 | 11.3% |
| *JumpSport Elite* | 313.8 | 88.2 | 28.1% | 265.8 | 33.2% |
| *Magic Circle* | 281.6 | 77.8 | 27.6% | 244.0 | 31.9% |
| *JumpSport StagedBounce* | 264.0 | 65.9 | 24.9% | 238.3 | 27.6% |
| *Airmaster* | 244.7 | 50.4 | 20.6% | 234.5 | 21.5% |
| *Propel* | 154.8 | 28.2 | 18.2% | 164.0 | 16.9% |
| *Ultega* | 148.6 | 31.6 | 21.3% | 157.2 | 20.1% |
| *Orbounder* | 180.3 | 27.2 | 15.1% | 193.3 | 14.0% |
| *Skywalker 15* | 200.8 | 34.2 | 17.0% | 210.7 | 16.2% |
| *Exacme* | 169.4 | 35.6 | 21.0% | 184.3 | 18.2% |
| *Homcom Aosom* | 165.3 | 39.2 | 23.7% | 166.3 | 23.6% |
| *PureFun* | 181.0 | 39.7 | 21.9% | 181.5 | 21.9% |
| *Sky Walker 14* | 166.4 | 28.1 | 16.9% | 178.5 | 15.7% |
| *Bounce Pro* | 171.8 | 33.7 | 19.6% | 178.4 | 18.9% |
| *JumpZone* | 209.8 | 59.1 | 28.1% | 191.0 | 30.9% |

FIG. 26

| | Mast Outer Diameter (in) | Mast & Foam Volume ($in^3$) |
|---|---|---|
| JumpSport SkyBounce with Original Safety Net System | 1.50 | 2,457 |
| JumpSport SkyBounce with New Enclosure Subsystem | 0.375 | 207 |
| *Veriflex Airzone* | 1.34 | 1,688 |
| *AlleyOOP Double Bed* | 1.66 | 4,332 |
| *Springfree Large Square* | 0.548 | 302 |
| *JumpSport Elite* | 1.69 | 4,477 |
| *Magic Circle* | 1.66 | 3,967 |
| *JumpSport StagedBounce* | 1.52 | 3,819 |
| *Airmaster* | 1.51 | 2,186 |
| *Propel* | 1.26 | 1,544 |
| *Ultega* | | |
| *Orbounder* | 1.50 | 1,605 |
| *Skywalker 15* | 1.50 | 2,012 |
| *Exacme* | 1.11 | 1,536 |
| *Homcom Aosom* | 1.00 | 1,725 |
| *PureFun* | 1.01 | 1,716 |
| *Sky Walker 14* | 1.26 | 1,572 |
| *Bounce Pro* | 1.25 | 1,638 |
| *JumpZone* | 1.50 | 2,762 |
| *Vuly Thunder* | 2.0×1.0 | |

FIG. 27

LOW MASS TRAMPOLINE ENCLOSURE SYSTEM

CROSS REFERENCE TO RELATED APPLICATIONS

This is a continuation of International Application No. PCT/US2018/045283, filed Aug. 3, 2018, which is a continuation-in-part of International Application No. PCT/US2018/039619, filed Jun. 26, 2018, which claims the benefit of U.S. Provisional Application No. 62/590,528, filed Nov. 24, 2017, U.S. Provisional Application No. 62/541,653, filed Aug. 4, 2017, and U.S. Provisional Application No. 62/525,141, filed Jun. 26, 2017.

This is a continuation-in-part of International Application No. PCT/US2018/039619, filed Jun. 26, 2018, which claims the benefit of U.S. Provisional Application No. 62/590,528, filed Nov. 24, 2017, U.S. Provisional Application No. 62/541,653, filed Aug. 4, 2017, and U.S. Provisional Application No. 62/525,141, filed Jun. 26, 2017.

This claims the benefit of U.S. Provisional Application No. 62/590,528, filed Nov. 24, 2017.

All the above-named applications are incorporated herein by reference in their entireties.

BACKGROUND

In the low-cost backyard trampoline market, shipping costs are large in proportion to the cost of materials in products sold. The safety net systems that provide jumper enclosing protections included with almost all backyard trampolines sold today account for a large portion of shipping costs. Therefore, anything that greatly reduces the volume or weight of these safety net systems creates a large financial advantage through reduced shipping and storage expenses.

Additionally, a lightweight enclosure system has other advantages including: being easier for consumers to transport from a store, including being more likely to fit in their vehicle; being easier to install and setup as there are no heavy poles and support materials to assemble; being easier to take down, move, and reassemble at another more distant location. Also, at the end of its life, the discarded materials will produce less waist to process; and potentially results in fewer greenhouse gases being emitted from activities related to their manufacture and/or shipment.

Two United States patents, TRAMPOLINE OR THE LIKE WITH ENCLOSURE, U.S. Pat. No. 6,053,845 (referred to below as the "845" patent) and TRAMPOLINE OR THE LIKE WITH ENCLOSURE, U.S. Pat. No. 6,261,207 (referred to below as the "207" patent) represented a revolutionary change for the trampoline industry as a whole. Prior to those inventions, safety enclosures for use with home trampolines were practically non-existent. Many had proposed enclosure designs, but these were impractical or ineffective for a variety of reasons. This was the state of affairs even though millions of trampolines were in use worldwide, and the need to protect jumpers from fall-offs was well-known. For instance, a comprehensive study had found 80% of serious, hospitalized trampoline injuries resulted from falling off a non-enclosed trampoline. During this period, medical doctors, researchers, and the American Academy of Pediatrics were calling for a ban on their sale and use in schools and recreational and home settings. The problem was of such a concern that public schools banned trampolines, despite their popularity and health benefits and once iconic "trampoline parks" (commercial pay-to-bounce venues open to the public) went out of business. Trampolines were limited to home use and to specialty athletic training under supervision, in sports like gymnastics and diving, where use of spotting harnesses is common.

Despite the call for bans and removal of trampolines from virtually all public facilities, home use of trampolines continued to grow. However, injuries increased significantly, as well. The costs and risks remained. There was ample motivation to create an effective, affordable enclosure for home users, yet nobody had done it. If a way could be found to minimize fall-off injuries, it would've been utilized well before 1997. Efforts to develop fall protection devices were made, but resulted mostly in large, heavy, metal cages that surrounded the trampoline. For instance, one design described how to hand build a cage using plumbing pipes of metal or plastic, tied off with rope strapping, with the cage being strapped to the trampoline frame and/or ground.

These early structures were very heavy, cumbersome to construct, and excessively expensive to ship and store in warehouses and on store shelves. The higher mass of these enclosures was intentional in order to offset the force of an adult moving at speed and impacting them. A 200 lb. individual moving laterally against a wall produces very high linear momentum (mass×velocity). It was believed that Newton's Third law (typically recited as, "For every action, there is an equal and opposite reaction.") required a high mass, high strength enclosure to repel a high momentum impact without failure or damaging the enclosure. However, high mass structures were so impracticable from a commercial standpoint that only a very limited number of enclosures were ever constructed or used with a trampoline, especially in the home market. Retailers were unwilling to stock and sell a product that took so much shelf and warehouse space and that was so heavy, bulky, expensive, and difficult to assemble. Prior to Publicover's inventions disclosed in the 845 and 207 patents, manufacturers and others in the industry could not find a way to design or produce an enclosure device that met these needs.

The Publicover patents 845 and 207 changed the calculation for the entire industry, radically altering the cost-benefit dynamics of enclosure production and sale. While the industry was seeking ways to lower costs (cheaper labor, etc.), the 845 and 207 innovation of attaching the net to shorter independent support poles and to the rebounding mat, directly or indirectly utilizing the rebounding surface to absorb impact forces, resulted in enclosures dramatically reduced in mass compared with the few enclosures that did exist at the time. The innovations were so profound that they were able to reduce average total mass of enclosures by approximately 50% over existing designs at that time, while still providing impact protection that exceeded all industry safety and reasonable performance standards. The commercial success of the 845 and 207 inventions is evident from the fact that sales went from virtually no enclosures being sold in 1997 to over a million sold and in use in the United States in just five or six years. Since then, the market has shifted further—today, effectively every trampoline sold worldwide has an enclosure, with the vast majority based on the 845 and 207 inventions.

Currently, mass-produced enclosures only marginally improve upon enclosure weight and package size by merely attempting to use thinner, weaker materials. This results in a significant degradation in performance and safety, producing far weaker enclosures that fail to or barely meet current ASTM standards (the voluntary US safety specifications), and results in enclosure pole and net components that fail within months or a few years. However, even these weaker devices still rely on the same design principles and inventions shown in 845 and 207. Over the past 20 years, no one has been able to improve upon those design principles in any significant way, especially in products for low-cost, mass-market sales.

Due to the rapid growth of online sales of trampolines, the need has grown to reduce the mass and packaging volume of the safety enclosure, while still retaining strength and performance. This need is even greater in the case of high-volume, low-margin consumer products, which make up an estimated 80% to 90% or more of all 14- to 15-foot circular enclosed trampolines (the most popular shape and sizes) produced and sold worldwide. These all-in-one (trampoline plus enclosure) systems are low-margin, low-cost products, generally selling for under $300 U.S. (in 2018 prices). By comparison, the average trampoline plus enclosure combo in 1998 sold for approximately $425 to $500. This simultaneous drop in retail price and increase in online sales has put tremendous pressure on the trampoline industry.

Over last 15 years, the number of trampolines sold in stores vs. online has shifted significantly. Today most low-cost, high volume trampolines are sold online with "free shipping" directly to the consumer. This shifts the freight cost burden to the retailers and manufacturers, putting further stress on margins. Shipping container or truckload quantities to a physical retail location are far more efficient and less costly than shipping individual products directly to an individual consumer. For example, based on standard freight and parcel rates, the cost to move a single enclosed trampoline system from the factory to a store shelf in the US is currently an estimated $35 to $65. From there, the consumer would buy and pick up the product, bearing the cost of getting it to his or her home. In contrast, moving a single enclosed trampoline system from the factory to an intermediary warehouse and then directly by delivery vehicle to a customer currently costs an estimated $125 to $225.

Most major parcel delivery services in the US now charge on the basis of the greater of the actual mass (weight), or the "DIM weight" (short for "dimensional weight," and sometimes referred to as "volumetric weight"). The DIM weight is an estimated or theoretical weight of what an optimized package should weigh at an expected density. Products shipped in larger dimension packages and lower density cost more per pound, on average, than products shipped in smaller, more densely-packed cartons. Rising costs of shipping (including fuel) and storage have become an enormous expense for manufacturers and retailers. These factors have had a devastating effect on trampoline producers. Since 2005, many trampoline companies, both domestically and abroad, have either stopped producing trampolines or gone out of business due to these market pressures.

Despite the critical, long-felt need for lower weight, lower volume packaging, and consistent safety performance, no one has effectively reduced the weight or average packaging dimensions of enclosure products beyond the designs enabled by the 845 and 207 patents until the designs disclosed in this current application. The enclosure designs disclosed in this patent are approximately 40% to 60% lower in weight than other enclosure designs on the market for comparable size and performance. Generally, when similar construction materials are involved, the cost is directly proportional to the weight. So, for example, a 10% reduction in weight would be expected to reduce the overall cost to get the product to a consumer by approximately 10% (manufacturing cost, ocean freight, warehousing, and delivery charges). Thus, the new designs in this patent are expected to achieve as much as a 40% to 60% reduction in total cost of the enclosure as compared with nearly all current low-cost enclosures on the market.

To accomplish this result while also still being able to pass international product safety/performance standards (e.g., ASTM F381 and F2225 (United States), EN-71 (Europe), AS 4989 (Australia), etc.); and, still have a product that lasts many years was unexpected to the inventors on this patent. Until the inventions disclosed in this application, it was counter-intuitive to those skilled in the art to think an enclosure of such low mass would be able to pass all the standard tests and to perform over an acceptable number of years. Arched and others enclosure designs existed in the market for many years, but nobody expected they could successfully lower the mass and volume (and the expense) significantly and still meet safety standards, or it would've been accomplished prior to the disclosed devices.

In an advantageous example, the volume of the enclosure pole packaging disclosed in this application is reduced by 80 to 90% compared with typical mass-market enclosures.

The above discussion points to why the art disclosed in these drawings and specifications is so significant for the industry and for enclosed trampoline design, fabrication, shipment, storage and sales. The inventors in this patent did not believe it was possible to significantly the weight of enclosures based on the 845 and 207 patents while also significantly reducing the volume of packaging. The goal was simply to improve, to any small degree, the weight of the components (relative to system size) that had remained substantially constant for the past 20 years, and that no one had yet improved upon. Scores of new enclosure designs have been brought to market without achieving any real improvement in terms of reduced weight and packaging size, but also with acceptable performance. The disclosed devices will achieve significant cost-savings advantages over those products based on the 845 and 207 patents. The described device and its versions successfully reduces, on average, an approximate 50% of the required enclosure mass beyond what any earlier device has been able to achieve; and all with sufficient strength to exceed all current international safety and performance requirements.

SUMMARY

Disclosed is a low mass trampoline system with an enclosure subsystem utilizing netting supported by arched, lightweight poles (or rods) that exhibit a low flexural rigidity as compared to masts in existing trampoline solutions in the marketplace or in use today that include jumper enclosing protections. The netting bottom edge and opposite pole ends are each integrated into the perimeter area of the rebounding surface. An impact against this enclosure subsystem distributes the impact energy through the poles and netting material and into the bed subsystem (i.e., rebounding surface and its coupling mechanism (e.g., including springs 705 and v-rings 709) with the frame) and then into the frame supported by the frame's leg poles. This transfers the energy away from the impact location to more distant locations across and around the other poles, to more distant netting material, across the rebounding surface, and into the springs, upper frame, and frame legs. The poles are placed in the enclosure subsystem at a specified orientation to reduce the energy absorbed through out of plane bending (where their strength is much more limited) and increase the energy absorbed through in plane bending (where the pole's strength is much greater). This energy absorption system permits a dramatically lighter pole to be utilized for a given level of energy dissipation than that required for a more traditional trampoline solution that includes jumper enclosing protections and elements corresponding to an enclosure subsystem where most of the energy is absorbed by bending cantilever masts (corresponding to the disclosed rods) and little to none of the energy is absorbed through axial loading on the masts. Additionally, because the impact energy is transferred throughout the entire trampoline system (effectively making the trampoline bed, springs (or other coupling mechanism), and frame key components of the total trampoline system) much lighter poles may be utilized. These poles are far lighter than masts used in existing trampoline solutions that include jumper enclosing protections. The light weight of the enclosure subsystem (as compared to the weight of a user) permits the enclosure subsystem to be coupled to the bed subsystem without the detrimental effect of a significant dampening load being added to the rebounding of the bed subsystem. Additionally, more flexible and lighter poles require less pole padding to no pole padding at all due to a direct jumper impact into a pole providing an elastic cushioning surface that easily bends (in comparison to a rigid pole) and does not create an impact hazard. Finally, the reduced mass of the enclosure subsystem and reduced need for more expensive and/or heavier duty components, results in a lighter total trampoline system of less volume that takes up much less storage space, and reduces materials costs and shipping expenses, and therefore provides a lower cost product for the end consumer, without sacrificing quality, safety, or sufficient functional strength.

It is to be understood that both the foregoing and the following descriptions are exemplary and explanatory only and are not intended to limit the claimed invention or application thereof in any manner whatsoever.

BRIEF DESCRIPTION OF THE DRAWINGS

In the drawings:

FIG. 23 is a table which depicts the safety net system mass and frame mass for many representative products in the market or in use today along with one of the newly disclosed trampoline systems in row 2.

FIG. 24 is a table which depicts the standardized mass of a bed subsystem for various geometries of trampoline systems.

FIG. 25 shows the ratio of the safety net system mass to a standardized mass of a bed subsystem for many representative products in the market or in use today along with one of the newly disclosed trampoline systems in row 2.

FIG. 26 shows the ratio of the mass of the safety net system to the gross shipping weight and to the gross shipping weight for a standardized gross weight for many representative products in the market or in use today along with one of the new disclosed trampoline systems in row 2.

FIG. 27 shows the safety net system's mast and any required foam for many representative products in the market or in use today along with one of the new disclosed trampoline systems in row 2.

DETAILED DESCRIPTION

1. Table of Contents

1. Table of Contents
2. Introduction
3. Key Metrics and Term Definitions
4. Advantageous Key Metric Ranges and Limits
   4.1. Rigidity and Self-Supporting
   4.2. Elliptical or Convex Curvature and Shape
   4.3. Bending Stress and Tensile Stress
5. Adjustability of Key Metrics
6. Advantageous Qualities Afforded by Key Metric Ranges
   6.1. Rigidity
   6.2. Energy Dissipation
7. Various Embodiments of Devices
   7.1. Trampoline Bed Shape
   7.2. Frame
   7.3. Rod Shape
   7.4. Rod Assembly
   7.5. Rod Coupling and Other Rod Details
   7.6. Netting Curtain Shape
   7.7. Netting Overlapping Entry
   7.8. Enclosure Subsystem/Bed Subsystem Connection
8. Relative Mass and Volume
9. Further Details of Certain Disclosed Embodiments
   9.1. Basic Embodiments
   9.2. Alternate Embodiments
   9.3. Rod Embodiments
   9.4. Additional Embodiments and Miscellaneous

2. Introduction

Described herein are trampoline systems that include a frame, a rebounding bed supported by the frame, and a safety enclosure subsystem that provides a chamber above the rebounding bed to help keep jumpers over the rebounding bed. The frame includes an upper frame member, sometimes referred to as a "perimeter frame member," and typically includes frame legs that support the upper frame member above the ground. The rebounding bed typically is connected to the upper frame member by a coupling mechanism such as by one or more bungee cords or by coil or leaf springs or by compression springs or by rod springs. The enclosure subsystem includes a net that extends above the level of the rebounding bed and that defines a chamber above the rebounding bed and a plurality of rods that support the net. Protective padding may be positioned to cover the coupling mechanism and/or on the poles, although pole padding is advantageously not employed to minimize enclosure subsystem volume.

Having tested numerous products on the market today that are representative of the kinds of trampoline solutions that include jumper enclosing protections available and evaluated currently existing designs, none have been found that satisfy the optimal metrics for performance of the disclosed devices detailed herein.

3. Key Metrics and Term Definitions

Certain metrics and terms within the descriptions of the disclosed devices have specific meanings and definitions. These metrics and terms shall have the meanings as defined below, whether used in capitalized or lower-case forms.

Figure 12A:
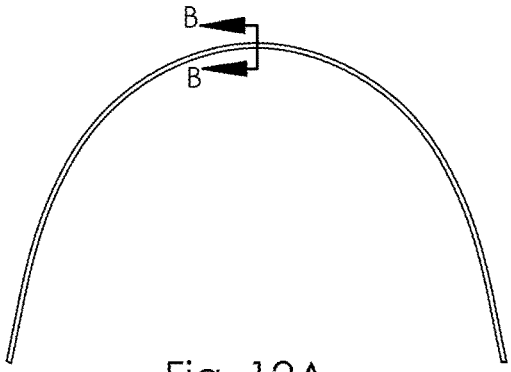
FIG. 12A is a front view of a solid cylindrical arched member.
Figure 12B:
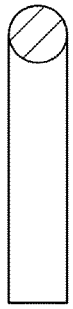
FIG. 12B is a side cross section view along line B of the solid cylindrical arched member of FIG. 12A.
Figure 12C:
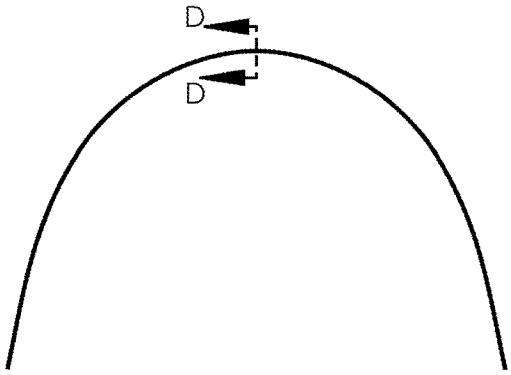
FIG. 12C is a front view of a solid cross-shaped arched member.
Figure 12D:
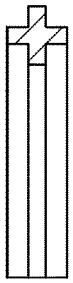
FIG. 12D is a side cross section view along line D of the solid cross-shaped arched member of FIG. 12C.
Figure 12E:
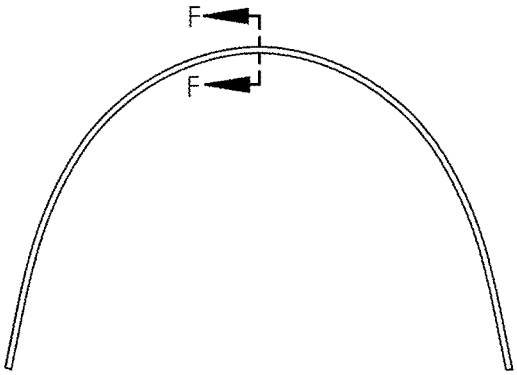
FIG. 12E is a front view of a solid square-shaped arch member.
Figure 12F:
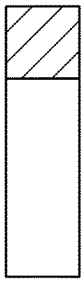
FIG. 12F is a side cross section view along line F of the solid square-shaped arched member of FIG. 12E.
Figure 12G:
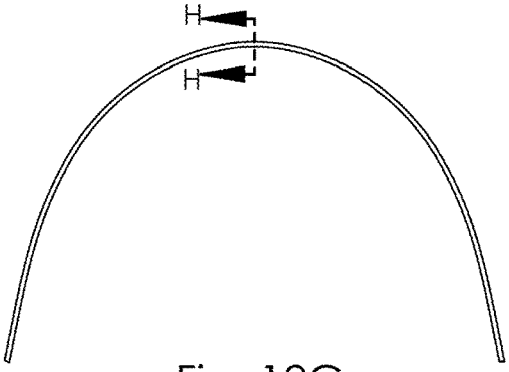
FIG. 12G is a front view of a hollow cylindrical arched member.
Figure 12H:
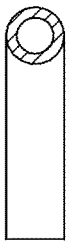
FIG. 12H is a side cross section view along line H of the hollow cylindrical arched member of FIG. 12G.

Rod: A rod is an elongated member that connects to the bed or frame subsystems or both subsystems in each of the two end areas and which has a portion situated between the at least two connection locations and a middle area of the rod extends above the plane of the rebounding surface. For example, any one of the following four named embodiments:

1) Flexible Rod: One advantageous embodiment of a rod is the maximum longitudinal portion (the portion) of a longitudinal structure (typically an elongated bar or tube), whose length is substantially greater than its width (e.g., more than ten times greater), and that has a sufficient flexural rigidity such that when the portion is in its isolated at rest shape, there exists an orientation such that after the following procedure, the flexural rigidity of the portion causes the portion to substantially return to its original resting shape and the portion is not torn, broken, plasticized, or noticeably deformed by the forces of the bending actions of the procedure. The procedure begins with the portion being temporarily bent (by means of an applied force at each of the two functional ends of the portion) from the starting isolated at rest shape so as to approximate a half circular shape (i.e., the tangents of the ends of the portion are bent to a 180° angle relative to each other and held at a radial distance from a center of a circle of diameter $2L/\pi$, where L is the length of the portion and the arc length of the formed curve), for example as shown in FIG. 12Q, and held in that position by the applied forces for at least a minute. The portion only passes this part of the procedure and may be a flexible rod if the applied forces when held cause the middle area of the rod to have an average radius of curvature less than $5L/2\pi$ (five times the radius) (e.g., the middle area of the rod is sufficient curved and not nearly straight). Next, the ends are temporarily moved closer together so that they are now at half the prior distance from each other in order to approximate a second, smaller half circular shape (i.e., the tangents of the ends of the portion are maintained at a 180° angle relative to each other and moved closer together to be at a radial distance from a center of a circle of diameter $L/\pi$), for example as shown in FIG. 12R, and held in that position by the applied forces for at least a second minute. Finally, the portion is then relaxed (i.e., the bending forces are released) and the portion is examined to determine whether the portion substantially returns to its original resting shape and whether the portion is not torn, broken, plasticized, or noticeably deformed by the forces applied during the procedure. A flexible rod has two end areas configurable to be attached or coupled to the bed subsystem or to the frame subsystem or to another rod.

2) Semi-Rigid Rod: A second advantageous embodiment of a rod is a rod that is substantially more rigid than a flexible rod and has no portion that satisfies the definition of a flexible rod. A semi-rigid rod is the maximum longitudinal portion (the portion) of a longitudinal structure (typically an elongated bar or tube), whose length is substantially greater than its width (e.g., more than ten times greater), and that has a sufficient flexural rigidity such that when the portion is in its isolated at rest shape, there exists an orientation such that after the following procedure, the flexural rigidity of the portion causes the portion to substantially return to its original resting shape and the portion is not torn, broken, plasticized, or noticeably deformed by the forces of the bending actions of the procedure. The procedure begins by identifying the line connecting the two functional ends of the portion, for example as shown in FIG. 12S, and temporarily bending the portion (by means of an applied force at each of the two functional ends of the portion) so as to move the functional ends five inches closer to each other along the identified line, for example as shown in FIG. 12T, and held in that position by the applied forces for at least a minute. Next, the applied forces are changed so as to move the functional ends five inches farther apart than the distance of their isolated at rest positions, for example as show in FIG. 12U, and held in that position for at least a minute. Finally, the portion is then relaxed (i.e., the bending forces are released) and the portion is examined to determine whether the portion substantially returns to its original resting shape and whether the portion is not torn, broken, plasticized, or noticeably deformed by the forces applied during the procedure. A semi-rigid rod has two end areas configurable to be attached or coupled to the bed subsystem or to the frame subsystem or to another rod.

3) Looped Rod: A third advantageous embodiment of a rod is the whole portion of a longitudinal structure (typically an elongated bar or tube), whose arc length is substantially greater than its width (e.g., more than ten times greater) and which wraps around to meet itself to form a closed loop (e.g., see FIGS. 12V-12W). A looped rod has two end areas configurable to be attached or coupled to the bed subsystem or to the frame subsystem or to another rod.

4) Active Rod: A fourth advantageous embodiment of a rod is a long thin longitudinal structure that has an active portion and does not satisfy the definition of a flexible rod or semi-rigid rod; the active portion is located between two connection locations where the active portion is coupled to either the frame or bed subsystems or both. An active rod is any structure that has similar flexural rigidity properties to either a flexible rod or a semi-rigid. An active rod has two end areas configurable to be attached or coupled to the bed subsystem or to the frame subsystem or to another rod.

Figure 9A:
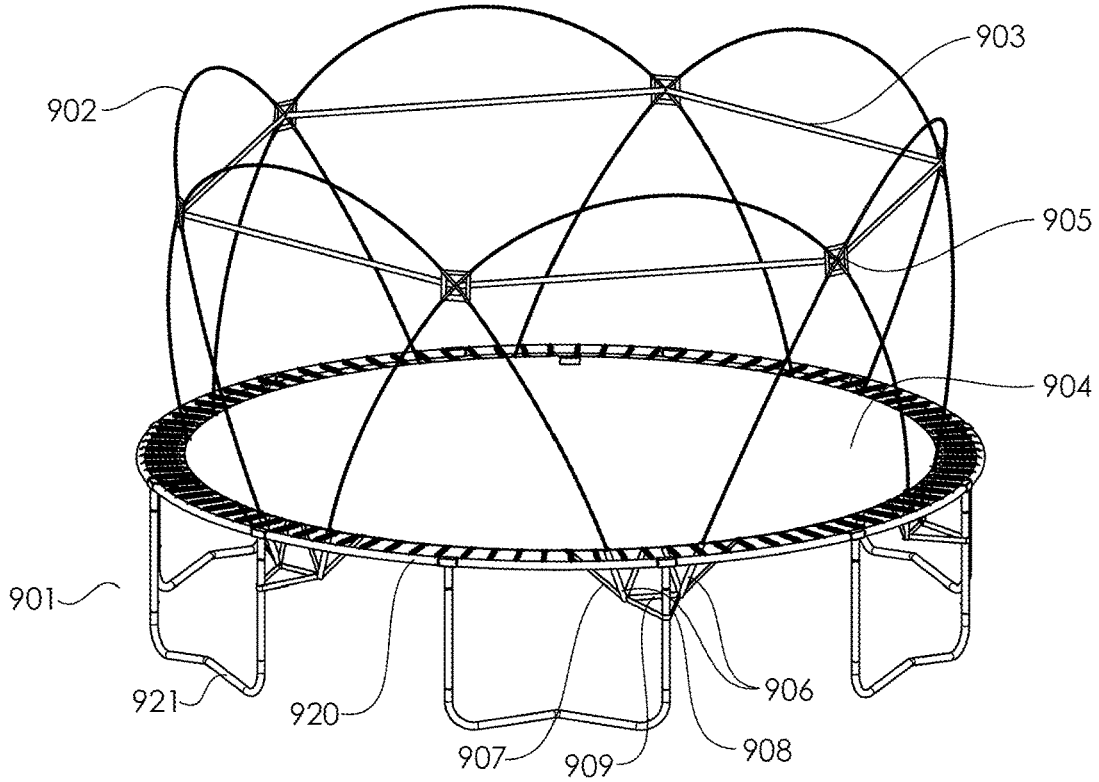
FIG. 9A is an angled view of a trampoline enclosure system comprised of six arch members.
Figure 9B:
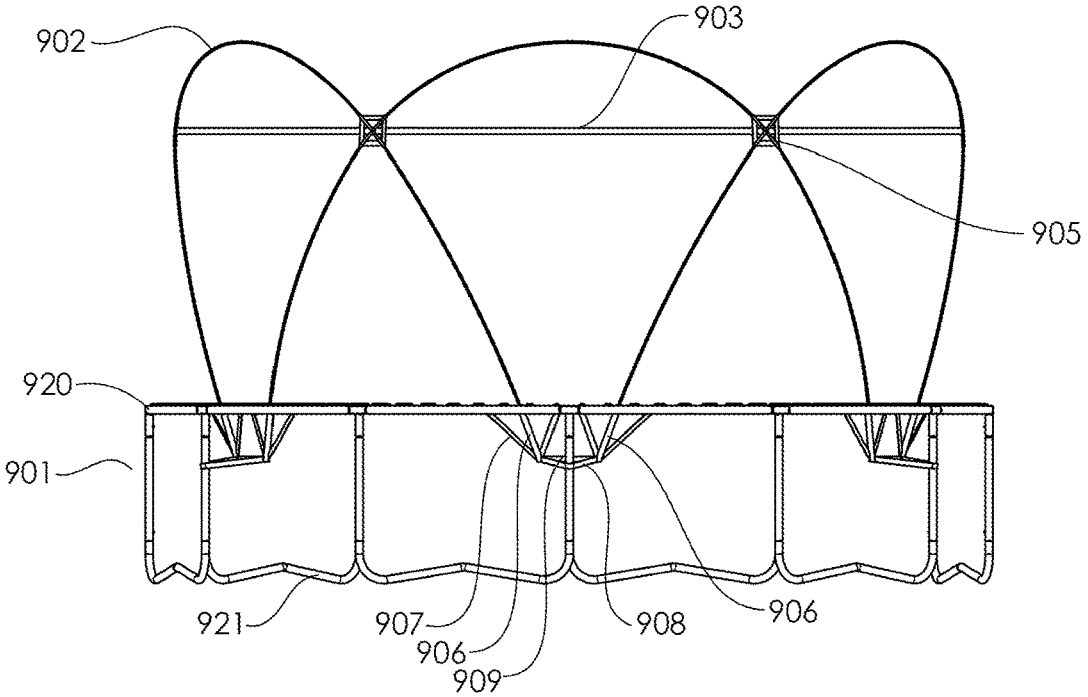
FIG. 9B is a front view of the trampoline enclosure system of FIG. 9A.
Figure 9C:
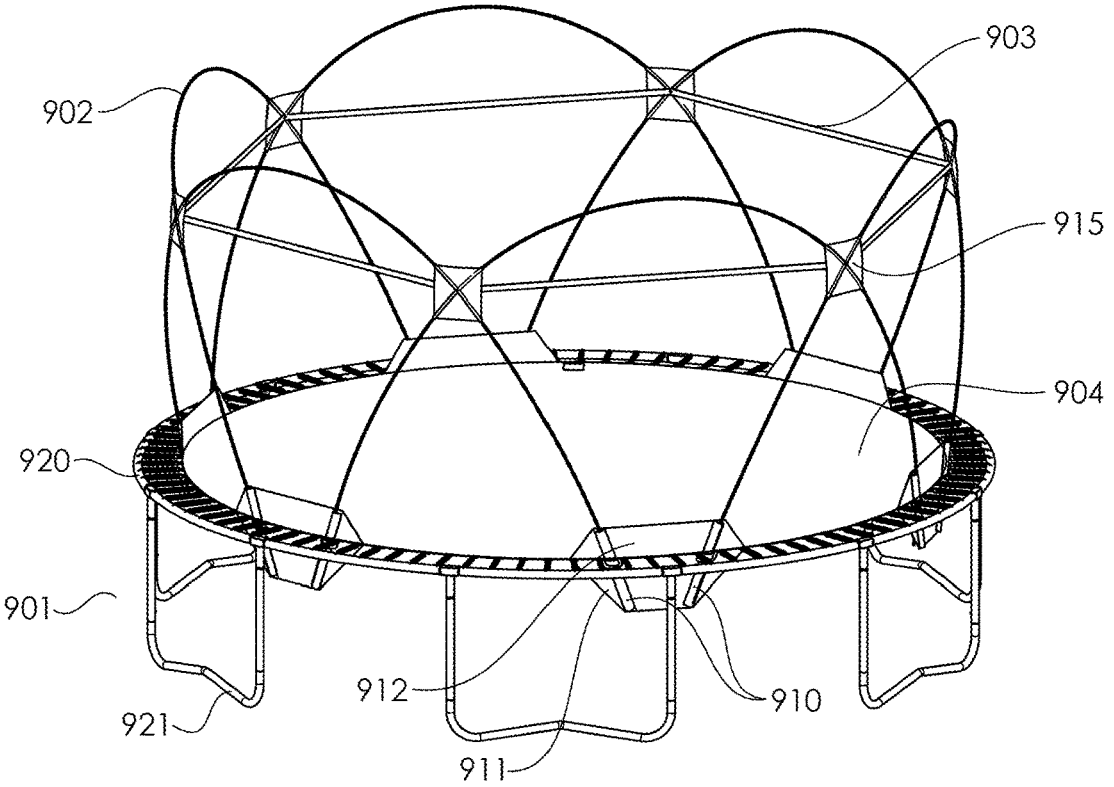
FIG. 9C is an angled view showing a circular trampoline with a reinforced arched rod enclosure.
Figure 9D:
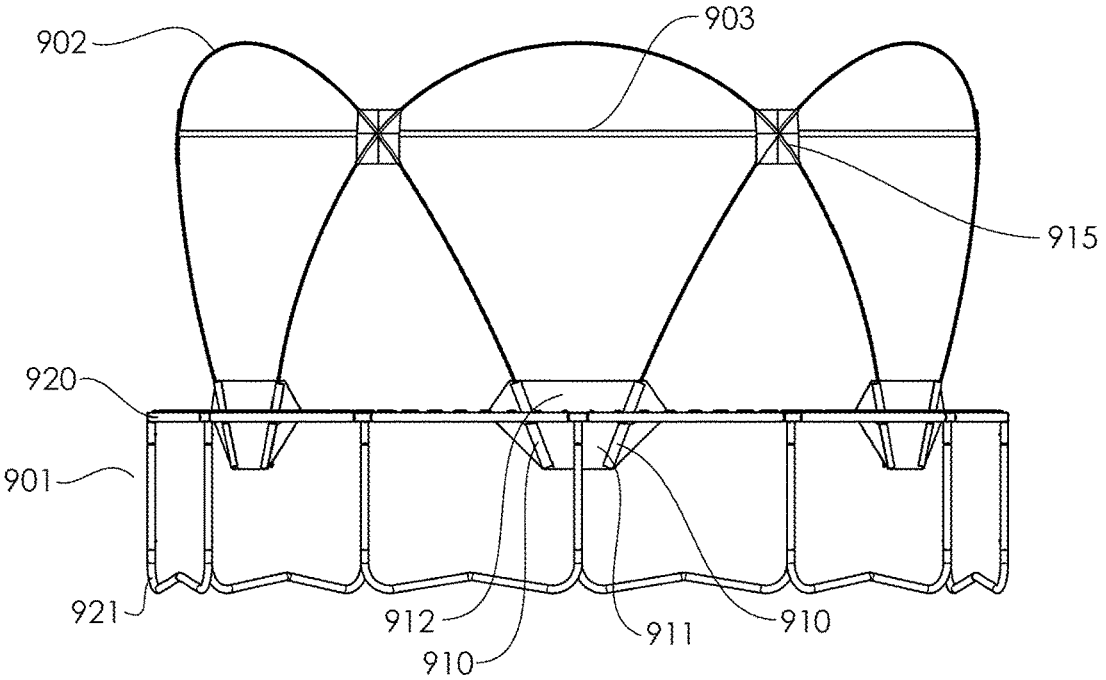
FIG. 9D is a front view showing the trampoline of FIG. 9C.
Figure 9E:
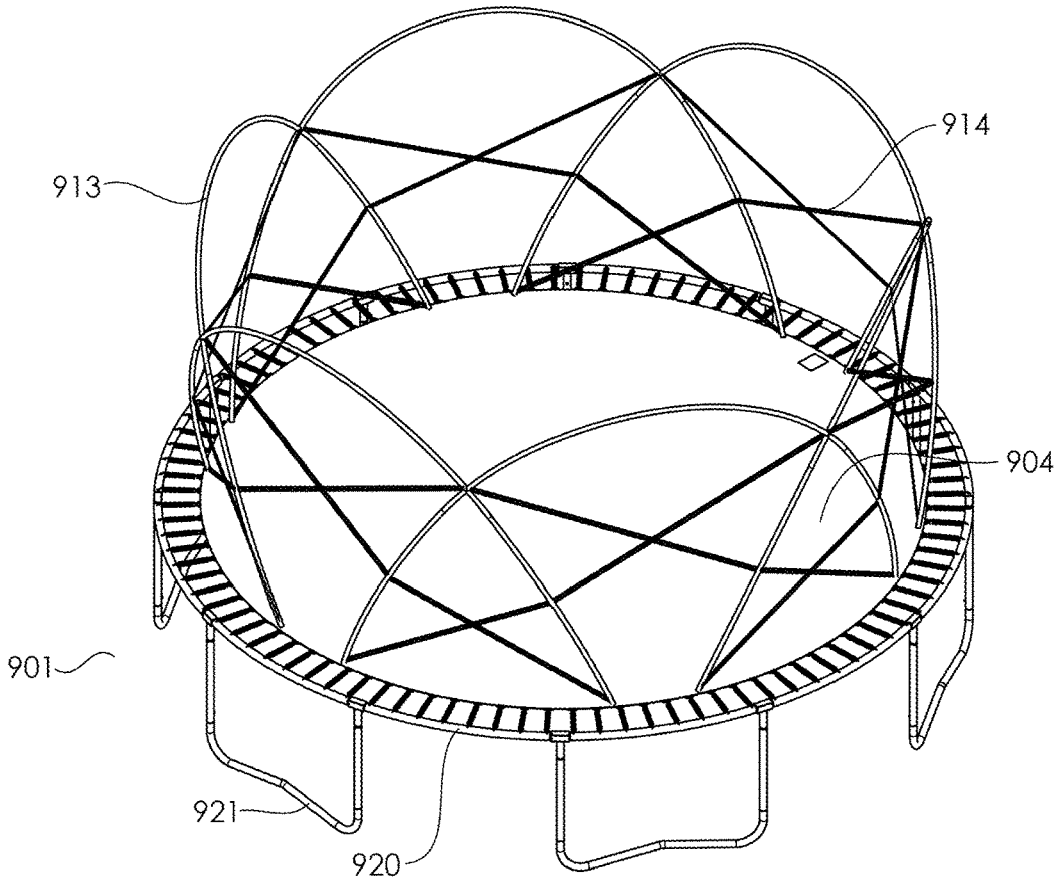
FIG. 9E is an angled view of a trampoline enclosure system comprised of six reinforced arch members.
Figure 9F:
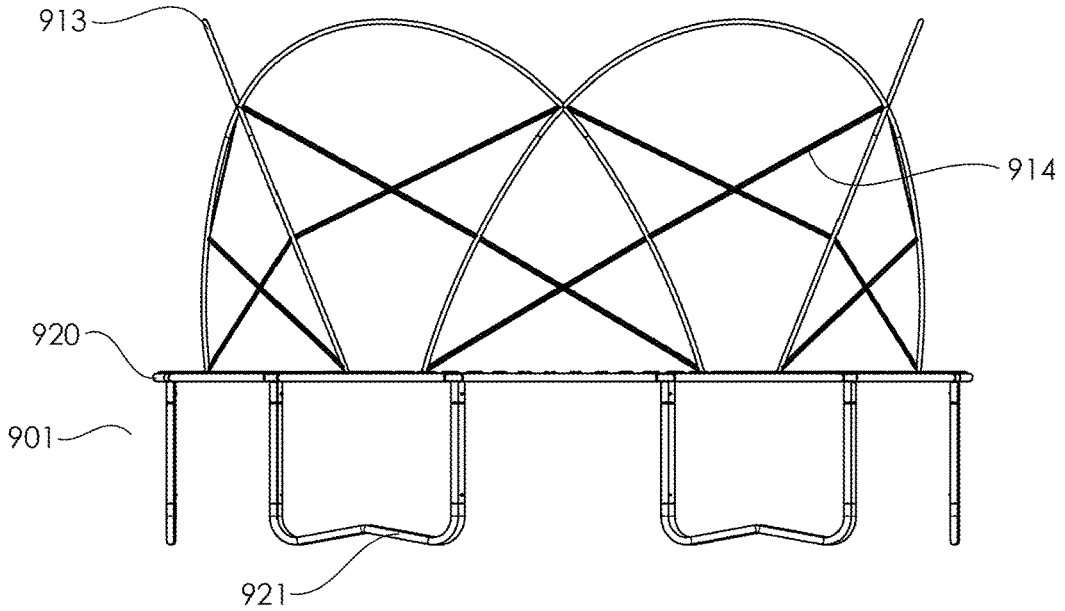
FIG. 9F is a front view of the trampoline enclosure system of FIG. 9E.
Figure 10A:
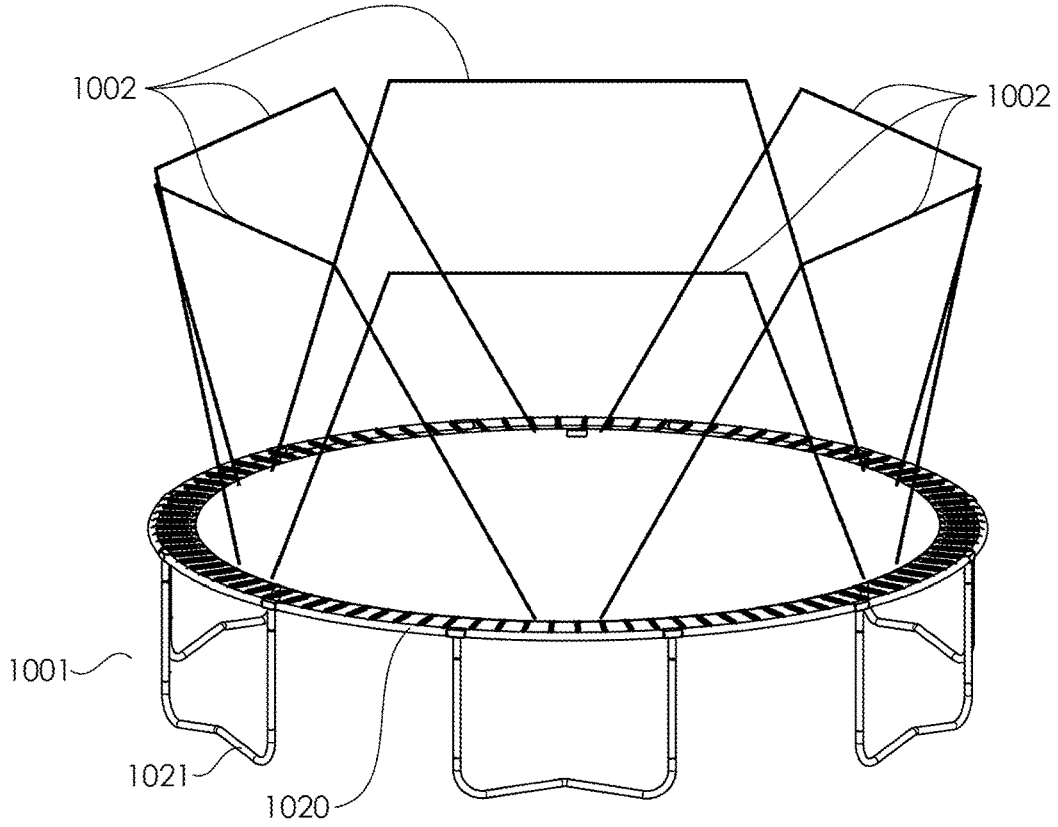
FIG. 10A is an angled view of a trampoline enclosure system comprised of six trapezoidal members.
Figure 10B:
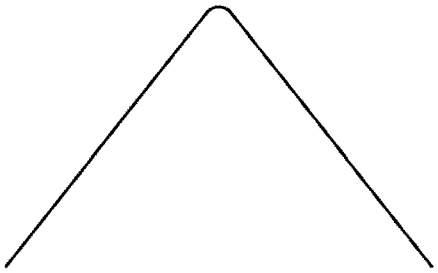
FIG. 10B is a front view of a two-segment arch which results in a triangular shape.
Figure 10C:
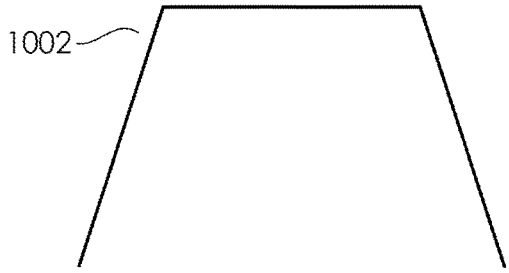
FIG. 10C is a front view of a three-segment arch which results in a trapezoid shape.
Figure 10D:
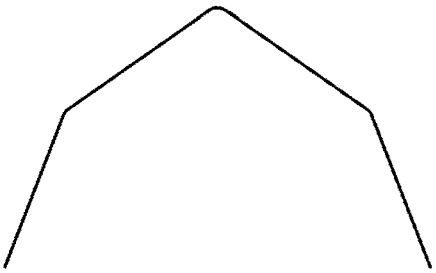
FIG. 10D is a front view of a four-segment arch.
Figure 10E:
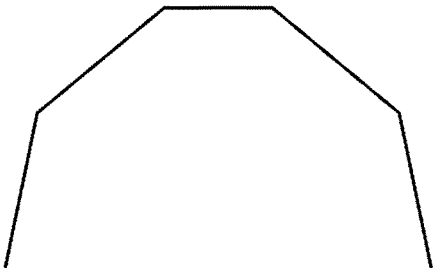
FIG. 10E is a front view of a five-segment arch.
Figure 10F:
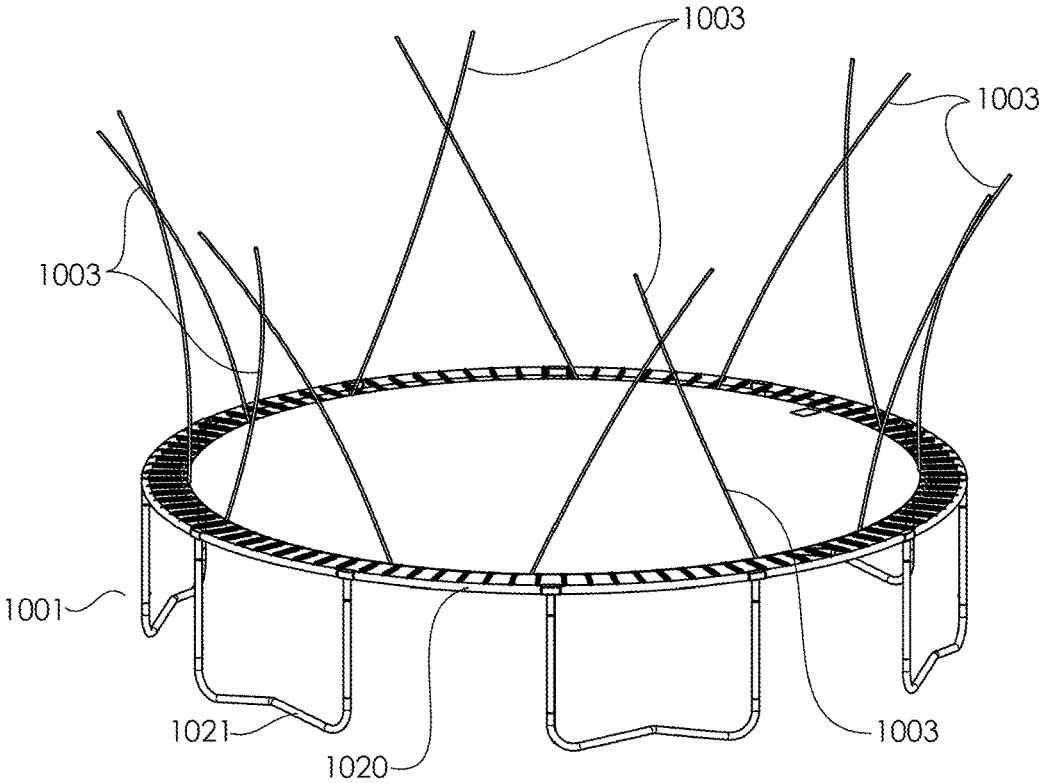
FIG. 10F is an angled view of a circular trampoline with a trampoline enclosure system comprised of six x-shaped crossing rod structures.
Figure 10G:
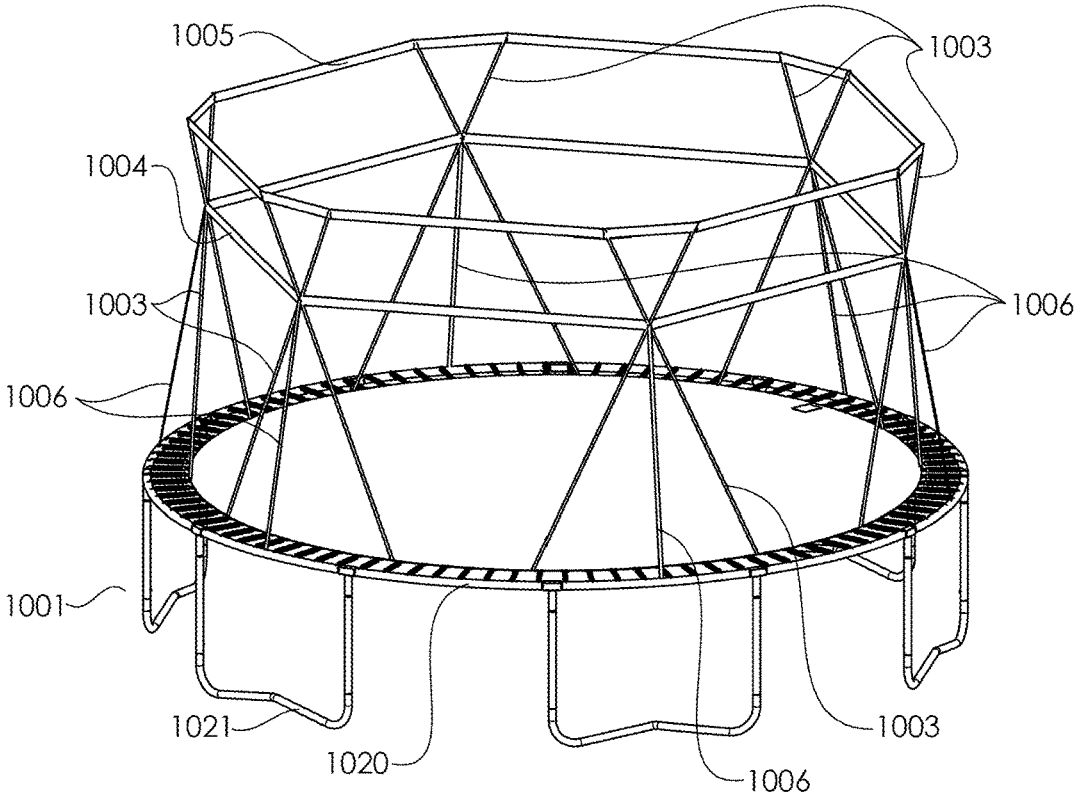
FIG. 10G is a front view of the circular trampoline with a trampoline enclosure system of FIG. 10F.
Figure 12I:
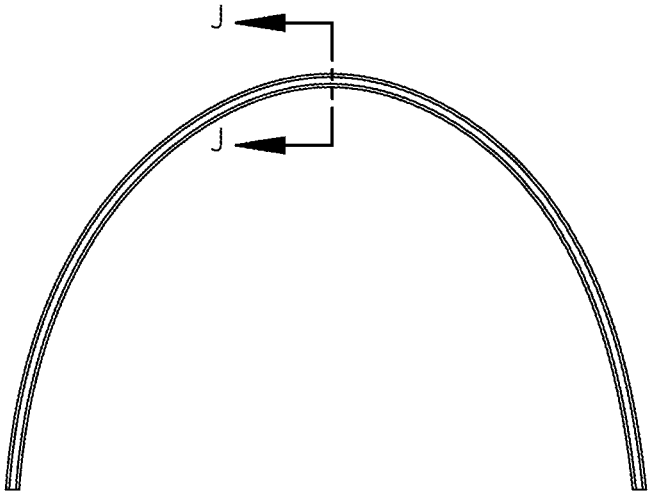
FIG. 12I is a front view of a grouped cylindrical arched member.
Figure 12J:
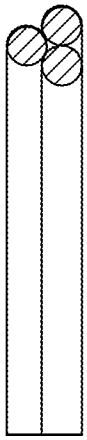
FIG. 12J is a side cross section view along line J of the grouped cylindrical arched member of FIG. 12I.
Figure 12K:
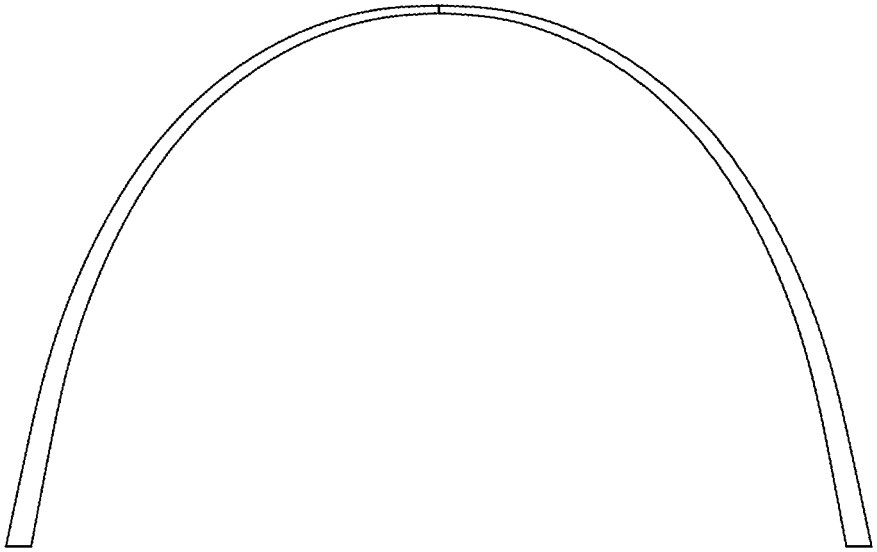
FIG. 12K is a front view of a tapered cylindrical arched member.
Figure 12L:
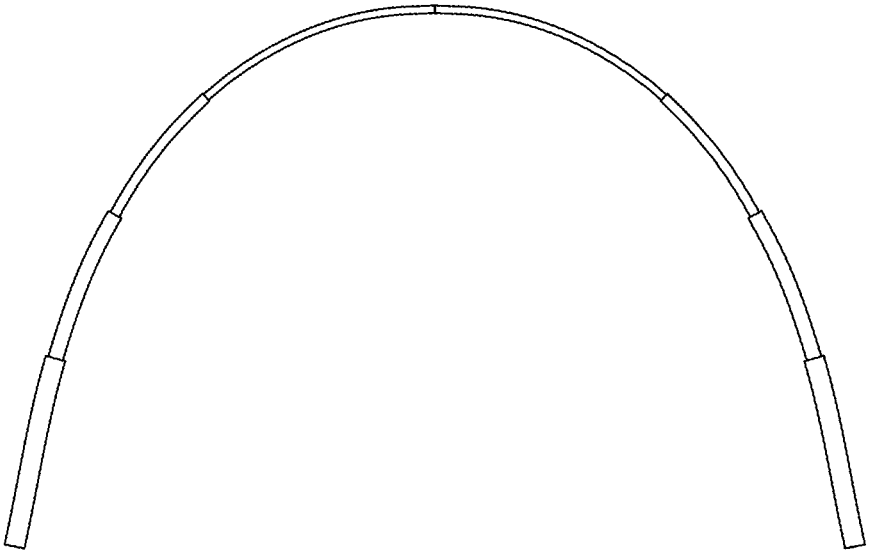
FIG. 12L is a front view of a stepped cylindrical arched member.

Is some embodiments, a rod is constructed from a single unitary piece of material, such as arched rods of the type shown in FIGS. 1-3, 5-9, and 12-16; or in other embodiments, a rod is constructed from plural pieces of material (each of which do not in themselves constitute a rod as defined herein) that are joined or coupled together or functionally correlated to act in concert with each other as a unit to approximate a single member, such as the x-shaped crossing rod structures of FIGS. 10F and 10G and the arched rod structures of FIGS. 12K and 12L and the grouped rod structure of FIGS. 12I and 12J or the connected segment rod structures of FIGS. 20A-20H. A rod may alternatively be referred to as an arch member, rod member, arched rod member, support rod, arched support rod, arched rod, pole, band, or banding. The corresponding elements for rods in a trampoline solution that includes jumper enclosing protections are referred to as masts herein.

Figure 11A:
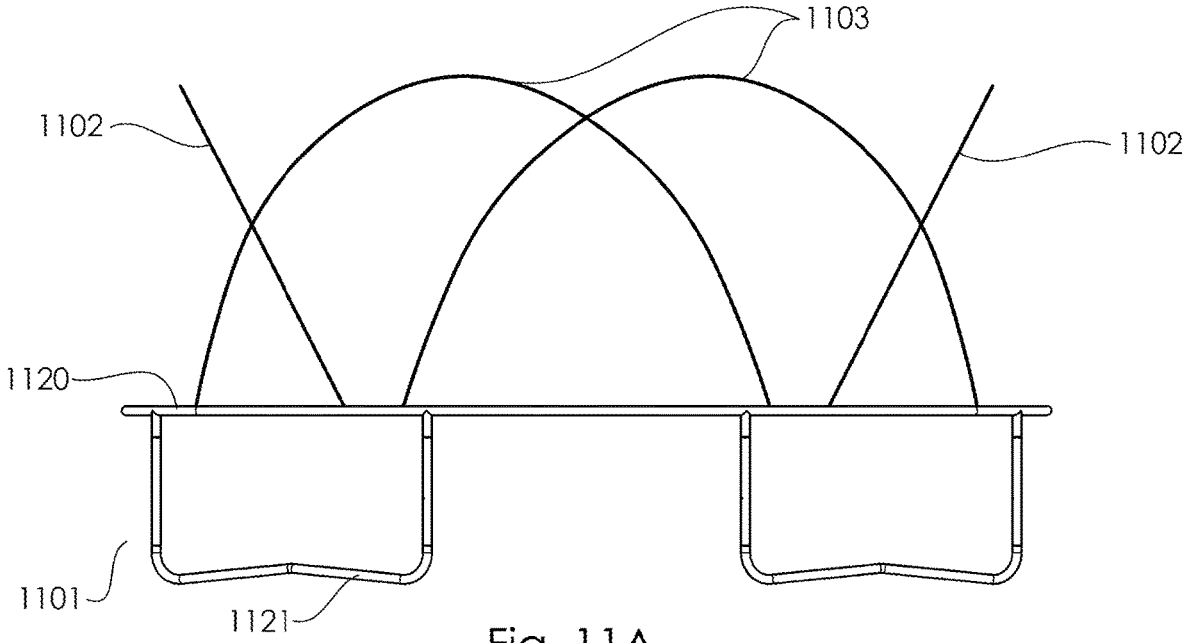
FIG. 11A is front view of an oval trampoline with a trampoline enclosure system comprised of six arched members.
Figure 12M:
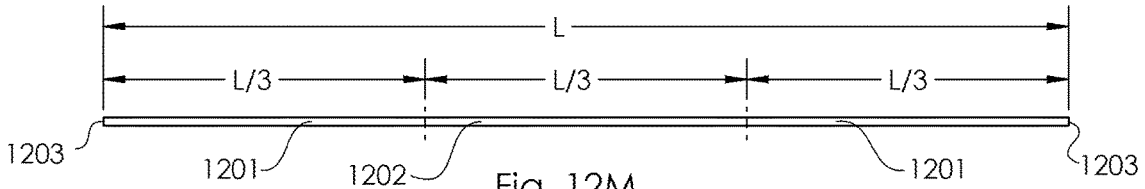
FIG. 12M is a front view of a rod with an isolated at rest straight shape.
Figure 12N:
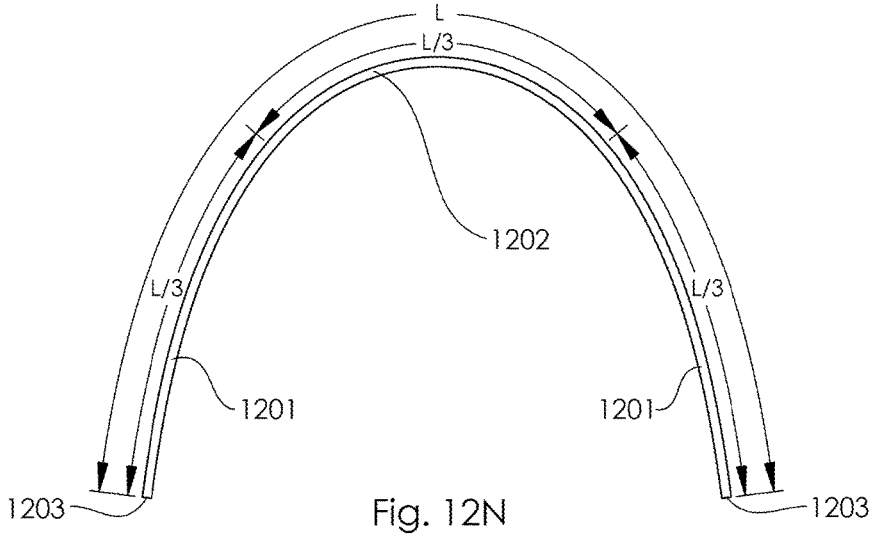
FIG. 12N is a front view of a flexible rod with an isolated at rest elliptical-like shape.
Figure 12O:
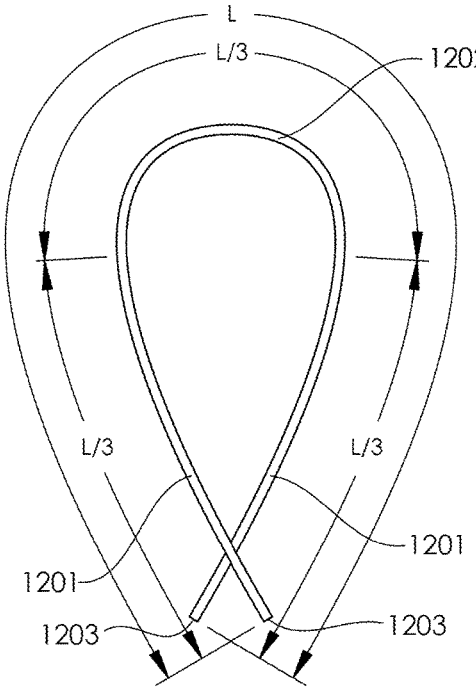
FIG. 12O is a front view of a flexible rod with an isolated at rest shape having a smaller radius of curvature than the rod of FIG. 12N.
Figure 12P:
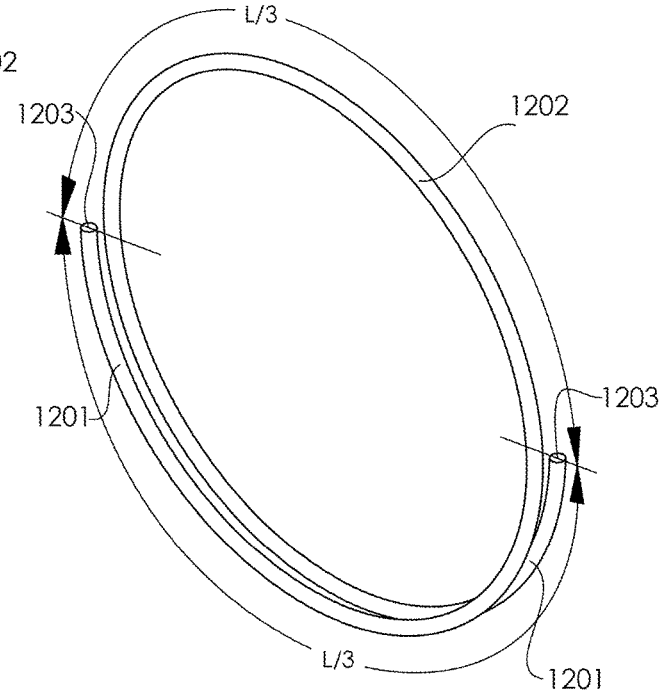
FIG. 12P is a front view of a flexible rod with an isolated at rest shape optimized for packing in a box whose longest length is less than a third of the total rod length.
Figure 12Q:
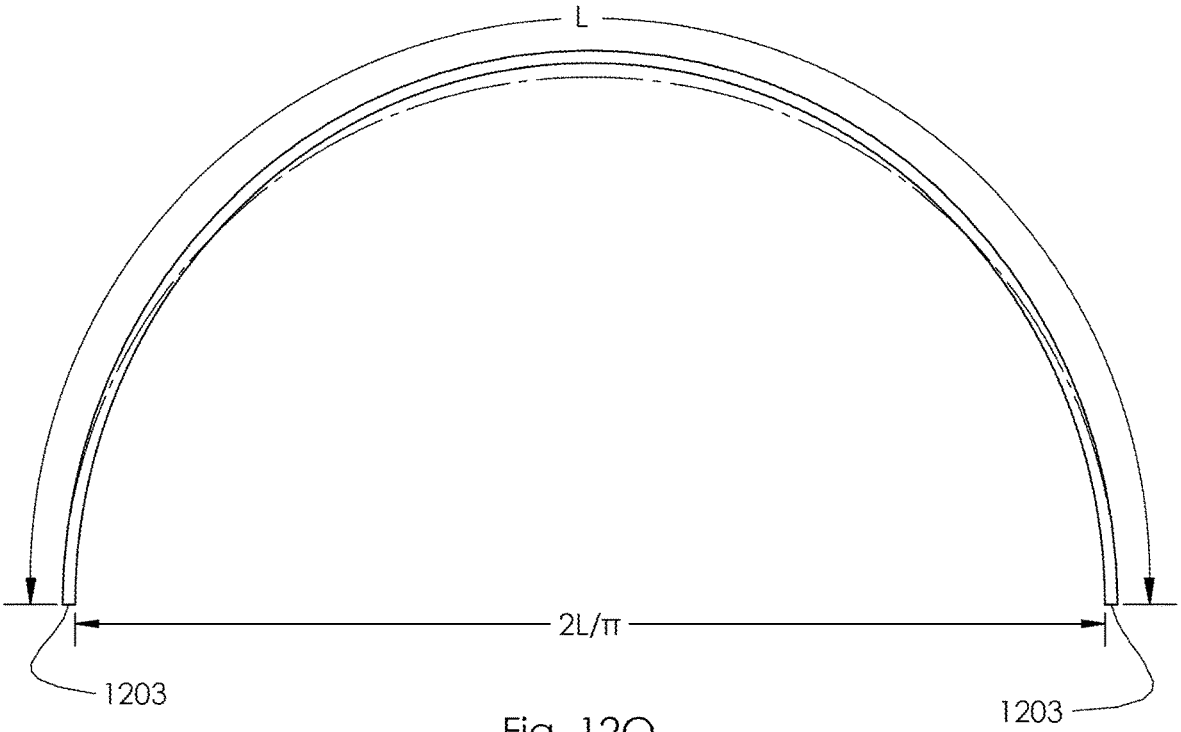
FIG. 12Q is a front view of the flexible rod of FIG. 12O under forces at the rod's functional ends to bend the rod to approximate a half circular shape.
Figure 12R:
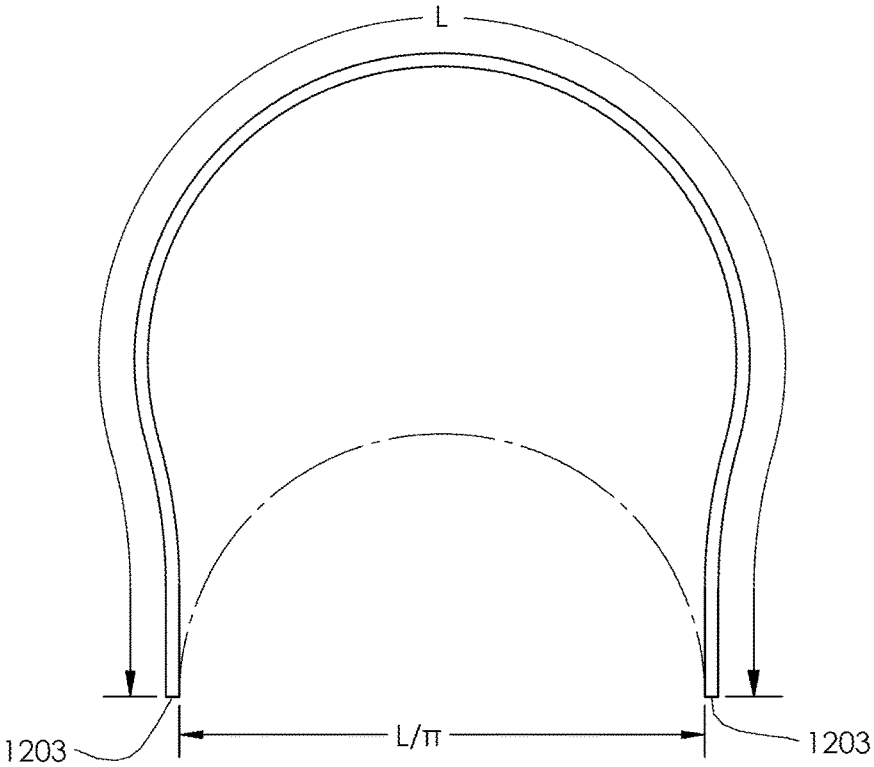
FIG. 12R is a front view of the flexible rod of FIG. 12O under forces at the rod's functional ends to bend the rod to approximate a smaller half circular shape.
Figure 12S:
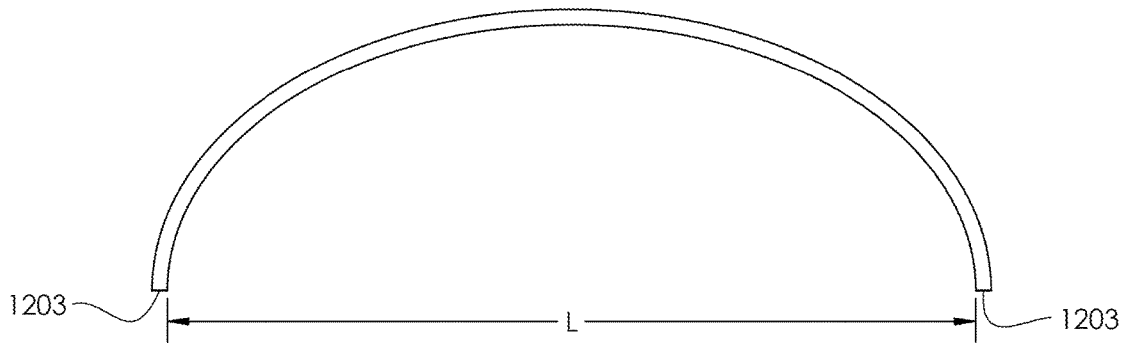
FIG. 12S is a front view of a semi-rigid rod.
Figure 12T:
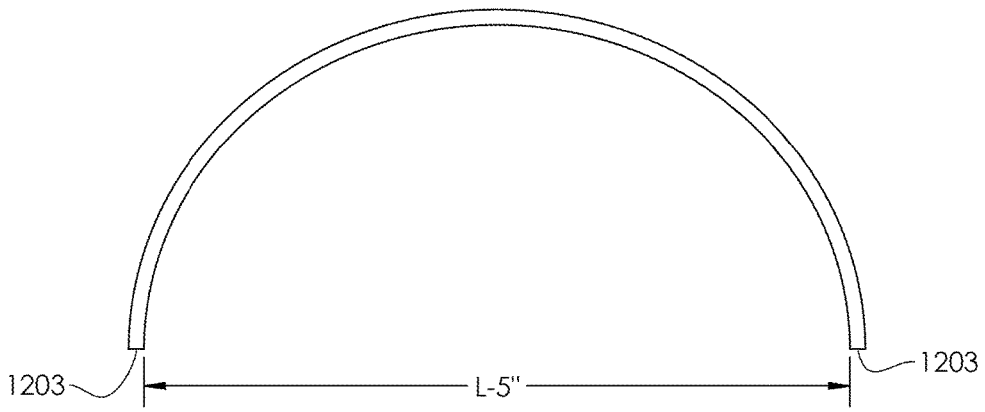
FIG. 12T is a front view of the semi-rigid rod of FIG. 12S under forces at the rod's functional ends to bend the rod to move the functional ends closer together.
Figure 12U:
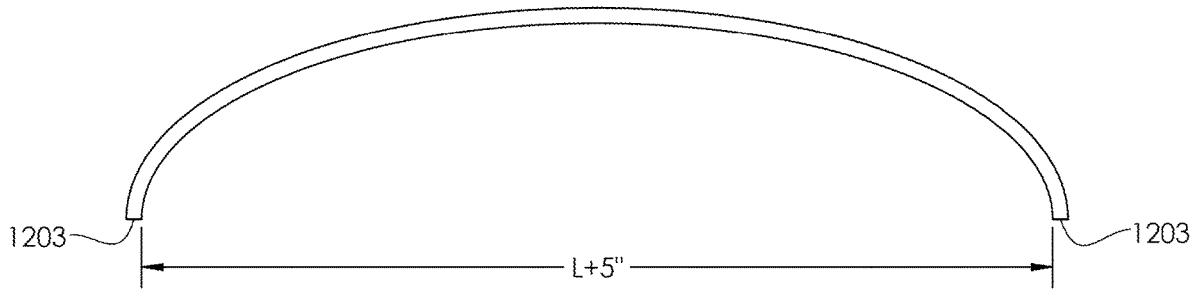
FIG. 12U is a front view of the semi-rigid rod of FIG. 12S under forces at the rod's functional ends to bend the rod to move the functional ends farther apart.
Figure 12V:
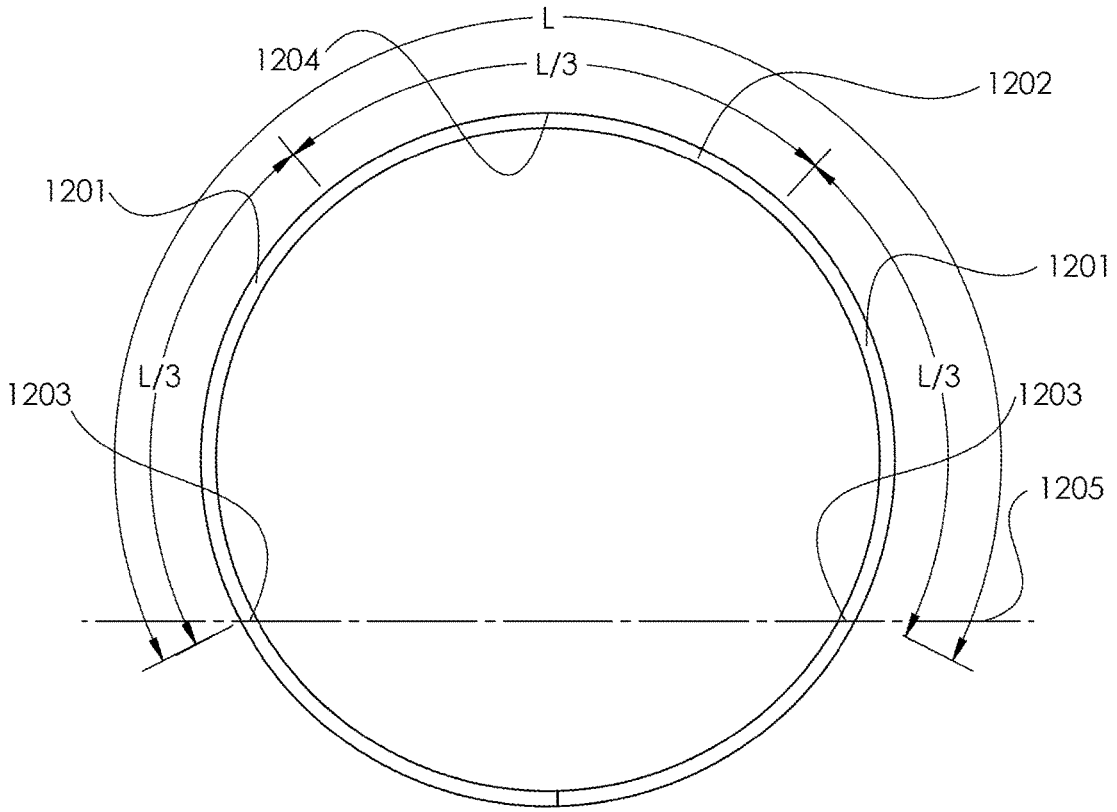
FIG. 12V is a front view of a looped rod.
Figure 12W:
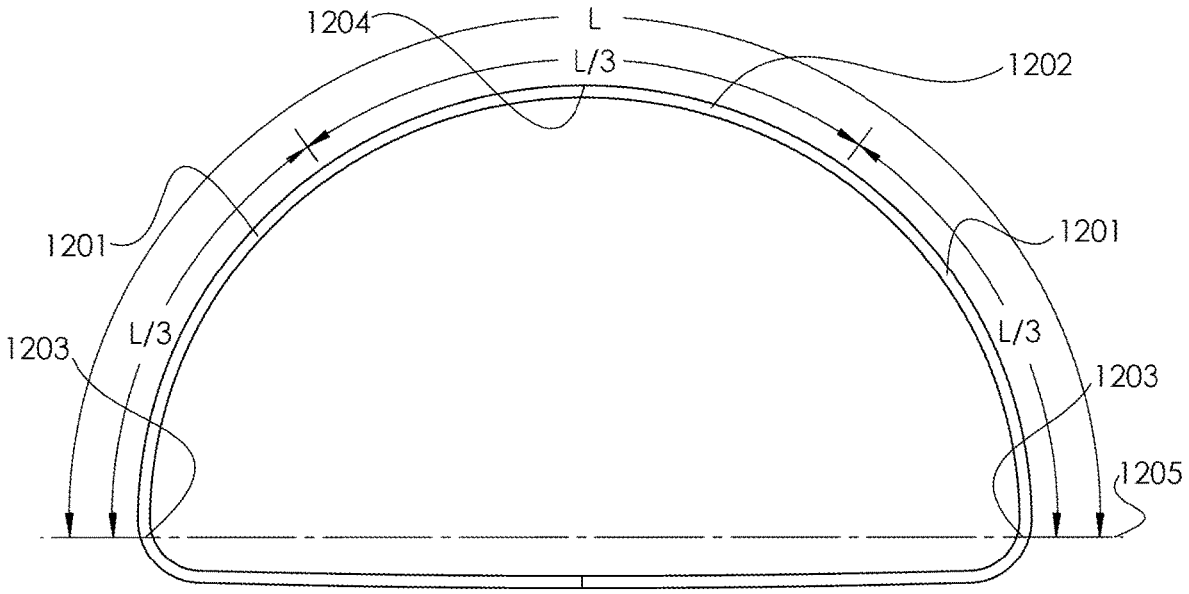
FIG. 12W is a front view of a looped rod.

Any of the following (but not limited to them) are considered examples of an arch: trapezoidal rods 1002 in FIG. 10A, FIG. 10B, FIG. 10C, FIG. 10D, FIG. 10E, rod structures 1003 in FIGS. 10F and 10G, side rods 1103 and end rods 1102 of FIG. 11A, FIG. 12V, or FIG. 12W.

Vertical Support Mast: is a special kind of rod-like member that is configured within the enclosure subsystem in a primarily vertical orientation and which provides reinforcing support by attaching or coupling of one end area of the vertical support mast to another supported rod. The orientation of a vertical support mast is not necessarily exactly vertical (i.e., masts may have a glancing angle less than 90°) but vertical support masts are typically oriented more vertically than rods and connect to the bed or frame subsystems or both subsystems in only one end area of a vertical support mast.

Horizontal Support Mast: is a special kind of rod-like member that is configured within the enclosure subsystem in a primarily horizontal orientation and which provides reinforcing support by attaching or coupling at least two distinct areas of the horizontal support mast to two distinct areas of another supported rod or of two separate rods. A horizontal support mast may optionally be looped. The orientation of a horizontal support mast is not necessarily exactly horizontal (i.e., masts may have a glancing angle greater than 0°) but horizontal support masts are typically oriented more horizontally than rods and do not connect to the bed or frame subsystems in any end area of a horizontal support mast.

Isolated at Rest: A rod is in its isolated at rest state when the rod is observed in isolation from the trampoline system by placing it by itself on a flat horizontal surface and letting the rod take its shape when no external forces (other than gravity) are acting upon it.

Assembled at Rest: A rod is in its assembled at rest state when the rod is observed in the context of an assembled trampoline system (without any users present) and letting the rod take its shape that results from the force of gravity on the rod and its coupling to the netting curtain and to other parts of the enclosure, frame, or bed subsystems. The assembled at rest state may alternatively be referred to as the relaxed state.

Functional End: The two extreme points along the longitudinal axis of a flexible rod or a semi-rigid rod at opposite ends of the rod that are the furthest apart along the rod's longitudinal axis. For rods that are not flexible rods and not semi-rigid rods, the functional ends of a rod are the two locations farthest apart from the rod apex along the rod where the rod is coupled to the frame or bed subsystem. For a vertical support mast, the functional ends are the two extreme points along the longitudinal axis of a vertical support mast at opposite ends of the vertical support mast that are the furthest apart along the vertical support mast's longitudinal axis. For a non-looped horizontal support mast, the functional ends are the two extreme points along the longitudinal axis of a horizontal support mast at opposite ends of the horizontal support mast that are the furthest apart along the horizontal support mast's longitudinal axis.

End Area: The portion of a rod, near each of the rod's functional ends, that is within a distance along the rod's curve length that is not greater than 33% of the total rod curve length (the rectification of the rod's curve) from either of the rod's two functional ends. However, for a looped rod, an end area is any portion of a rod in the direction of the apex from a functional end that is not greater than 33% of the rod's functional curve length (the rectification of the rod's curve through the rod apex between the rod's two functional ends) from the functional end. For a vertical support mast, the end area is the portion of a mast, near each of the vertical support mast's functional ends, that is within a distance along the vertical support mast's curve that is not greater than 33% of the total vertical support mast curve length (the rectification of the vertical support mast's curve) from either of the vertical support mast's two functional ends. For a non-looped horizontal support mast, the end area is the portion of a mast, near each of the horizontal support mast's functional ends, that is within a distance along the horizontal support mast's curve that is not greater than 33% of the total horizontal support mast curve length (the rectification of the horizontal support mast's curve) from either of the horizontal support mast's two functional ends.

Middle Area: The middle portion of a rod between its end areas, away from each of the rod's functional ends, that is within a distance along the rod's curve that is greater than or equal to 33% of the total rod curve length (the rectification of the rod's curve) from both of the rod's two functional ends. However, for a looped rod, the middle area is the portion of the rod between the end areas that is above the rebounding surface. For a vertical support mast, the middle area is the middle portion of a vertical support mast between its end areas, away from each of the vertical support mast's functional ends, that is within a distance along the vertical support mast's curve that is greater than or equal to 33% of the total vertical support mast curve length (the rectification of the vertical support mast's curve) from both of the vertical support mast's two functional ends. For a non-looped horizontal support mast, the middle area is the middle portion of a horizontal support mast between its end areas, away from each of the horizontal support mast's functional ends, that is within a distance along the horizontal support mast's curve that is greater than or equal to 33% of the total horizontal support mast curve length (the rectification of the horizontal support mast's curve) from both of the horizontal support mast's two functional ends.

Glancing Angle: The acute angle of a rod (or vertical support mast) where it meets (or its projection continuing along the path of the rod/mast meets) the plane of the rebounding surface. The glancing angle is measured as the acute angle between the plane of the rebounding surface and an imaginary plane. For a rod (or vertical support mast), the imaginary plane is defined by a best fit plane defined by the points along the portion of the rod (or vertical support mast) that is above the rebounding surface. The glancing angle is measured while the trampoline is unloaded (i.e., assembled at rest, without any jumpers or users). The glancing angle is often referred to as e.

Axial Force: (includes both tensile and compressive force) a normal force parallel to the length of the rod (or vertical support mast). The ability of a rod (or vertical support mast) to accept a pulling apart (tensile) or together (compressive) force that would tend to stretch or compress the rod (or vertical support mast) along its length and permit the force applied to be transmitted along the length of the rod (or vertical support mast).

Bed Subsystem: A trampoline bed and any coupling mechanism (e.g., bungee cords, coil springs, leaf springs, compression springs, or rod springs) that connects the bed to a trampoline frame and any pads positioned to cover a coupling mechanism. The bed subsystem does not include any portion of the frame subsystem or the enclosure subsystem as defined herein. A bed subsystem's mass refers only to the portion of the bed subsystem actually shipped to customers and/or dealers in practice and does not include any portions that the end customer and/or dealer is instructed to add (e.g., customer is instructed to add sand or water to weigh down the bed subsystem).

Standardized Mass of Bed Subsystem: A bed subsystem's standardized mass refers to the mass of a prototypical bed and spring system for a given frame's geometry and is given for many geometries shown in FIG. 24. It is derived from the following formula: Mat Area×(mass of Mat material per unit area)+Bed Perimeter×(mass of edging per unit length)+Bed Perimeter×(spring mass+v-ring mass+webbing mass)×(# of springs per unit length). Where, the mass of matt material per unit area is 257.64 $gm^{-2}$; the mass of edging per unit length is 44.64 $gm^{-1}$; the spring mass is 136 g; the v-ring mass is 13 g; the v-ring webbing mass is 7.44 g; and the number of springs per unit length is 8 springs per meter. The mat perimeter diameter is taken to be 0.5 m less than the frame diameter.

Frame Subsystem: A trampoline frame including one or more perimeter frame members, any frame legs that support the perimeter frame members, and any connectors that join the frame legs to the perimeter frame members. The frame subsystem does not include any portion of the bed subsystem or the enclosure subsystem as defined herein. A frame subsystem's mass refers only to the portion of the frame subsystem actually shipped to customers and/or dealers in practice and does not include any portions that the end customer and/or dealer is instructed to add (e.g., customer is instructed to add sand or water to weigh down the frame subsystem). A frame subsystem may alternatively be referred to as a frame.

Enclosure Subsystem: A net, rods that support the net, any vertical support masts, any rod padding, and any connectors (including any sleeves or straps) that join, couple, or attach the net, vertical support masts, and/or rods to each other and/or to the bed subsystem or frame subsystem. The enclosure subsystem does not include any portion of the frame subsystem or the bed subsystem as defined herein. An enclosure subsystem's mass refers only to the portion of the enclosure subsystem actually shipped to customers and/or dealers in practice and does not include any portions that the end customer and/or dealer is instructed to add (e.g., customer is instructed to add sand or water to weigh down the enclosure subsystem). An enclosure subsystem may alternatively be referred to as an enclosure, safety enclosure, safety enclosure subsystem, net enclosure, or safety net enclosure. The corresponding elements for an enclosure subsystem in a trampoline solution that includes jumper enclosing protections are referred to as a safety net system herein and correspondingly the safety net system's mass which correspondingly only includes portions shipped to the customer and/or dealer.

Cross: Two rods, a rod and a vertical support mast, or two segments cross each other if when assembled within the enclosure subsystem in an assembled at rest state and viewed from a point three feet above the centroid of the jumping surface, the paths of the two appear to intersect in an x-shape at a relative angle of greater than 100, such as when one passes behind the other. For example, the x-shaped crossing point 708 of FIG. 7B has two rods 702 crossing each other and the x-shaped crossing segments of rod structures 1003 in FIG. 10F have two segments that cross each other.

Crossing Point: When two rods, a rod and a vertical support mast, or two segments cross each other, the point half way between the two, in the center of the area where the paths of the two appear to intersect as viewed from the point three feet above the centroid of the jumping surface. For example, the crossing point 708 of FIG. 7B where rods 702 cross each other. A crossing point may alternatively be referred to as a junction point.

Center Area: In an assembled enclosure subsystem, the center area is any mid-point along the span of a rod, vertical support mast, or horizontal support mast between two adjacent points. The adjacent points are selected from the points where the rod, vertical support mast, or horizontal support mast crosses another rod in an enclosure subsystem, the end points on the rod's, vertical support mast's, or horizontal support mast's functional ends, or any other fixed point of a rod, vertical support mast, or horizontal support mast in the enclosure subsystem such as where it passes through, couples to, attaches to, connects to, or is connected to a point on the bed subsystem, perimeter area, or frame.

Bed Perimeter: In an assembled trampoline system, within the bed subsystem, the bed perimeter is the edge of the rebounding surface which is delineated by the outer edge of the area upon which a user is intended to jump (e.g., the outer edge of the bed where the bed is coupled to springs).

Perimeter Area: In an assembled trampoline system, including a rebounding surface, the perimeter area is a volume that extends alongside and inwardly/outwardly of the bed perimeter on the jumping surface, for example as shown schematically in FIGS. 19A-19C. In particular, the perimeter area is the volume around the bed perimeter 1907 containing all the points whose shortest distance to the perimeter, for example point $P_1$ in the volume with shortest distance $D_1$ to the perimeter at point $P_2$, is less than distance $D_3$ which is 15% of the distance $D_2$ between a third point, for example point $P_3$, along the perimeter whose distance $D_2$ is the shortest distance to the centroid C of the rebounding surface. In rod spring (or leaf spring) embodiments, the perimeter area is expanded such that distance $D_1$ is expanded to be less than 25% of distance $D_2$ so that the upper frame perimeter is included in the perimeter area.

Loaded Weight: The loaded weight refers to the total weight borne by the rods and vertical support masts of an enclosure subsystem and is comprised of the mass of all portions of the enclosure subsystem that are suspended by the rods and vertical support masts, including the mass of the rods themselves, the mass of the netting curtain supported by the rods, and the mass of any other parts of the enclosure subsystem such as connectors, straps, sleeves and cross-patches.

Assembled Bending Rigidity: An assembled enclosure subsystem's rod's (or vertical support mast's) ability to resist bending deflection. This is determined by the pulling force required, applied by an approximately half-inch wide strap, wrapped around a Center Area of a rod (or vertical support mast), to deflect a rod (or vertical support mast) by pulling on it, divided by the amount of bending deflection at its central area while the rod (or vertical support mast) is in its assembled enclosure subsystem location $$\left(k_b = \frac{F}{\delta}\right).$$

Isolated Bending Rigidity: This measure is generally easier to perform than the Assembled Bending Rigidity that this measure is representative of. It may be measured in isolation of an assembled enclosure subsystem by using an unassembled rod (or vertical support mast) (i.e., the rod (or vertical support mast) by itself without the netting curtain) by cutting a two foot section and lying the section of the rod (or vertical support mast) horizontally across two support points (one fixed and one roller support point) near the rod (or vertical support mast) section's center, placed one foot apart and measuring the force required, applied by a weighted half-inch wide strap on the top of the rod (or vertical support mast) to create a load at its mid-point between the two support points, to deflect the rod (or vertical support mast) divided by the amount of bending deflection at its mid-point $$\left(k_b = \frac{F}{\delta}\right).$$

See Section 4.1—Rigidity and Self-Supporting for complete details.

Bending Moment: The internal reaction forces inside a beam member which balance applied bending loads. A bending moment results in tension on one side of the beam and compression on the opposite side of the beam.

In Plane Bending: Bending caused by a load applied to an arched rod member that lies on the best-fit plane formed by the rod's curvature. The geometry of an arched rod member results in a high stiffness in response to in plane bending loads. For a vertical rod, none of the bending is in plane bending.

Out of Plane Bending: Bending caused by a load applied to an arched rod member normal to the best-fit plane formed by the rod's curvature. The geometry of an arched rod member results in a low stiffness in response to out of plane bending loads. For a vertical rod, all bending is out of plane bending.

Flexural Rigidity: The isolated bending rigidity times the cube of the length of the span of the rod (or vertical support mast) when determining the bending rigidity, divided by a constant of 48. The flexural rigidity is an approximation for the elastic modulus times the moment of inertia. The flexural rigidity formula is derived from the max bending deflection equation for a simply supported beam (i.e., has a pinned/fixed support at one end and a roller support at the other end) with a constant cross-section and a point load at the center. The relationship for flexural rigidity in symbolic form is $$\text{Flexural Rigidity} = EI = \frac{k_b * l^3}{48}.$$

Net: An expanse of flexible material which forms an enclosing curtain around a trampoline that protects a user from falling off a trampoline. A net is a barrier made of connected strands of metal, fiber, or other flexible or ductile materials, including a mesh, web, or netting in that they have many attached or woven strands. In some embodiments, it is advantageous that a net has a concave-upwards stress-strain curve (the amount of force required to stretch the net by a given amount increases the further the net is stretched). In some embodiments, it is advantageous that a net be composed of hexagonal or triangular apertures rather than square or rectangular apertures. In advantageous embodiments, the net material is resistant to breaking down in ultraviolet light. It is advantageous that the net extends at least 4.5 feet above the rebounding surface for use with smaller users or on beds with a surface area of less than 3,300 $in^2$ (e.g., a circular bed with less than approximately a 65-inch diameter). With circular beds with a diameter less than 10 feet, it is advantageous that the net extends at least 5 feet above the rebounding surface. It is more advantageous that the net extends at least six feet above the rebounding surface for use with most users and with circular beds with a diameter of 10 feet or more. For rectangular beds, it is advantageous that the net extends to a height of at least the greater of 5 feet or one half of the rectangular bed's longest side (e.g., for a 14×8 rectangular bed, the net advantageously extends at least 7 feet above the bed and for a 9×6 bed, at least 5 feet). The net may alternatively be referred to as a curtain, netting curtain, or netting surface.

User: A user is defined as any sized person able to jump on any of the disclosed trampoline systems. The disclosed devices are usable by any person of any size. The adult and adult sized users of the disclosed devices are usually individuals between a height of 4 feet 7 inches and 6 feet 10 inches, with a weight range between 70 lb to 500 lb, though generally, the common user falls within the range of normal weights of the general population. Children between the ages of 4 to 8 may also use one of these devices, but their bodyweight is generally lighter, between 30 to 80 lb. Young people between the ages of 8 and 16 can vary greatly in weight and size, from 50 lb to more than 400 lb. The disclosed devices are configurable, and in many embodiments adjustable, to enable optimization for individuals in these various weight ranges and age groups.

Enclosure Specified User Weight: A specified weight for which an Enclosure Impact Weight Rating test passes.

Maximum Enclosure Specified User Weight: The greatest Enclosure Specified User Weight for which an Enclosure Impact Weight Rating test still passes.

Enclosure Impact Weight Rating: The weight rating under the ASTM F 2225-15 Performance Requirement Test #1 (see section 6.1—Barrier Impact and Enclosure Support Pole (Frame) Impact Tests) DOI: 10.1520/F2225-15 and available at http://www.astm.or/ci-bin/resolver.cgi?F2225-15 except that, the ASTM test is modified such that the maximum specified user weight in section 3.1.7 is replaced by a different mass, specified herein, named the Enclosure Specified User Weight, such as a mass that is 11 times the mass of the enclosure subsystem. The Enclosure Specified User Weight value that is used to replace the maximum specified user weight may understate or overstate the highest maximum specified user weight that could be achieved when applying the test described in § 6.8 of ASTM F381-16. Under ASTM F381-16, manufacturers are expected to ensure that the maximum specified user weight meets the test requirements of § 6.8. The maximum specified user weight of § 6.8 is the same weight at which all ASTM trampoline and enclosure tests are conducted. For purposes of our claims and specifications in this patent, the maximum specified user weight is presumed to be the Enclosure Specified User Weight, regardless of whether the Enclosure Specified User Weight exceeds the Maximum User Weight achieved where the Maximum User Weight divided by 21% will displace the bed of the trampoline by 80% (+/−0.5 in. (12 mm)) of the distance to the ground when the bed is loaded using the disk specified in FIG. 5 of ASTM F381-16. Additionally, the ASTM test is modified to specify that the four impacts are composed of two Standard Rod Impacts at the same location, one Standard Net Impact, and one Standard Opening Impact. Future revisions to these ASTM standards shall not affect the references or the claims in this patent or calculations relying thereon.

Standard Rod Impact: An impact, corresponding to one of the two support pole impacts of § 6.1 of the ASTM F 2225-15, using a given Enclosure Specified User Weight applied against an enclosure support pole at a height mid-distance between the top and bottom of the enclosure barrier (e.g., at impact center location 2107 in FIG. 21A). In the disclosed embodiments where rods are arched, the standard rod impact is applied to an arched rod and not applied to any vertical support masts.

Standard Medium Rod Impact: A standard rod impact using an Enclosure Specified User Weight that is 7 times the mass of the enclosure subsystem.

Standard Large Rod Impact: A standard rod impact using an Enclosure Specified User Weight that is 11 times the mass of the enclosure subsystem.

Standard Extra Large Rod Impact: A standard rod impact using an Enclosure Specified User Weight that is 12 times the mass of the enclosure subsystem.

Standard Huge Rod Impact: A standard rod impact using an Enclosure Specified User Weight that is 13 times the mass of the enclosure subsystem.

Standard Extra Huge Rod Impact: A standard rod impact using an Enclosure Specified User Weight that is 14 times the mass of the enclosure subsystem.

Standard Giant Rod Impact: A standard rod impact using an Enclosure Specified User Weight that is 15 times the mass of the enclosure subsystem.

Standard Extra Giant Rod Impact: A standard rod impact using an Enclosure Specified User Weight that is 16 times the mass of the enclosure subsystem.

Standard Humongous Rod Impact: A standard rod impact using an Enclosure Specified User Weight that is 17 times the mass of the enclosure subsystem.

Standard Extra Humongous Rod Impact: A standard rod impact using an Enclosure Specified User Weight that is 18 times the mass of the enclosure subsystem.

Standard Gigantic Rod Impact: A standard rod impact using an Enclosure Specified User Weight that is 19 times the mass of the enclosure subsystem.

Standard Extra Gigantic Rod Impact: A standard rod impact using an Enclosure Specified User Weight that is 20 times the mass of the enclosure subsystem.

Standard Net Impact: An impact, corresponding to one of the barrier impacts of § 6.1 of the ASTM F 2225-15, using a given Enclosure Specified User Weight directed at a point on the barrier (net) midway between the support poles (rods) at a height mid-distance between the top and bottom of the enclosure barrier (e.g., at impact center location 2108 on net 2105 in FIG. 21D). In the disclosed embodiments where rods are arched, the midway between support poles shall mean a point along the netting curtain halfway between the top and bottom of the netting curtain (often at a point directly below the apex of a rod (e.g., rod apex 2109 of rod 2102 in FIG. 21D-21F), but not when vertical support masts are employed to support the apex) equidistant from the points at the same height that are on the closest two rod portions or vertical support masts.

Standard Stress Net Impact: An impact, corresponding to one of the barrier impacts of § 6.1 of the ASTM F 2225-15, using a given Enclosure Specified User Weight directed at a point on the barrier (net) midway between crossing support poles (rods) at a height mid-distance between the top and bottom of the enclosure barrier (e.g., at impact center location 2211 on net 2205 in FIGS. 22A-22B). In the disclosed embodiments where rods are arched, the point midway between crossing support poles shall mean a point along the netting curtain halfway between the top and bottom of the netting curtain (at a point directly below the crossing of two rods (e.g., crossing point 2210 of rods 2202 in FIG. 22A-22B)) equidistant from the points at the same height that are on the closest two rod portions.

Standard Medium Net Impact: A standard net impact using an Enclosure Specified User Weight that is 7 times the mass of the enclosure subsystem.

Standard Large Net Impact: A standard net impact using an Enclosure Specified User Weight that is 11 times the mass of the enclosure subsystem.

Standard Stress Large Net Impact: A standard stress net impact using an Enclosure Specified User Weight that is 11 times the mass of the enclosure subsystem.

Standard Extra Large Net Impact: A standard Net impact using an Enclosure Specified User Weight that is 12 times the mass of the enclosure subsystem.

Standard Huge Net Impact: A standard Net impact using an Enclosure Specified User Weight that is 13 times the mass of the enclosure subsystem.

Standard Extra Huge Net Impact: A standard Net impact using an Enclosure Specified User Weight that is 14 times the mass of the enclosure subsystem.

Standard Giant Net Impact: A standard Net impact using an Enclosure Specified User Weight that is 15 times the mass of the enclosure subsystem.

Standard Extra Giant Net Impact: A standard Net impact using an Enclosure Specified User Weight that is 16 times the mass of the enclosure subsystem.

Standard Humongous Net Impact: A standard Net impact using an Enclosure Specified User Weight that is 17 times the mass of the enclosure subsystem.

Standard Extra Humongous Net Impact: A standard Net impact using an Enclosure Specified User Weight that is 18 times the mass of the enclosure subsystem.

Standard Gigantic Net Impact: A standard Net impact using an Enclosure Specified User Weight that is 19 times the mass of the enclosure subsystem.

Standard Extra Gigantic Net Impact: A standard Net impact using an Enclosure Specified User Weight that is 20 times the mass of the enclosure subsystem.

Standard Opening Impact: An impact, corresponding to one of the barrier impacts against the enclosure opening of § 6.1 of the ASTM F 2225-15, using a given Enclosure Specified User Weight directed as close as possible to the mid-distance between the top and bottom of the opening in the barrier used for entrance to the chamber defined by the netting curtain.

Standard Medium Opening Impact: A standard opening impact using an Enclosure Specified User Weight that is 7 times the mass of the enclosure subsystem.

Standard Large Opening Impact: A standard opening impact using an Enclosure Specified User Weight that is 11 times the mass of the enclosure subsystem.

Standard Extra Large Opening Impact: A standard Opening impact using an Enclosure Specified User Weight that is 12 times the mass of the enclosure subsystem.

Standard Huge Opening Impact: A standard Opening impact using an Enclosure Specified User Weight that is 13 times the mass of the enclosure subsystem.

Standard Extra Huge Opening Impact: A standard Opening impact using an Enclosure Specified User Weight that is 14 times the mass of the enclosure subsystem.

Standard Giant Opening Impact: A standard Opening impact using an Enclosure Specified User Weight that is 15 times the mass of the enclosure subsystem.

Standard Extra Giant Opening Impact: A standard Opening impact using an Enclosure Specified User Weight that is 16 times the mass of the enclosure subsystem.

Standard Humongous Opening Impact: A standard Opening impact using an Enclosure Specified User Weight that is 17 times the mass of the enclosure subsystem.

Standard Extra Humongous Opening Impact: A standard Opening impact using an Enclosure Specified User Weight that is 18 times the mass of the enclosure subsystem.

Standard Gigantic Opening Impact: A standard Opening impact using an Enclosure Specified User Weight that is 19 times the mass of the enclosure subsystem.

Standard Extra Gigantic Opening Impact: A standard Opening impact using an Enclosure Specified User Weight that is 20 times the mass of the enclosure subsystem.

Center of Impact: The center of impact is the location (e.g., impact center location 2107 in FIG. 21A-21C and impact center location 2108 in FIG. 21D-21F) where the centroid of mass of the test bag providing the load, projected onto the face presented by the test bag (e.g., for bag 2103, the center of the bag's face 2110 in FIG. 21A-21F) in a standard rod impact, standard net impact, or standard opening impact when the test bag initially impacts the barrier.

Rebounding Effect: An elastic effect in opposition to the impact force of a body.

The jumping surface of the trampoline may interchangeably be referred to as the bed, jump bed, jumping bed, rebound bed, rebounding bed, trampoline bed, jump surface, jumping surface, rebound surface, rebounding surface, trampoline surface, trampoline mat, mat, and the like.

The trampoline system comprises a frame subsystem, a bed subsystem, and an enclosure subsystem. The trampoline system may interchangeably be referred to as a trampoline safety enclosure system, trampoline enclosure system, and the like.

4. Advantageous Key Metric Ranges and Limits

Each of the following ranges and limits has been shown to be optimal by modeling, experimentation and testing. However, the ranges may vary with slightly less optimal characteristics, or may vary for highly specific uses. For each of these ranges and limits, a user and/or manufacturer may adjust the key metrics of the disclosed embodiments to configure and adjust for advantageous operation, such as by an adjustment mechanism.

4.1. Rigidity and Self-Supporting

When a rod's (or vertical support mast's) isolated bending rigidity is referenced it pertains to the rod's (or vertical support mast's) ability to resist bending deflection such as by the following disclosed test that is based upon standard test method ASTM D 4476-03. Each rod (or vertical support mast) being tested is cut down to a 24 in rod (or vertical support mast) sample section and is simply supported (i.e., has a pinned/fixed support at one end and a roller support at the other end) one foot apart from each other and evenly spaced around the rod (or vertical support mast) sample's center (e.g., fixed support 1805 and roller support 1806 in FIGS. 18A-18B) and is tested with two different weights or pulling forces applied by suspending the weights using a half-inch wide strap attached to a roller placed at the center of the one-foot span between supports (e.g., force F in FIG. 18B) and the resulting bending deflections of the rod (or vertical support mast) sample's center where the strap is hung from the roller are measured (e.g., the difference between the quantity of the loaded measure y2 in FIG. 18B and unloaded measure y1 in FIG. 18A), graphed, and given a best fit straight line that has a y-intercept equal to zero so that the linear curve fit is of the form y=mx. Note that the weights are adjusted to include the weight of the roller and strap such that the total weight of the applied weights matches the target test weight. The bottom surface 1808 of the rod (or vertical support mast) sample 1801 is supported at opposite ends 1803 and 1804 and the supports 1806 and 1805 are placed approximately 6 inches from each end 1803 and 1804. The weights range up to 20 lb. For each applied weight (force) the resulting bending deflection (e.g., the difference between the quantity of the loaded measure y2 and unloaded measure y1) is recorded. The bending deflection is tested using two different load weights to permit graphing the bending deflection for each rod (or vertical support mast) sample over a range of two loads. The two load weights are selected to be evenly spread out across the range from 0 lb to 20 lb (i.e., one weight of 10 lb and the second of 20 lb). However, in the case that the resulting bending deflection for the 20 lb weight (force) causes the supported device 1801 to exceed 2% fiber strain, fail, break, fall, or collapse, the range of the selected weights is linearly scaled downward (e.g., all by ½) to an adjusted weight range such that the maximum weight of the range maximally deflects (e.g., 3 in) the device to the point just short (e.g., within 95% of the weight) of causing the supported device to reach 2% fiber strain, fail, break, fall, or collapse.

In the above test, 2% fiber strain is as measured in the outer fibers of the rod (or vertical support mast) sample under test. Given a strain, e, a flexural modulus of elasticity, E, a length, L, and a rod (or vertical support mast) sample radius, r, the equation for the center load, P, is $P=\pi\varepsilon E r^3/2L$. Making some simplifying assumptions and calculating this for 3 typical sizes of cylindrical fiberglass plastic rods (or vertical support masts) (i.e., 0.25, 0.375, and 0.50 in diameter), the force to get to 2% fiber strain is 30 lb for 0.25, 100 lb for 0.375 in, and 250 lb for 0.50 in. Therefore, in practice, for the above test, the 2% fiber strain is not reached with a 20 lb load with most of the rods disclosed.

An example of two load weights (inclusive of the weight of the roller and strap) spread evenly across the weight range of 0 lb to 20 lb is weights at 20 and 10 lb. Such load weights are selected to be within a reasonable error tolerance such as plus or minus 4%, e.g., for a target of 20 lb any weight between 20.8 lb and 19.2 lb is acceptable.

A dial indicator or other measuring device that is accurate to 0.001 inches is recommended to use. The ten data points, evenly spread across the weight range, are recorded to analyze the data. For the analysis, the bending deflection is the x-axis (horizontal) and the applied force (weight) is the y-axis (vertical). The data gathered from this testing and experimentation is assumed linear and has a y-intercept equal to zero so that the linear curve fit is of the form y=mx. Any rod (or vertical support mast) sample that deforms under its own weight, before any load weights are added, so much as to make it collapse and thus practically impossible for the tester to support the rod (or vertical support mast) sample at its ends without clamping it to the test support points, does not fall within the disclosed ranges for isolated bending rigidity. The slope (m) of the disclosed best fit straight line corresponds to the isolated bending rigidity of the rod (or vertical support mast) sample.

4.2. Elliptical or Convex Curvature and Shape

Disclosed are rods embodying a curved, elliptical, rounded, convex, arched, segmented, or polygonal (e.g., see FIGS. 10A-10G) shape along the curtain of the installed perimeter netting. Opposite ends of each rod path are advantageously situated near the supporting jump surface perimeter (near the perimeter area) and the bottom edge of the netting surface (or curtain). The center section or apex of each rod path is situated far above the jump surface and near the supported top edge of the netting surface. The rods' shapes in their installed forms and the bending forces they maintain on the perimeter netting provide the primary forces acting on the netting curtain to define, support, and maintain its surface shape relative to the netting bottom edge that is affixed to the perimeter area of the jump surface. The rods lie primarily within or near the surface of the netting curtain although in some embodiments the rods extend below the jump surface and thus beyond the netting surface, whose enclosing function is only required from the jump surface and upward. In some embodiments, the rods advantageously extend beyond the upper edge of the netting. When the rods extend beyond the limits of the netting curtain surface, the rods remain within or near the imaginary surface projected beyond the top and bottom edges of the netting. The perimeter netting surface advantageously extends directly upward (i.e., perpendicular to the plane of the jump surface) from the jump surface perimeter area (e.g., for a circular jump surface, the perimeter netting advantageously forms a cylinder). The rods are advantageously employed to create a netting surface that approaches the shape of extending directly upward (i.e., approximating to a 90° angle) from the jump surface perimeter area.

Because the netting curtain advantageously extends directly upward from the jump surface perimeter area and the apex of each rod is situated near the supported top edge of the netting curtain, when viewed from above, the path of each rod advantageously follows or approximates the perimeter shape of the jump surface and thus advantageously does not pass over the interior of the jump surface, or if it does pass over the interior of the jump surface, the spans passing over the interior are advantageously minimized.

For jump surfaces that are continuously curved in a convex manner, the rod path as viewed from above is more readily controlled to trace the perimeter of the jump surface and not pass over the interior of the jump surface nor pass outside the perimeter of the jump surface. Whereas, for jump surfaces with corners, such as rectangular and octagonal trampoline beds, the rods in some embodiments do diverge from the jump surface perimeter and pass over the interior or exterior of the jump surface perimeter, but such transversals advantageously do not encroach more than 30% of the radius inward from the perimeter toward the centroid of the jump surface or more than 15% of the radius outward from the perimeter away from the centroid of the jump surface and the spans wherein the deviation from the perimeter radius exceeds 10% do not account for more than 20% of the total rod length. Such limited encroachments ensure the unusable jump surface that is eclipsed by the netting is limited to the regions of the jump surface with reduced jumping performance that are generally found near the jump surface perimeter and especially found near the corners for jump surfaces with corners (e.g., rectangular trampoline beds).

4.3. Bending Stress and Tensile Stress

Disclosed are enclosure subsystems utilizing fiberglass plastic rods (or vertical support masts) that can sustain bending stress (rigidity) and tensile stress of at least 5,000 $lb \times in^{-2}$ without damage or permanent deformation. If the measured angle of an enclosure rod in its assembled at rest shape is greater than 10° from its original measured angle after the sustained bending stress and/or tensile stress, it shall be interpreted as a permanent deformation. The following table 4-1 lists the bending and tensile stress a rod (or vertical support mast) composed of the various listed materials is capable of sustaining without rod (or vertical support mast) damage or permanent deformation for different types of rod (or vertical support mast) materials:

TABLE 4-1

| Material | Required Maximum Stress without Damage |
|---|---|
| Plastic | 5,000 lb × $in^{-2}$ |
| Unidirectional Fiberglass Composite | 100,000 lb × $in^{-2}$ |
| Aluminum | 20,000 to 40,000 lb × $in^{-2}$ |
| Titanium | 140,000 lb × $in^{-2}$ |
| Carbon Fiber | 200,000 lb × $in^{-2}$ |
| Steel | 30,000 to 100,000 lb × $in^{-2}$ |

5. Adjustability of Key Metrics

In some embodiments, the enclosure subsystem is adjustable to account for the weight or capabilities of jumpers. In some such embodiments (e.g., see FIGS. 9A-9D), rods run through the jump surface and are connected to the frame (e.g., connected by sleeve 906, support 907, and leg strap 908) to permit adjustability. By providing multiple holes in the bed, during assembly, one may configure the glancing angle of rods (and thereby also configuring the rod apex height) by maintaining the length of the span of the portion of each rod above the bed while changing how far apart the holes are (i.e., changing the angle between the points where the rod intersects the surface of the trampoline bed and the center of the trampoline bed a) that are selected to run the rods through. Multiple holes also permit, during assembly, configuring the number of rods utilized. Because the distance a rod spans along the perimeter increases when selecting holes that are further apart (i.e., holes having a greater angle α) while maintaining a constant glancing angle and apex height, in this mode of adjustability, the poles extend to a lesser amount below the bed, protruding out of its underside, to account for the greater span a pole traverses between the holes when maintaining a generally constant rod apex (e.g., apex 106 in FIG. 1A) height above the jump surface to match a given netting curtain height in embodiments where the rod apex does not extend above the top of the netting curtain.

Adjustability is also afforded by selecting a different netting. The height of the netting above the jump surface may be shorter (e.g., 4.5 feet) for jumpers that do not jump as high or taller (e.g., six feet) for jumpers that jump higher. A rod's angle is adjusted, and different holes are selected, to account for the height of a given net. Netting with different mesh hole apertures, mesh hole shapes, and stretchiness may be selected for differing target weight and capabilities of jumpers.

Further examples of an adjustment mechanism include the following: tensioners whereby the portion of a rod 902 that protrudes below the bed 904 into support sleeve 906 of the trampoline is more or less tensioned with additional supports 907 and leg straps 908 relative to the frame 901; assembling the support rods 502 into different mounting holes 506 and 507 to produce different glancing angles or different rod apex height and optionally crossing the rods near the trampoline bed (see also support rods 602 and mounting holes 606 and 607, and support rods 702 which cross at crossing point 708 and mounting holes 706 and 707); adjustable strap mechanism; and ratcheting mechanisms. In some embodiments, the foregoing adjustment mechanisms are also be applied to vertical support masts.

For circular trampoline beds in embodiments where the rod apex defines the netting curtain height and a rod path is closely approximated by an ideal elliptical path along a cylinder of the netting curtain, for which the trampoline bed provides a base, the rod apex height above the trampoline bed v is a function of the radius of the cylinder r, the angle between the points where the rod intersects the surface of the trampoline bed and the center of the trampoline bed a, and the glancing angle of the ellipse formed by the rod path θ by the following equation:

$$v = \tan(\theta) r\left(1 - \cos\left(\frac{\alpha}{2}\right)\right).$$

The radius of curvature of the ideal ellipse at its major axis R is a function of the radius of the cylinder r, and the glancing angle of the ellipse formed by the rod path θ by the following equation: R=cos(θ) r. The following table 5-1 provides a for various glancing angles (θ) and various diameters (2r) of trampolines in order to achieve a six-foot height (v) of the rod apex above the trampoline bed and the resulting ratio of curvature:

$$\frac{R}{r}:$$

TABLE 5-1

| Glancing Angle (θ) | 15-foot diameter (α) | 14-foot diameter (α) | 12-foot diameter (α) | 10-foot diameter (α) | Ratio of Curvature $\frac{R}{r} = \cos(\theta)$ |
|---|---|---|---|---|---|
| 30° | 225.4° | 238.0° | 274.1° | n/a | 0.866 |
| 35° | 196.4° | 205.9° | 230.7° | 271.1° | 0.819 |
| 40° | 174.7° | 182.5° | 202.1° | 230.9° | 0.766 |
| 45° | 156.9° | 163.6° | 180.0° | 203.1° | 0.707 |
| 50° | 141.6° | 147.4° | 161.5° | 180.8° | 0.643 |
| 55° | 127.8° | 132.9° | 145.1° | 161.6° | 0.574 |
| 57° | 122.6° | 127.4° | 139.0° | 154.5° | 0.545 |
| 60° | 114.9° | 119.3° | 130.0° | 144.2° | 0.500 |
| 64° | 104.8° | 108.8° | 118.4° | 131.0° | 0.438 |
| 68° | 94.8° | 98.4° | 106.8° | 118.0° | 0.375 |
| 72° | 84.5° | 87.6° | 95.1° | 104.8° | 0.309 |
| 72.5° | 83.2° | 86.3° | 93.6° | 103.1° | 0.301 |
| 76° | 73.6° | 76.3° | 82.7° | 91.0° | 0.242 |
| 78.5° | 66.3° | 68.7° | 74.4° | 81.8° | 0.199 |
| 80° | 61.6° | 63.8° | 69.1° | 75.9° | 0.174 |

6. Advantageous Qualities Afforded by Key Metric Ranges

6.1. Rigidity

By utilizing rods (or vertical support masts) with a median or mean effective diameter advantageously no greater than 1.5 in or between 0.125 and 1.5 in and more advantageously no greater than 1.00 in or between 0.25 and 1.00 in and even more advantageously no greater than 0.75 in or between 0.25 and 0.75 in and even more advantageously no greater than 0.50 in or between 0.25 and 0.50 in and, in each of these cases, with a flexural rigidity advantageously between 1,000 and 18,500 lb×in$^2$ and more advantageously between 1,500 and 18,000 lb×in$^2$ and even more advantageously between 1,500 and 12,000 lb×in$^2$, a smaller rod (or vertical support mast) effective diameter and a much lower flexural rigidity (i.e., smaller effective diameter and much lower flexural rigidity than the masts typically found in existing trampoline solutions that include jumper enclosing protections available today) may be successfully employed in the disclosed enclosure subsystems with their unique geometries to permit a higher Enclosure Impact Weight Rating to be achieved (i.e., a higher Enclosure Specified User Weight) with less material weight and less material volume than found in masts in existing trampoline solutions that include jumper enclosing protections available today.

The effective diameter, D, of a rod (or vertical support mast) at a given point along its longitudinal axis is the diameter for the circle whose area matches the rod's (or vertical support mast's) cross-sectional area, A, at the given point (the cross-section being perpendicular to the longitudinal axis at the given point) by the following formula: $D=2\sqrt{A/\pi}$. The mean effective diameter of a rod (or vertical support mast) is the integral between the functional ends of the rod, along the arc of the rod (or vertical support mast), of the rod's (or vertical support mast's) effective diameter divided by the arc length of the rod (or vertical support mast) between the functional ends of the rod. The median effective diameter of a rod (or vertical support mast) has the property such that the portion (e.g., half) of the effective diameters along the arc of the rod (or vertical support mast) between the functional ends that are greater than the median is equal to the portion (e.g., half) that are lesser than the median effective diameter.

Such a rod (or vertical support mast) is advantageously chosen to be made of unidirectional fiberglass composite with a median or mean effective diameter close to 0.375 in and a flexural rigidity close to 6,000 lb×in$^2$ (e.g., between 3,000 lb×in$^2$ and 12,000 lb×in$^2$). Such rods are advantageously assembled in an elliptical configuration such as those shown in FIGS. 1-9 to create a trampoline enclosure system with excellent retaining and safety properties when applied to errant jumpers to keep them from leaving the safety of the chamber defined by the enclosure subsystem and returning them to the interior jump bed.

The rods (or vertical support masts) of the disclosed enclosure subsystems can be made of unidirectional fiberglass composite, carbon fiber, aluminum, PVC, or other plastic materials. Depending upon the modulus of elasticity of a rod's (or vertical support mast's) materials and the number of rods (or vertical support mast's) employed (a greater number of rods (or vertical support masts) and/or interconnecting/coupling between rods (or vertical support masts or both) permit using smaller diameter rods (or vertical support masts)), a rod's (or vertical support mast's) effective diameter is advantageously sized up to 1.0 in, and in some embodiments, more advantageously sized up to 0.75 in, and in some embodiments, even more advantageously sized up to 0.5 in, and in some embodiments (including embodiments with unidirectional fiberglass composite rods (or vertical support masts)), advantageously sized to be close to 0.375 in, and in most embodiments, advantageously sized at or above 0.25 in. The rods (or vertical support masts) with diameters between 0.25 in and 0.50 in have an isolated bending rigidity between 1.2 lb×in$^1$ to 19 lb×in$^1$ and a flexural rigidity between 1,150 lb×in$^2$ and 18,500 lb×in$^2$. It is more advantageous for fiberglass plastic rods (or vertical support masts) to have a rod (or vertical support mast) effective diameter closer to 0.375 in than either 0.25 in or 0.50 in. Rods (or vertical support masts) with greater flexural and bending rigidity for a given diameter (such as those composed of steel or carbon fiber) are more advantageously sized with smaller diameters, even below 0.25 inches. It is more advantageous for rods (or vertical support masts) of most materials to have a flexural rigidity closer to 5,820 lb×in$^2$ than either 1,150 lb×in$^2$ or 18,500 lb×in$^2$. Rods (or vertical support masts) with greater flexural rigidity (i.e., closer to 18,500 lb×in$^2$) are stronger and stiffer and are one means of permitting a higher Enclosure Impact Weight Rating to be achieved (i.e., a higher Enclosure Specified User Weight), however, if a rod (or vertical support mast) is too stiff it does not bend enough on impact and absorbs the energy of an impact more slowly and with such absorption being slower, comes a greater risk of injury upon impact by an errant jumper. Additionally, rods with too great a flexural rigidity cannot be bent to conform to the arch shape provided by the rod's path along the surface of a netting curtain.

The following table 6-1 shows the different diameter rods (or vertical support masts) needed to exhibit the advantageous flexural rigidity of 6,000 lb×in$^2$ using different materials with varying moduli of elasticity:

TABLE 6-1

| Material | Modulus of Elasticity | Solid Rod (or Vertical Support Mast) Diameter [in] | Hollow Outside Diameter [in] | Hollow Inside Diameter [in] | Flexural Rigidity (EI) |
|---|---|---|---|---|---|
| Plastic | $0.36 \times 10^6$ | 0.75 in | .79 | .47 | 6,000 lb × in$^2$ |
| Unidirectional Fiberglass Composite | $6.0 \times 10^6$ | 0.375 in | .39 | .23 | 6,000 lb × in$^2$ |
| Aluminum | $10. \times 10^6$ | 0.333 in | .34 | .21 | 6,000 lb × in$^2$ |
| Titanium | $16.5 \times 10^6$ | 0.293 in | .30 | .18 | 6,000 lb × in$^2$ |
| Regular Carbon Fiber | $18. \times 10^6$ | 0.29 in | .30 | .18 | 6,000 lb × in$^2$ |
| Steel or High Modulus Carbon Fiber | $30. \times 10^6$ | 0.25 in | .26 | .16 | 6,000 lb × in$^2$ |

6.2. Energy Dissipation

Beam internal forces: When external loads are placed on a beam member, internal forces develop in the beam member to balance the loads and achieve static equilibrium. The three internal forces are axial force (A in FIG. 8F), shear force (S in FIG. 8F) and bending moments (M in FIG. 8F).

Axial forces are uniform tension (tensile force) or compression (compressive force) in the longitudinal direction of the beam or normal to the beam's cross section. Shear forces act perpendicular to the longitudinal direction of the beam or parallel to the beam's cross section. When an external load is exerted on a beam, that load is transferred through the beam and reaction forces develop at the connected ends of the beam to achieve equilibrium with the external loads. Depending on how the ends of the beam are constrained, the reaction forces will be comprised of axial and shear forces and bending moments.

The disclosed embodiments exhibit advantageous energy dissipation characteristics. For example, when a jumper flies away from the centroid of the jump surface and impacts a rod at or near its apex, the rod tends to maintain its shape such that the netting curtain is pulled outward away from the centroid of the jump surface and this pulls on the ends of the rod that are attached to the bed subsystem, causing the rods to bend and transfer some load to the bed through a tensile force. This pulling begins the smooth and safe transfer of energy from the impact location and into the trampoline bed where the two end areas of the rod are affixed. The trampoline bed flexes against the nearby springs at the two remote locations gradually decelerating and then recoiling to pull the rods which pulls the netting and the jumper back toward the centroid of the bed. Other nearby poles undergo a similar but lesser tensile load transfer that is asymmetrical as the attached netting is pulled by the impacting jumper resulting in a smaller portion of energy being transferred to the bed at the ends of the other poles. In aggregate, the various poles work together to efficiently absorb the impact energy over a wide range of the bed perimeter area. Because each of the rod's load is partially transmitted through tensile force of the rods, wherein the rods exhibit greater relative strength in comparison to their bending stress strength, and into the bed subsystem which is inherently designed for impacts and energy absorption, the poles may be constructed with much lighter gauge materials than is required when the poles primarily absorb energy on their own through their out of plane bending stress and their flexing, wherein the poles exhibit little bending stress strength compared to the same pole's strength of in plane bending stress.

A similar energy dissipation advantage is seen when a user's impact with the enclosure is more perpendicular with than parallel to the bed subsystem surface, for instance when the user impacts the enclosure in a mostly downward direction (i.e., mostly vertical). When this occurs the disclosed enclosure systems slow (i.e., deaccelerate) the fall gradually and guide the user back toward the centroid of the rebounding surface with consequently greatly reduced risk of injury. The guiding back toward the centroid of the rebounding surface is due to the rebound of the horizontal component of their impact. This shows a significant improvement over previous enclosure designs; a downward impact with a prior design would lead to the net almost immediately becoming taut, causing a jarring sensation to the user who would then end up colliding directly onto the padded springs, another jarring experience as the spring give very little when landed directly onto, perpendicularly to their direction of elasticity. These jarring sensations are accompanied by an increased risk of injury.

Testing and experimentation performed by the inventors has shown that the ratio of in plane to out of plane bending stress for the disclosed embodiments is independent of the impact weight, depending only on the impact location and the construction of the enclosure.

During an impact with this system by an outside colliding body, the amount of load transferred by a rod via tensile force is significant. It is advantageous for greater than 30% of the load transferred by a pole to be via tensile force and less than 60% of the load transferred by the pole to be via shear force. It is more advantageous for greater than 70% of the energy to be absorbed via tensile force and less than 30% by shear force. It is even more advantageous for greater than 75% of the energy to be absorbed via tensile force and less than 25% by shear force. It is even more advantageous for greater than 80% of the energy to be absorbed via tensile force and less than 20% by shear force. It is even more advantageous for greater than 85% of the energy to be absorbed via tensile force and less than 15% by shear force. It is even more advantageous for greater than 90% of the energy to be absorbed via tensile force and less than 10% by shear force. It is even more advantageous for greater than 95% of the energy to be absorbed via tensile force and less than 5% by shear force.

Disclosed is a trampoline system including an enclosure subsystem with rods (structural components) (and, in some embodiments, vertical support masts) for suspending the net above a surface of the trampoline where the rods (and, in some embodiments, vertical support masts) are substantially supported (i.e., at least 30% of all of the rod's (and, in some embodiments, vertical support mast's) loaded weight is supported) by the bed subsystem. The system is configured so that the rods (and, in some embodiments, vertical support masts) transfer a portion of the load of a horizontal impact to the net and the rods (and, in some embodiments, vertical support masts) to the bed subsystem via tensile force through the rods (and, in some embodiments, vertical support masts) and through the net to a plurality of remote locations in the perimeter area, such remote locations being distant from the area of impact.

Figure 19A:
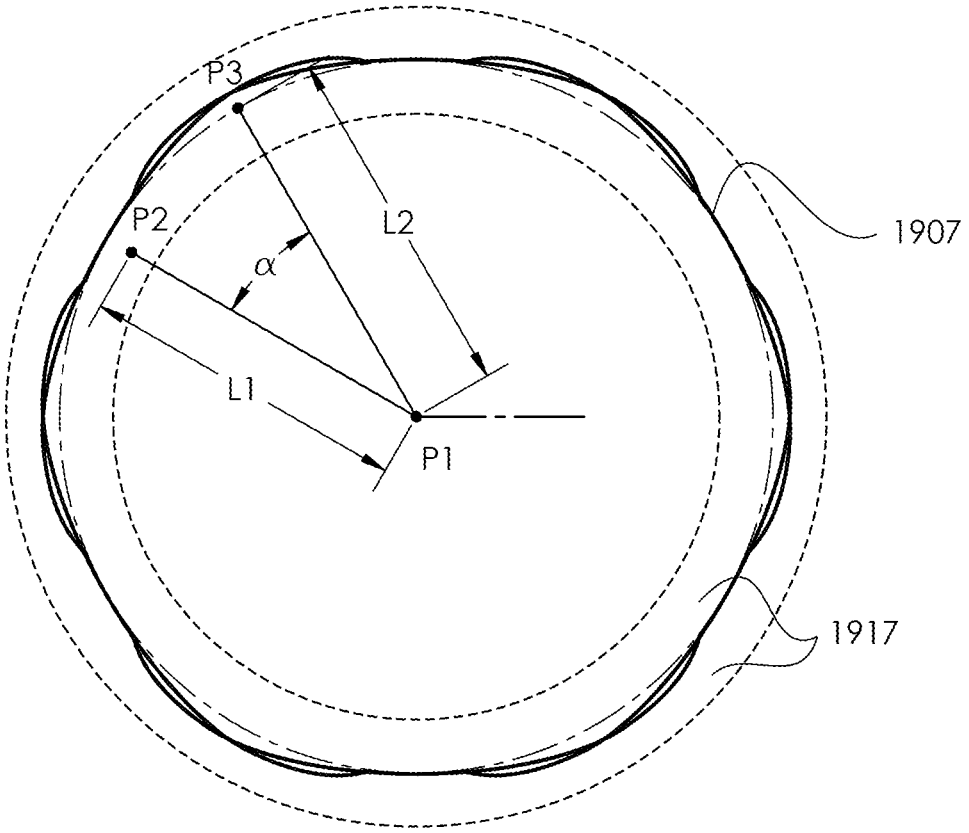
FIG. 19A is a top view of a round trampoline system showing the perimeter area.

The system is advantageously configured such that more than 35% of a standard large rod impact is transferred to remote locations. The system is more advantageously configured such that more than 50% of a standard large rod impact is transferred to remote locations. The system is even more advantageously configured such that more than 70% of a standard large rod impact is transferred to remote locations. The system is advantageously configured such that more than 25% of a standard large net impact is transferred to remote locations. The system is more advantageously configured such that more than 35% of a standard large net impact is transferred to remote locations. The system is even more advantageously configured such that more than 50% of a standard large net impact is transferred to remote locations. A first location along the perimeter area is remote or distant from a second location along the perimeter area at the same height above the plane of the jump surface, for example as shown in FIG. 19A, where the second location is below an impact location if, when viewed from above the jump surface, an angle $\alpha$ of at least 30 is formed between a first line $L_1$ passing through the point $P_1$ with the same height above the centroid C of the jump surface and the first location $P_2$ along the perimeter area and a second line passing $L_2$ through the same point $P_1$ with the same height above the centroid of the jump surface and the second location $P_3$ along the perimeter area, the second location $P_3$, immediately below the impact location, also being in a plane with a 90° glancing angle to the jump surface where the plane passes through the centroid of the jump surface and the centroid of the area of impact.

In a standard large rod impact against many of the disclosed enclosure subsystems, more than 50% of the energy delivered by the impact against the enclosure subsystem is advantageously transferred to the bed subsystem. It is more advantageous in a standard large rod impact, that more than 65% of the energy delivered by the impact against the enclosure subsystem is transferred to the bed subsystem.

The portion of the standard large net impact load absorbed via tensile force of the poles and via the net pulling on the bed subsystem is advantageously at least 5% of the load of an impact and, in advantageous embodiments, the average portion of the load absorbed via tensile force and via the net pulling on the bed subsystem is at least 10% of the load of an impact and, in even more advantageous embodiments, the average portion of the energy absorbed via tensile force and by the net pulling on the bed subsystem is at least 25% of the load of an impact.

Figure 22A:
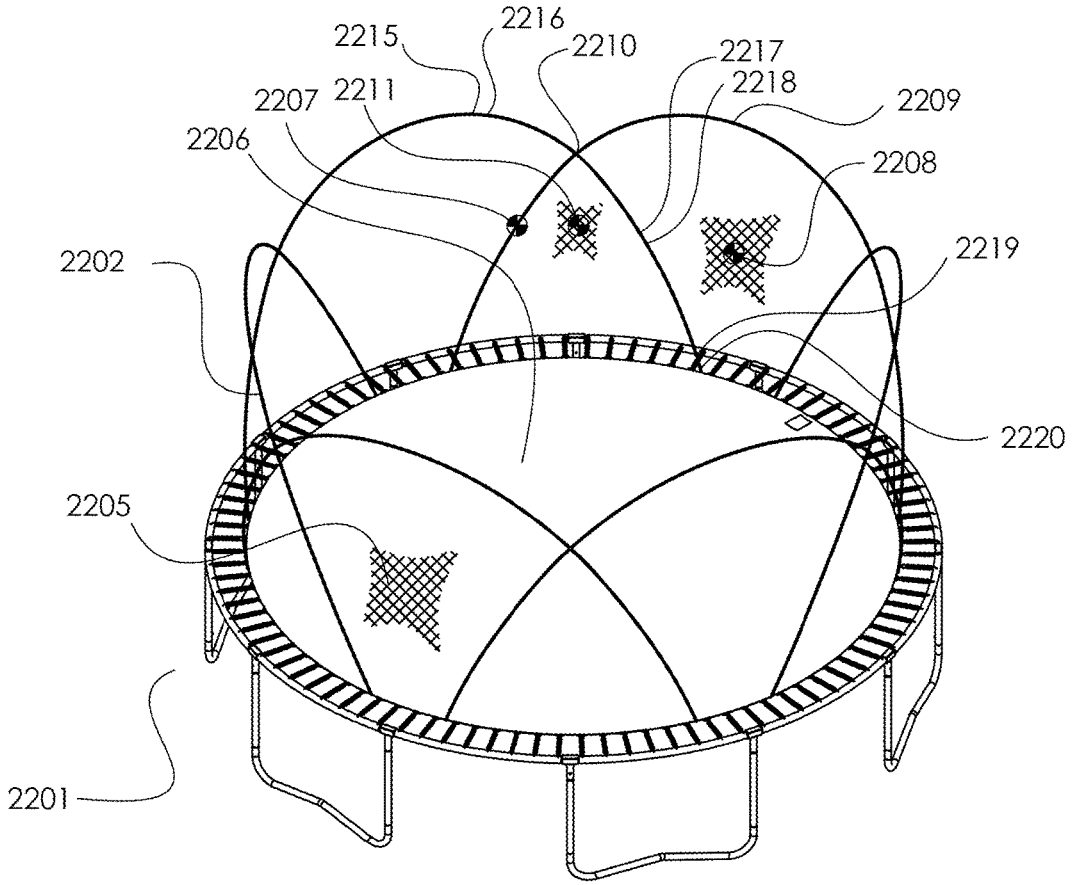
FIG. 22A is an isometric view of a trampoline depicting the locations of strain gauges and impact locations.
Figure 22B:
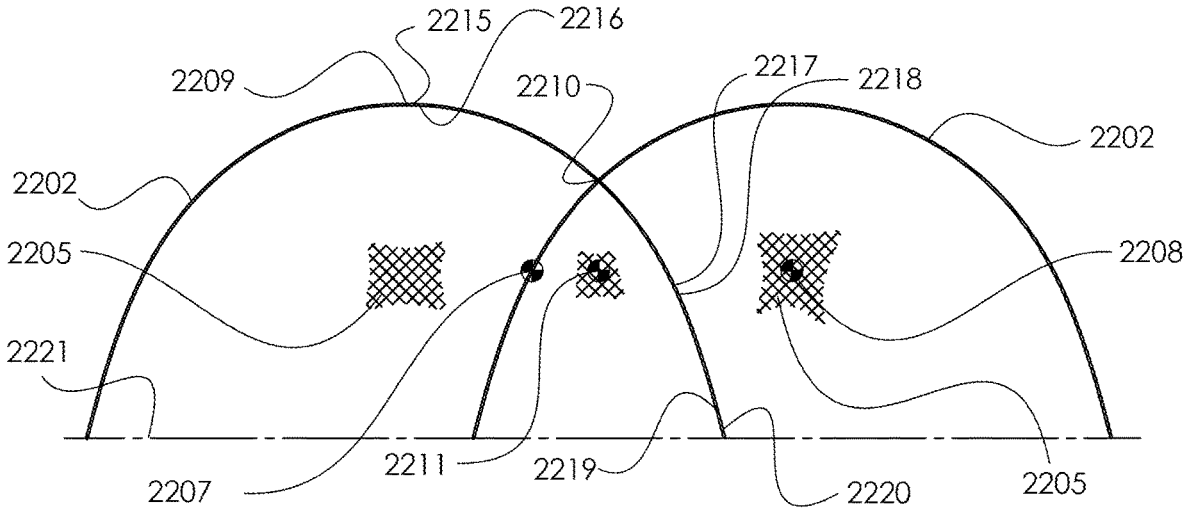
FIG. 22B is an inside panoramic view of the trampoline from FIG. 22A.

In many of the disclosed embodiments, in a standard large net impact, when measured at a height between 41% and 49% of the height of the rod apex (i.e., the mid-stress location; e.g., gauges 2217 and 2218 of FIGS. 22A-22B) on the rod (e.g., rod 2202 with gauges 2217 and 2218 of FIGS. 22A-22B) closest to the impact (e.g., impact location 2208 of FIGS. 22A-22B), more than 45% of the bending stress energy is absorbed by in plane bending stress of the rod (and, in some embodiments, vertical support masts) and less than 55% of the bending stress energy absorbed by out of plane bending stress of the rod (and, in some embodiments, vertical support masts). In some embodiments, more energy is absorbed by in plane bending than out of plane bending. When measured at the apex (e.g., apex 2209 of FIGS. 22A-22B) of the closest rod more than 10% of the bending stress energy is absorbed by in plane bending stress and less than 90% of the bending stress energy is absorbed via out of plane bending stress.

In many of the disclosed embodiments, in a standard large rod impact, when measured at a height between 41% and 49% of the height of the rod apex (i.e., the mid-stress location; e.g., gauges 2217 and 2218 of FIGS. 22A-22B) on the nearest crossing rod (e.g., rod 2202 with gauges 2217 and 2218 of FIGS. 22A-22B) of the impact (e.g., impact location 2207 of FIGS. 22A-22B), more than 40% of the bending stress energy is absorbed by in plane bending stress of the rod (and, in some embodiments, vertical support masts) and less than 60% of the bending stress energy is absorbed by the out plane bending stress of the rod (and, in some embodiments, vertical support masts). When measured at the apex (e.g., apex 2209 of FIGS. 22A-22B) of the nearest crossing rod more than 35% of the bending stress energy is absorbed by in plane bending stress and less than 65% of the bending stress energy is absorbed via out of plane bending stress.

In many of the disclosed embodiments, in a standard stress large net impact, when measured at a height between 41% and 49% of the height of the rod apex (i.e., the mid-stress location; e.g., gauges 2217 and 2218 of FIGS. 22A-22B) on either of the nearest crossing rods (e.g., rod 2202 with gauges 2217 and 2218 of FIGS. 22A-22B) of the impact (e.g., impact location 2211 of FIGS. 22A-22B), more than 75% of the bending stress energy is absorbed by in plane bending stress of the rod (and, in some embodiments, vertical support masts) and less than 25% of the bending stress energy is absorbed by the out plane bending stress of the rod (and, in some embodiments, vertical support masts). When measured at the apex (e.g., apex 2209 of FIGS. 22A-22B) of either of the nearest rods more than 65% of the bending stress energy is absorbed by in plane bending stress and less than 35% of the bending stress energy is absorbed via out of plane bending stress.

For a circular trampoline bed, the effective radius of the trampoline bed is the same as the radius of the circular trampoline bed. For an elliptical trampoline bed, the effective radius is the radius of curvature at the semi-minor axis of the elliptical trampoline bed. For a regular polygonal trampoline bed, the effective radius is the radius (also called circumradius) of the regular polygon shaped trampoline bed. For concyclic polygon trampoline beds, the effective radius is the radius of the minimal circumscribed circle (also called circumcircle) around a given concyclic polygonal shaped trampoline bed. For all other polygonal trampoline beds, the effective radius is the radius of the smallest circle (also a minimum bounding circle) that contains all the vertices of the polygon.

A rod (or vertical support mast) could potentially break if the bending stress is too great, therefore, it is advantageous that the assembled at rest shape of a rod (or vertical support mast) in the enclosure subsystem does not result in bending a rod (or vertical support mast) too severely and thus creating a lot of pre-loading bending stress even before a jumper impacts a rod (or vertical support mast) and thus provides even more bending stress. Because of this, it is advantageous that the rods (or vertical support masts), when installed in an enclosure subsystem and assembled at rest (i.e., not being impacted by a jumper), have a radius of curvature at all points along the path of the rod (or vertical support mast) which is greater than or equal to 0.20 the effective radius (defined above) of the trampoline bed. It is even more advantageous if the radius of curvature along the path of the rod (or vertical support mast) is always greater than 0.30 of the effective radius of a trampoline bed. It is even more advantageous if the radius of curvature along the path of the rod (or vertical support mast) is always greater than 0.37 of the effective radius of a trampoline bed. It is even more advantageous if the radius of curvature along the path of the rod (or vertical support mast) is always greater than 0.43 of the effective radius of a trampoline bed.

In general, in circular trampoline embodiments with elliptically arched rods, the foregoing requires that the glancing angle of the rods advantageously be less than $78.5°=\cos^{-1}(0.2)$ and even more advantageously less than $72.5°=\cos^{-1}(0.3)$ and even more advantageously less than $68.3°=\cos^{-1}(0.37)$ and even more advantageously less than $64.5°=\cos^{-1}(0.43)$. This is because, for an elliptical curve formed by a plane (defined by a rod's path) intersecting a cylinder (defined by a netting curtain), the ratio $$\left(\frac{R}{r}\right)$$

of the radius of curvature at the ends of the semi-major axis of the ellipse to the radius of the cylinder can be computed as a function of the angle (θ) of the secant plane that is perpendicular to the cylinder's axis (i.e., the glancing angle of the ellipse formed by the rod path), in the following way:

$$\frac{R}{r} = \cos(\theta).$$

The above table 5-1 shows the ratio $$\left(\frac{R}{r}\right)$$

for various glancing angles (θ).

7. Various Embodiments of Devices 7.1. Trampoline Bed Shape

The disclosed device embodiments may be adapted to various trampoline bed shapes and sizes beyond the standard circular shape depicted in most drawings. These include elliptical, rectangular, square, pentagonal, hexagonal, heptagonal, octagonal, and more generally any curved or polygonal shape or number of angles and sides. In such applications, the enclosure subsystem shape rounds out the corners of the bed as the netting curtain extends upward from the bed so that the enclosure subsystem travels inside of corners and outside of edges as viewed from above (e.g., see FIGS. 11G, 17C, 17D, and 17E).

7.2. Frame

The disclosed devices have a trampoline bed that is advantageously held taut by connected springs which pull outward, radially from the perimeter of the bed, to an enclosing upper frame. The upper frame together with the frame legs form the trampoline frame subsystem. The upper frame is supported above the ground by the frame legs. At least three legs are present, but more commonly four or six legs are employed. Often each leg is itself composed of two vertical shafts to each support the upper frame where the two shafts are connected by a ground footing to form a single leg. The frame legs are often composed of poles, such as metal tubing. The frame is a key energy dissipating component to the trampoline system upon impact by a jumper into the netting curtain.

The rebounding bed is coupled to the frame by various means, including coil springs, bungee springs, compression springs, rod springs, and leaf springs. In embodiments where the bed itself has sufficient elasticity (springiness) so as to not require additional spring members, the bed may be coupled directly to the frame without any intervening spring members.

7.3. Rod Shape

The rods (or vertical support masts) may be hollow (e.g., see FIG. 12H) or solid (e.g., see FIG. 12B). Hollow rods (or vertical support masts) may be composite and their hollow center filled with a with differing material such as a foam. The cross-sectional perimeter of the rods (or vertical support masts) may be shaped in a circular (e.g., see FIG. 12B), elliptical, cross-shaped (e.g., see FIG. 12D), triangular, square (e.g., see FIG. 12F), trapezoidal, pentagonal, hexagonal, octagonal, or other polygonal fashion.

While the rods (or vertical support masts) may have a straight shape when isolated at rest, in some embodiments it is advantageous for a rod's (or vertical support mast's) isolated at rest shape to more closely approximate their assembled at rest shape (e.g., an elliptical-like shape). This is because it permits the rods (or vertical support masts) to be constructed of even less material since none of the required flexing is consumed by conforming to the shape of the installed net since their isolated at rest shape is constructed to more closely approximate (as compared to a straight isolated at rest rod (or vertical support mast)) each rod's (or vertical support mast's) assembled at rest shape in their assembled path along the installed netting curtain. To minimize volume of the poles during shipping and transit, the poles may be shipped in a flexed position that more closely approximates their being straight rods (or vertical support masts).

In some embodiments, the rods' (or vertical support masts') isolated at rest shape exaggerates the assembled at rest shape by having a smaller radius of curvature for at least some points along its path as compared to the radius of curvature of the assembled at rest shape. This is advantageous for a horizontal impact as the rod (or vertical support mast) would pass through its isolated at rest shape and have to bend much further before a catastrophic failure due to bending stress. Additionally, a smaller radius of curvature when in its isolated at rest shape permits packing the rod (or vertical support mast) in an even tighter radius of curvature for the same amount of bending stress and thus permitting an advantageously smaller box for shipping.

For circular trampoline system embodiments, depending upon the glancing angle of the rods relative to the trampoline bed, for a rod with a given isolated at rest shape (such as straight or elliptical), the rods will be closer to or farther from their isolated at rest shape. The bending of a rod can be expressed as the average radius of curvature. At one extreme, where the rods are perpendicular to the bed at a 90° glancing angle, the assembled at rest average radius of curvature would be infinite. As the glancing angle decreases toward parallel to the bed at 0°, the assembled at rest average radius of curvature drops toward the limit of the radius of the perimeter area to which the enclosure subsystem is attached and the rod assembled at-rest shape approaches that of a circle. Neither extreme glancing angle (i.e., 0° and 90°) provides a functioning version of the disclosed invention, but are included here to illustrate a trend for the middle portion of glancing angles between the extremes that do function. Angles approaching 90° are not practical because they require an extremely tall enclosure subsystem in order for the rods to arch back down such that opposite ends of the rods are attached to the trampoline bed. Generally, the tallest enclosure subsystem needed is governed by the tallest users and the highest they can jump. For a 14-foot diameter trampoline bed and an adult user, the netting curtain advantageously extends upward six feet above the bed surface, however, the use of a hot-bed or other trampoline configuration to permit above typical jumping heights requires a taller netting curtain height. The rod members are bent into arch shapes which are enclosed or otherwise connected with a net. The arches are bent to curve within a plane whose glancing angle matches the glancing angle of the rods relative to the bed surface. The arches may be approximated by an ellipse on the plane.

Pre-shaped rods (or vertical support masts) whose isolated at rest shape more closely approximates their assembled at rest shape permit the use of lighter rods (or vertical support masts) without collapse as long as the rods (or vertical support masts) can flex without breaking. This pre-shaping gives more rigidity for lighter weight.

7.4. Rod Assembly

To minimize a maximum length dimension, a single rod (or vertical support mast) may be assembled from multiple sections or segments. The sections may be combined, coupled, connected and/or assembled by several means such as telescoping wherein each section end fits into the opposite end of the next section. Alternatively, the sections may be woven into the netting and overlap for several inches without actually being attached directly to each other and instead depending upon frictional forces for their coupling. Such overlapping segments are advantageously encased within a sleeve to provide additional friction such that axial stress on one segment is at least partial transferred to the adjoining segment by means of friction forces. Additionally, the netting transfers some energy of a segment near a point of impact into axial stress of segments more distant from the point of impact.

There are many other means of assembling segments into a single rod (or vertical support mast) (e.g., see FIGS. 20A-20H) and these include: A screw or threading mechanism whereby the end of one segment is screwed or threaded into the adjacent end of the next segment. A snapping coupling mechanism whereby one male segment end snaps into place of a receiving female segment end. A clamping collar on one segment end that accepts another segment end. A gluing such as with epoxy glue to permanently attach the end of one segment to another segment end. The ends of two rods (or vertical support masts) may be taped together. A sleeve made from metal, carbon fiber, plastic, or other rigid material that holds the ends of rods (or vertical support masts) that are slid into the sleeve with screws to tighten down the screw. A clamping sleeve with a horizontal slit to accept the rods (or vertical support masts) and then screws or other means to clamp down to seal the horizontal slit. The rod (or vertical support mast) may have one or more holes or indentations that a clamping screw goes into to help prevent the rod (or vertical support mast) from pulling out of the sleeve. Any combination of two or more of the foregoing may be utilized with two or more segments to assemble a rod (or vertical support mast).

In some embodiments, an elliptical curvature (or other type of arching curve) is loosely approximated by a plurality of individual discrete segments which connect to each other at an angle to form a single rod member (e.g., see FIGS. 10B-10E) wherein the rod contains a first end area and a second end area that is coupled to the bed subsystem or frame subsystem or some combination of both the bed subsystem and frame subsystem. Such segments are straighter (having a larger radius of curvature) than the elliptical curve (or other type of arching curve) they approximate in aggregate as a rod. For example, two segments could connect at approximately a 90° interior angle to form a triangular shaped rod with the trampoline bed forming one side of the triangle (e.g., FIG. 10B) or alternatively, two segments could cross and extend beyond where they connect to form an x-shape (e.g., FIGS. 10F-10G). Alternatively, three segments could connect at approximately a 120° interior angle to form an acute isosceles trapezoidal shaped rod with the trampoline bed forming the longer base of the trapezoid (e.g., FIGS. 10A and 10C).

Alternatively, a rod may be composed of discrete segments that are connected at or near 180° interior angles or other interior angles greater than 120° to form a single rod member (e.g., see FIGS. 10B-10E) that is straight or nearly straight. Each segment may itself be a straight (or nearly straight) section, which when joined together form a single rod and when assembled at rest in the enclosure subsystem approximate the curve of an elliptical or other type of arching curve.

7.5. Rod Coupling and Other Rod Details

The rods (or vertical support masts) also couple to the net in various locations which are advantageously spaced out along even repeating intervals of the rod. One way to attach the net to the rods (or vertical support masts) is to insert them into sleeves (e.g., the sewn fabric support patches 911 and 912 of FIGS. 9C-9D) sewn onto the net. In some embodiments, the rods (or vertical support mast) are connected to the enclosure subsystem in various manners, such as loop attachments, Velcro straps, or through openings sewed or otherwise placed on or in the netting. It is advantageous for the rods (or vertical support masts) to have a cross-sectional shape that permits the rod (or vertical support mast) to easily fit through the mesh holes of the netting and thus the rods (or vertical support masts) may be woven into the net by the rod (or vertical support mast) repeatedly traversing back and forth between the inside to the outside of the net through the mesh holes and thus the net provides its own attachment mechanism to the rod (or vertical support mast) with a reduced need for additional sleeves or other means of connection.

Utilizing a lower rod glancing angle or fewer rods (or vertical support masts) results in a lesser ability for the disclosed enclosure subsystems to provide a cushioning effect to an errant jumper's downward fall (vertical motion). Utilizing a greater glancing angle or fewer rods (or vertical support masts) results in a lesser ability to absorb an errant jumper's horizontal motion. A greater glancing angle of a rod results in a lesser ability to transfer a horizontal force through the rod by means of tensile force and requires more of the energy is consequently absorbed by out of plane bending stress. Utilizing a greater number of rods (or vertical support masts) or rods (or vertical support masts) with greater stiffness tends to add to the mass and/or volume of the enclosure subsystem. A rod's stiffness when absorbing energy through out of plane bending stress is far less than its stiffness when absorbing energy through in plane bending stress, hence, shifting energy absorption into in plane bending stress and away from out of plane bending stress is advantageous as it permits a lighter weight rod and a less stiff rod to be used when the amount of bending stress it needs to bear without failure (e.g., breaking) is reduced.

Using a glancing angle of 68° in a 6-arched rod system provides an advantageous trade off as compared to a 45° glancing angle wherein the 68° system sacrifices some strength versus outwardly directed impacts (horizontal loading) in return for greater strength versus downwardly directed impacts (vertical loading). This is advantageous for an impacting jumper since once airborne, the only forces acting on the jumper are gravity and the enclosure subsystem and the gravitational force only affects the vertical loading hence making it advantageous to provide a better cushioning effect as the jumper falls under gravitational influence compared to the cushioning effect for the horizontal loading. As the number of rods is decreased below six rods, a lower glancing angle is advantageous to maintain a balanced trade-off between horizontal and vertical cushioning. Similarly, As the number of rods is increased above six rods, a greater glancing angle is advantageous to maintain a balanced trade-off between horizontal and vertical cushioning. However, as the angle approaches 0° or 90° many of the beneficial effects of the disclosed device tend to disappear.

Rods may be combined in an enclosure subsystem that have differing glancing angles (e.g., some rods at 57° and others at 68°). Generally, a glancing angle of 68° is found to be advantageous for a 6-arched rod system to maximize the energy transferring aspects using a minimum of mass and volume, but in practice other numbers of rods such as 3, 4, 5, 7, 8, 9, 10, 11 or 12 and other angles greater than or equal to 30° or less than or equal to 80° may be utilized such as 30°, 35°, 40°, 45°, 50°, 55°, 57°, 60°, 64°, 68°, 72°, 76°, or 80°. For a 5-arched rod system, a glancing angle of 64° is found to be advantageous. For a 4-arched rod system, a glancing angle of 57° is found to be advantageous. For a 3-arched rod system, a glancing angle of 55° is found to advantageous. In many embodiments, it is advantageous to utilize glancing angles between 40° and 76° and in some embodiments, it is even more advantageous to utilize glancing angles between 45° and 72°. Fewer arches require lesser glancing angles and thus larger spans. A greater number of arches permit greater glancing angles and thus shorter spans. A greater glancing angle is more effective at slowing a vertical fall than a lesser glancing angle whereas a lesser glancing angle is more effective at containing a horizontal impact than a greater glancing angle. It is advantageous to select a glancing angle that balances the beneficial effect of slowing a vertical fall and containing a horizontal impact.

In alternative embodiments, vertical support masts (e.g., vertical support masts 406 in FIGS. 4C-4D and vertical support masts 1110 in FIGS. 11E-11F) running nearly straight up from the frame or bed perimeter area (i.e., at a glancing angle greater than 80° to the frame or bed) directly up to the apex area of supported rods provide added vertical loading support. Such vertical support masts permit the glancing angle of each supported rod to be lower than were the vertical support masts not present. In embodiments with vertical support masts that have glancing angles closer to 90°, such vertical support masts also help keep the enclosure subsystem from collapsing inwardly upon itself. Such vertical support masts become more advantageous in circular or regular polygon embodiments with larger bed effective radii relative to their netting curtain height or correspondingly containing long straight sections (that exhibit characteristics like very large bed diameters) such as those found in rectangular embodiments.

Both end areas of each rod (or one end area of each vertical support mast) are attached to a flexible connection near the perimeter of the trampoline bed (in the perimeter area). This is a unique configuration that builds flexibility and compliance into the enclosure subsystem. This is beneficial because when the net is impacted, the entire system of the rods, any vertical support masts, net, mat, frame and any springs move together and absorb the impact energy slowly, and the impact energy is distributed across these mediums to more distant locations across the trampoline system. Because both ends of each rod are advantageously connected to the perimeter area of the trampoline bed subsystem and these connections are distant from each other, the energy absorption of each impacted rod is split to permit it to be distributed across these two remote bed locations. This splitting of energy absorption, together with the great flexibility afforded by the lightweight and low gauge poles permitted by the disclosed embodiments, results in a safe and smooth deceleration and removes the need for pole padding (as required when stiffer poles are used), further reducing the enclosure subsystem's volume and mass. The flexible rods themselves also bend and absorb energy, but an angled arch shape efficiently transfers energy to the bed subsystem via axial force and provides a sufficiently rigid enclosure subsystem to support the netting. The arch structure is more efficient compared to typical safety net systems that use independent cantilever masts, so lightweight flexible rods can be used instead of stiff and heavy large diameter steel tubing.

The tops of the arches (e.g., rods 402 of FIG. 4C-4D) are optionally connected by rigid vertical support masts (e.g., vertical support masts 406 of FIG. 4C-4D) which helps to tie the enclosure subsystem together to ensure more energy is transferred evenly into the bed subsystem during an impact by means of this additional coupling between the rods. Another benefit of this system is that it can be customized and upgraded for children as they grow. The basic kit can use smaller rods without vertical support masts and be sufficient for small children. As they grow and gain weight, the family can upgrade the system by adding vertical support masts, reinforcement poles, straps, and also changing to thicker or stiffer rods (or vertical support masts) or adding more rods (or vertical support masts). This modular system lets the user spend the minimal amount of money as needed over time to meet their needs.

The rods (and, in some embodiments, vertical support masts) are advantageously coupled with the rebounding effect of the bed subsystem. In such systems the rods of the enclosure subsystem function as a kind of rod spring. Because the enclosure subsystem has a very low mass (e.g., 15 lb) as compared to safety net systems in existing trampoline solutions that include jumper enclosing protections on the market today, the coupling of the rods (and, in some embodiments, vertical support masts) (which bear the loaded weight of the bed subsystem) does not substantially dampen the rebounding effect of the bed subsystem. This is because the mass of the enclosure subsystem is so slight in comparison to the mass of an adult user, thus permitting the enclosure subsystem to move up and down with the bed subsystem supporting it as a user jumps up and down on it. In embodiments where the enclosure subsystem has at least some of the rods (or vertical support masts) having at least one end area or the net coupled with the bed subsystem the enclosure subsystem has an added function in that it provides additional spring capacity to the bed subsystem as when a user lands on the bed subsystem and pulls the bed downward the perimeter of the bed subsystem contracts (or shrinks) and flexes the rods (which act as rod springs) (or vertical support masts) inward by means of bending stress that stores some of the energy of the jumper which is partially restituted back to the jumper as the bending stress is released and the poles (or vertical support masts) return toward their relaxed state. The foregoing gives the enclosure subsystem a rebounding effect.

7.6. Netting Curtain Shape

Generally, the netting curtain is shaped to extend straight upward, perpendicularly to the trampoline bed. In some embodiments, it is advantageous to depart from a netting curtain shape that extends straight upward and instead create a netting curtain that generally inclines inwardly toward the centroid of the trampoline bed. Such a curtain construction may have an average grazing angle to the bed of less than 90°. This is advantageous in that it provides greater safety to the user by restraining them at a lesser radius from the centroid at the top of the netting curtain than at the bottom. This is advantageous in that a jumper engaging the netting curtain at the top of the curtain is at greater risk than a jumper engaging the curtain nearer to the bottom of the curtain and by engaging a high above the surface jumper, closer to the center of the trampoline bed, their risk of landing outside the bed is reduced.

One way to implement a netting curtain that tapers inward is to have a netting curtain that when not yet installed and laid out on a flat surface makes an isosceles trapezoidal shape where the longer base forms the bottom of the netting curtain that is installed on the trampoline bed and the shorter base forms the top of the netting curtain. By having a shorter top, a truncated cone like curtain shape is produced when the legs of the trapezoid are wrapped around the rods (and any vertical support masts) to meet each other instead of a cylindrical curtain shape that is achieved when the netting is rectangular instead of an isosceles trapezoidal shape. The restriction of the shorter distance along the top of the curtain works together with the outward pressing force of the rods to create an inwardly tapered, truncated conal type of curtain shape.

7.7. Netting Overlapping Entry

The enclosure subsystem provides entry through a section of the netting curtain that contains two pieces of overlapping netting. This provides a passageway to permit access to the inside of the enclosure subsystem's chamber by allowing a user to separate the two overlapping pieces and pass between them. When jumping the overlapping section is long enough to secure the jumper from accidentally passing through the passageway during impact with the enclosure subsystem.

The overlap can be attained by having crossing rods pass through the ends of the overlapping netting. For example, in FIG. 15B, the arched rods 1502 cross and the portion below the crossing point 1509 may be advantageously configured as an entry way via overlapping netting in that section. Alternatively, the overlap may be advantageously suspended from the apex 1508 of arch rod 1502.

7.8. Enclosure Subsystem/Bed Subsystem Connection

The enclosure subsystem's netting (e.g., the enclosure subsystem netting 105 of FIG. 1B) and rods (e.g., the support rods 102 of FIG. 1B) (and any vertical support masts) are advantageously attached or coupled to the perimeter area of the trampoline bed (e.g., the trampoline mat 104 of FIG. 1B) to provide additional means of transferring impact energy from the enclosure subsystem to the bed subsystem. Because the bed subsystem provides smooth, gradual energy dissipation and an energy dampening effect to the enclosure subsystem, it is advantageous that at least 30% of the mass of the enclosure subsystem, the loaded weight of the rods (and any vertical support masts), is directly and primarily supported by the bed subsystem. In some embodiments, it is more advantageous that at least 40% of the mass of the enclosure subsystem, the loaded weight of the rods (and any vertical support masts), is directly and primarily supported by the bed subsystem. In some embodiments, it is more advantageous that at least 50% of the mass of the enclosure subsystem, the loaded weight of the rods (and any vertical support masts), is directly and primarily supported by the bed subsystem. In some embodiments, it is more advantageous that at least 60% of the mass of the enclosure subsystem, the loaded weight of the rods (and any vertical support masts), is directly and primarily supported by the bed subsystem. In some embodiments, it is more advantageous that at least 70% of the mass of the enclosure subsystem, the loaded weight of the rods (and any vertical support masts), is directly and primarily supported by the bed subsystem. In some embodiments, it is more advantageous that at least 80% of the mass of the enclosure subsystem, the loaded weight of the rods (and any vertical support masts), is directly and primarily supported by the bed subsystem. The foregoing is advantageous by providing that the vast majority of the energy in a jumper's impact with the enclosure subsystem is transferred to the bed subsystem where it can be safely absorbed and finally dissipated, such as into the frame. One means of attachment or coupling is to have a series of button holes, with optional grommets for greater durability, along the bottom edge of the net which are spaced apart to permit their being aligned with trampoline bed springs in the perimeter area. In such a configuration, a plurality of spring hooks may be threaded through a plurality of button holes, thus attaching or coupling the edge of the enclosure subsystem to the bed perimeter area.

Figure 13A:
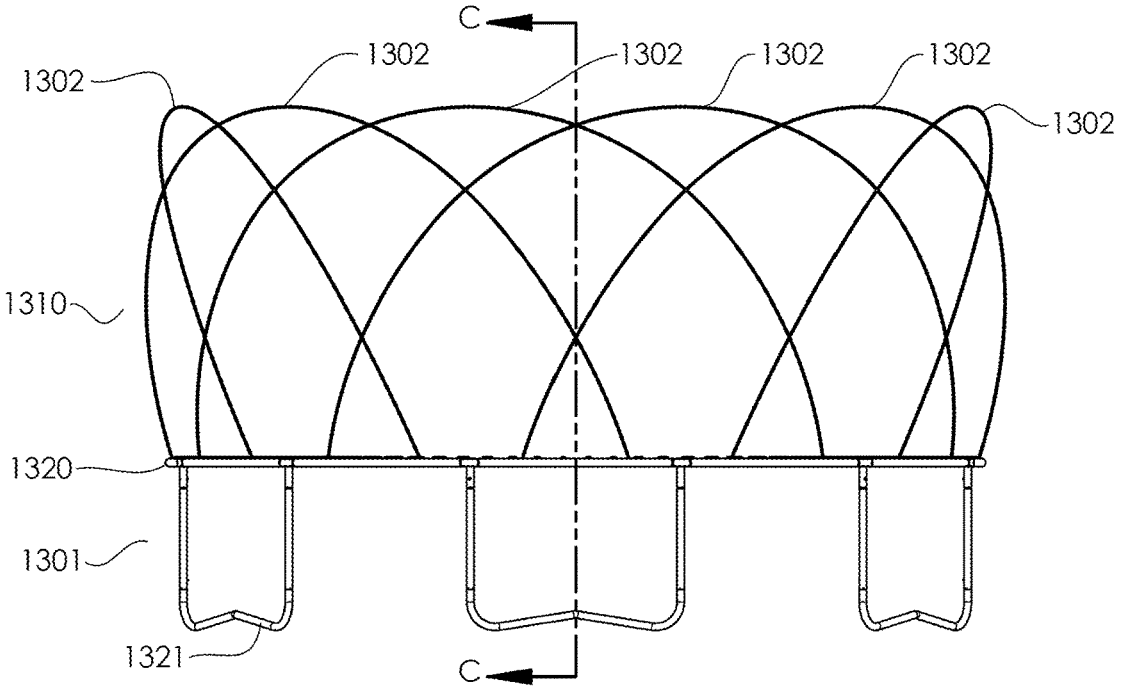
FIG. 13A is a front view of a trampoline enclosure system comprised of six arch members attached to the frame.
Figure 13B:
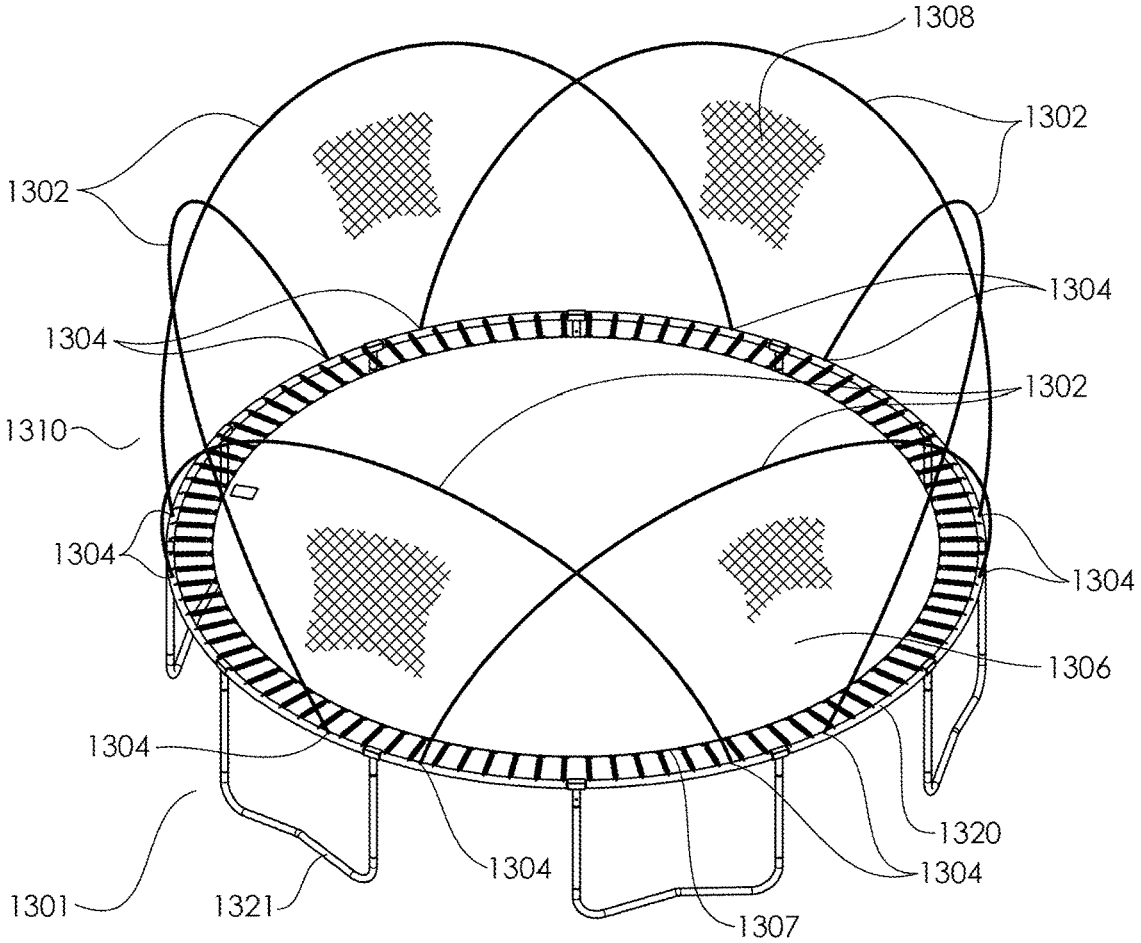
FIG. 13B is an isometric view of the trampoline enclosure system of FIG. 13A.
Figure 13C:
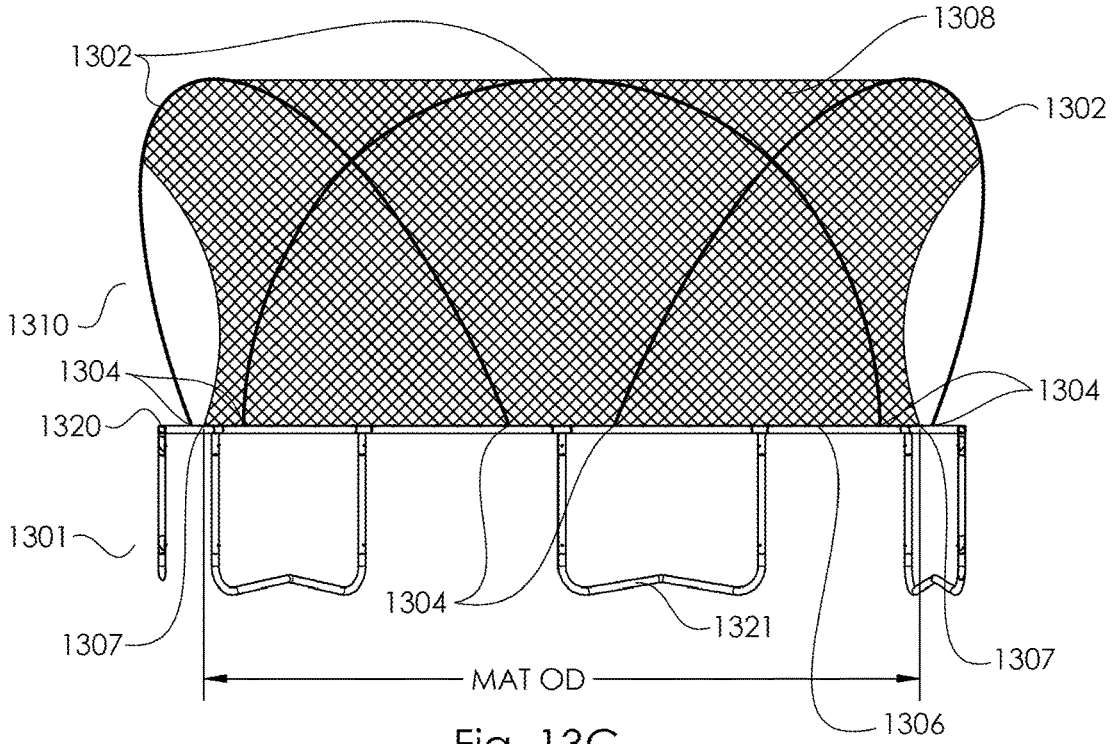
FIG. 13C is a cross-section view along line C of the trampoline enclosure system of FIG. 13A.
Figure 13D:
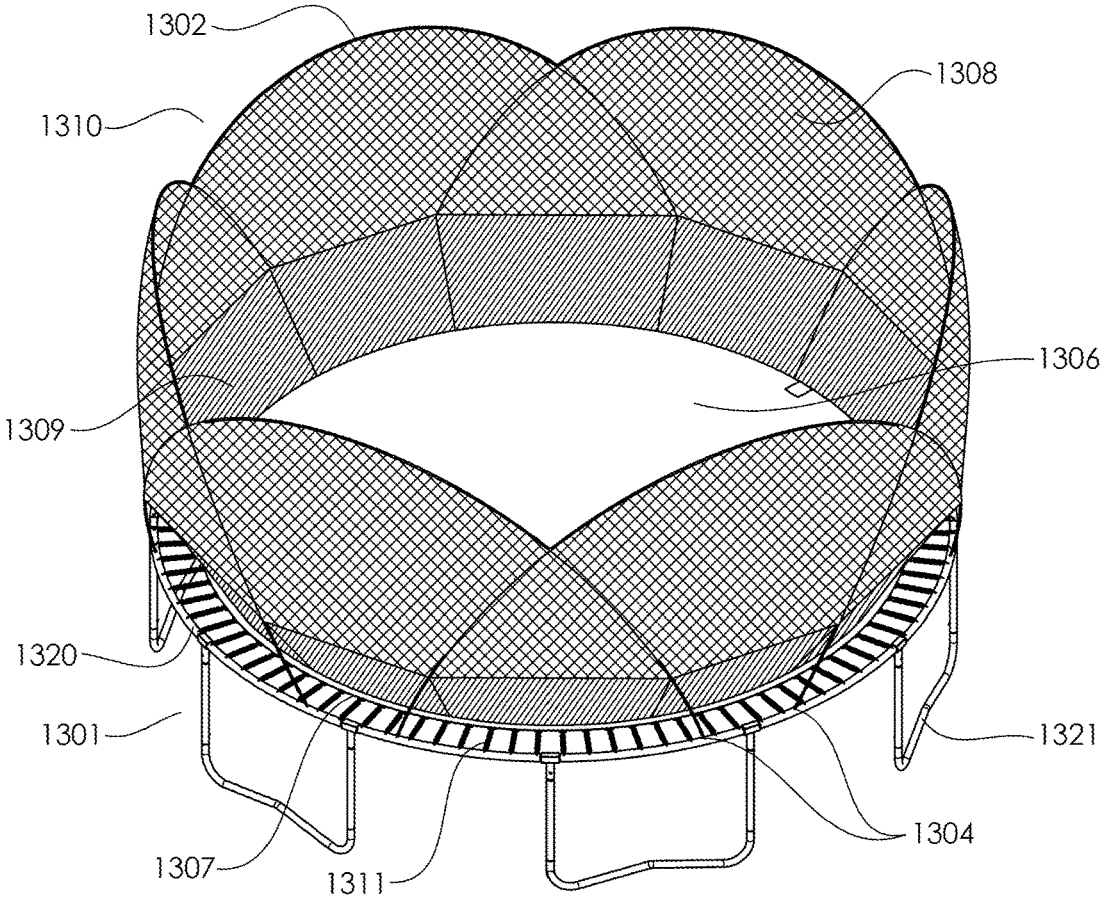
FIG. 13D is an isometric view of a trampoline enclosure system comprised of six arch members attached to the frame that has protective spring cover fabric panels as part of the net.
Figure 13E:
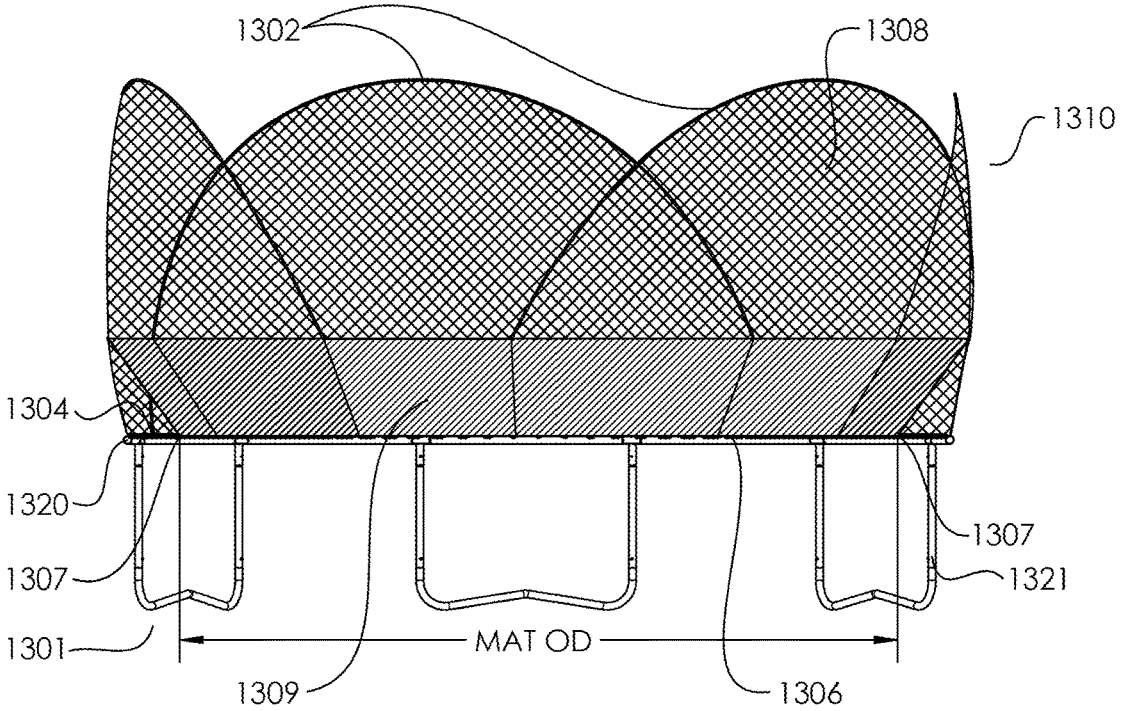
FIG. 13E is a front cross section view of the trampoline like the one in FIG. 13D but with the netting extending fully to the frame.
Figure 13F:
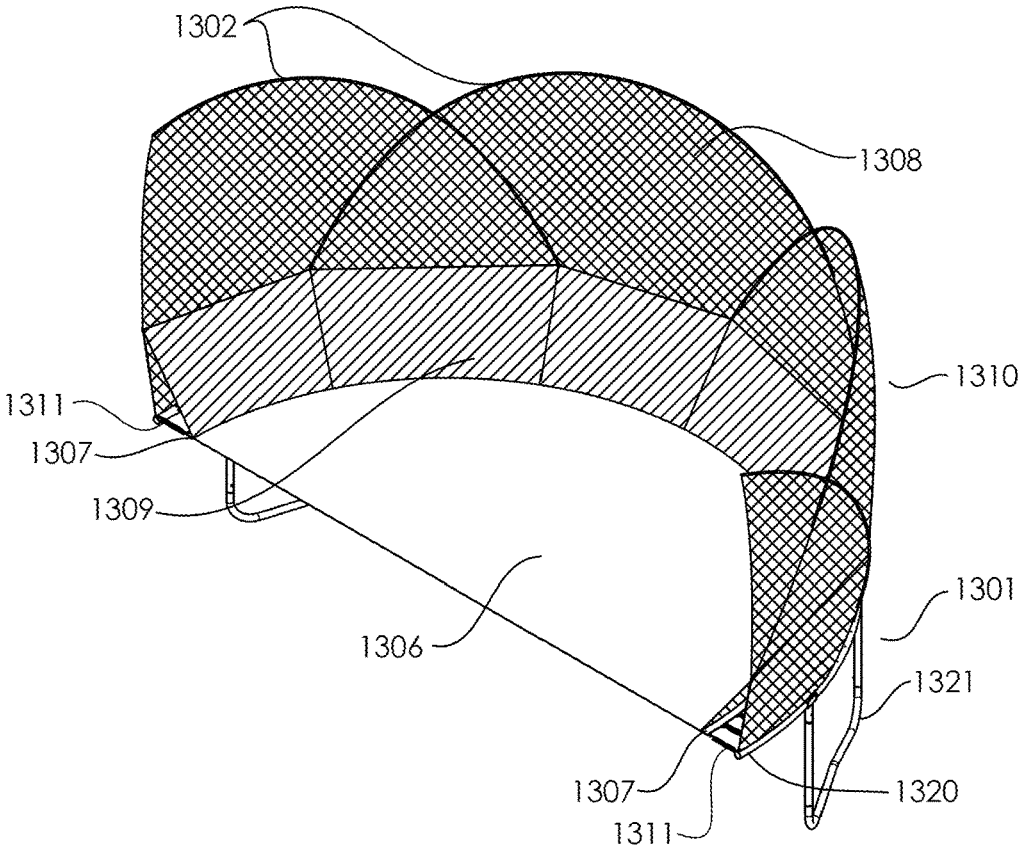
FIG. 13F is an isometric cross section view of the trampoline in FIG. 13E.
Figure 14A:
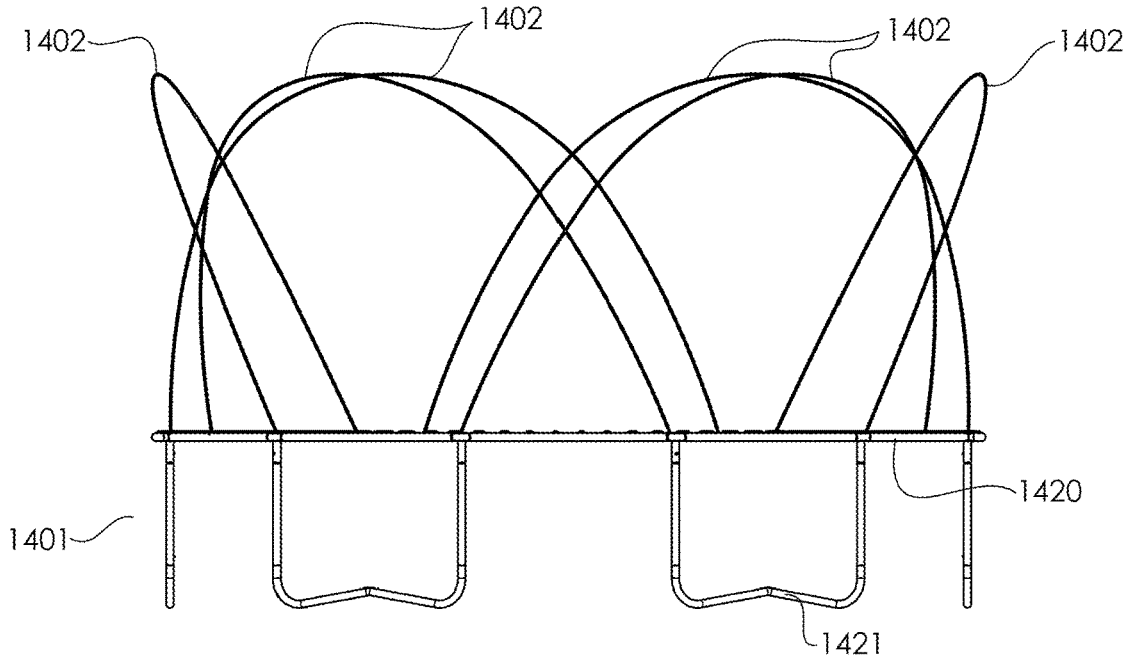
FIG. 14A is a front view of a trampoline enclosure system comprised of six arch members each attached to both the frame and the mat in an alternating configuration.
Figure 14B:
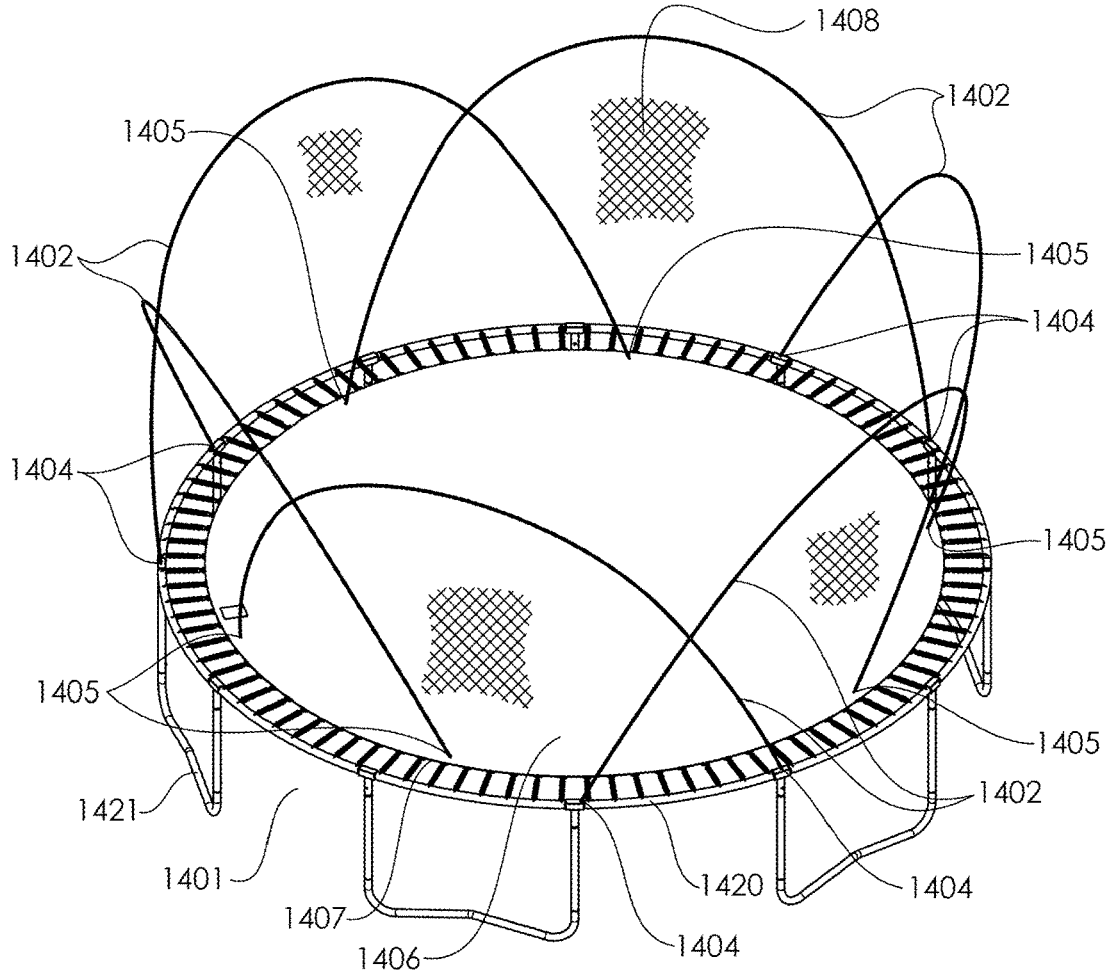
FIG. 14B is an isometric view of the trampoline enclosure system of FIG. 14A.

In alternative embodiments, in order to provide a more rigid enclosure subsystem, the enclosure subsystem's netting (e.g., the enclosure subsystem netting 105 of FIG. 1B, netting 1308 of FIGS. 13B-13F, and netting 1408 of FIG. 14B) and/or rods (e.g., and 1111 of FIG. 11F; and arched rods 1302 of FIGS. 13A-13B and 1402 of FIGS. 14A-14B) and/or any vertical support masts (e.g., vertical support masts 406 of FIGS. 4C-4D, 1006 of FIG. 10G) are attached or coupled to the frame (e.g., upper frame 1320 of FIGS. 13A-13B and 1420 of FIG. 14B) instead of or in addition to being attached or coupled to the bed subsystem (e.g., the trampoline mat 1306 of FIG. 13B and 1406 of FIG. 14B).

In embodiments where the netting is attached to the frame, it is advantageous to add an angled flap or sheet of additional netting material (e.g., netting flap 1309 of FIGS. 13D-13F) that is attached to the netting curtain about a foot above the rebounding surface and that couples or attaches the netting to the bed subsystem in addition to the frame. In such embodiments, the flap or sheet pulls on the rods where the flap or sheet meets the main curtain and causes the rods to flex inward and this adds to the rebounding effect of the bed subsystem as the flexed rods help to pull the rebounding surface back by an additional spring-like mechanism to supplement the rebounding effect of any springs of the bed subsystem. Alternatively, bungee cords or other spring-like member may be used to couple the netting curtain, when it is coupled or attached to the frame, to also be coupled or attached to the bed subsystem.

In embodiments where rods (or vertical support masts) are attached to the frame, the coupling mechanism between a rod (or vertical support mast) and the frame is advantageously configured to have limited elasticity or significant elasticity in the coupling mechanism. (For example, a coupling mechanism made of rubber, spring steel, fiberglass, silicone, springs, etc.) Such an elastic coupling mechanism on the frame allows the portion of rods (or vertical support masts) at, below, or above and nearby the coupling to the frame to move relative to the frame which is much more rigid.

In embodiments where the bed subsystem includes rod springs (or leaf springs) situated below the rebounding surface, the arched rods (or vertical support masts) may be coupled to the perimeter of the frame subsystem near the upper portion of the frame where the spring rods are coupled to the frame. It is advantageous for the coupling mechanism to secure the arched rods (or vertical support masts) at a slightly greater diameter than the perimeter of the rebounding surface so that the path of the arched rods (or vertical support masts) does not rub against the perimeter of the rebounding surface as it falls and rises when a user jumps upon it. It is also advantageous that the netting curtain is attached to the perimeter of the rebounding surface to prevent a jumper from falling below the rebounding surface and being exposed to the rod springs (or leaf springs). Sufficient slack must be created in the enclosure subsystem to account for the rotation of the perimeter of the rebounding surface relative to the frame below as the rod springs (or leaf springs) are compressed so that the net is not needlessly strained against the arched rods (or vertical support masts) with each bounce of a user.

During an impact with this trampoline system by an outside colliding body with the enclosure subsystem, the amount of energy initially absorbed by the trampoline bed and spring subsystem is greater than the amount of energy initially absorbed by the trampoline frame. It is advantageous for greater than 60% of the energy initially be absorbed by the bed and spring subsystem and less than 40% of the energy initially be absorbed by the frame. It is more advantageous for greater than 70% of the energy to be initially absorbed via the bed and spring subsystem and less than 30% by the frame. It is even more advantageous for greater than 75% of the energy to be initially absorbed via the bed and spring subsystem and less than 25% by the frame. It is even more advantageous for greater than 80% of the energy to be initially absorbed via the bed and spring subsystem and less than 20% by the frame. It is even more advantageous for greater than 85% of the energy to be initially absorbed via the bed and spring subsystem and less than 15% by the frame. It is even more advantageous for greater than 90% of the energy to be initially absorbed via the bed and spring subsystem and less than 10% by the frame. It is even more advantageous for greater than 95% of the energy to be initially absorbed via the bed and spring subsystem and less than 5% by the frame.

An alternative means of connecting the rods (or vertical support masts) to the bed subsystem is to affix a series of sleeves to the perimeter area of the bed (e.g., the support patches 911 and 912 of FIGS. 9C-9D) where the sleeve provides a channel for the pole (e.g., the arched rods 902 of FIGS. 9C-9D) (or vertical support mast) to match the glancing angle of the pole (or vertical support mast) when the sleeve 911 is folded down to be perpendicular to the bed 904 surface. Sleeves may also be attached on the netting to provide connectivity between the netting and the rods (or vertical support masts) at various heights between the bed surface and the top of the netting. A second sleeve attachment may be provided at each sleeved connection point along the perimeter such that one folds down 911 and one folds up 912, to provide two sleeves for each rod 902 (or vertical support mast), one sleeve 911 above the surface of the trampoline and the second 912 below the surface of the trampoline.

Sleeves may also be affixed to the netting (e.g., the cross patch 915 of FIGS. 9C-9D). Sleeves placed on the netting around the junction points where rods (e.g., the arched rods 902 of FIGS. 9C-9D) (or a rod and a vertical support mast) cross each other (creating an x-shape) are particularly advantageous as such sleeves help the independent rods (or rod and vertical support mast) and netting to function as an integrated unit, thus allowing an impact centered on one rod, vertical support mast, or the netting to transfer more energy to the crossing rod (or vertical support mast) and netting by means of the netting sleeves further unifying and coupling the rods (or rod and vertical support mast) and netting together into a combined functional unit. Such sleeves at rod (or rod and vertical support mast) junctions serve to also maintain the relative angle of rods (or rod and vertical support mast) crossing each other. Upon horizontal impact into a rod this reduces the amount of rod bending and increases the amount of tensile force on the impacted rod.

8. Relative Mass and Volume

The disclosed enclosure subsystem's netting and rod embodiments are advantageous in that their mass and volume compared to the mass and volume of the trampoline bed, springs, and frame is greatly reduced compared to previous products with similar Enclosure Impact Weight Ratings. One of the ways that mass of the trampoline system disclosed is reduced as compared to traditional trampoline systems on the market today is that in the disclosed embodiments, the poles or the poles' coupling devices are not welded to the frame, as such welding and/or coupling devices add to the mass. Such welding of poles or poles' coupling devices to the frame is found in many of the existing trampoline solutions employed in the market or in use today previous to this disclosure.

FIG. 23 shows the safety net system mass and frame mass for many representative products in the market or in use today along with one of the newly disclosed trampoline systems in row 2. The trampoline weight rating shown in the table is the value reported by the manufacturer unless more accurate data is available by testing performed by the inventors. Under ASTM F381-16, manufacturers are expected to ensure that the maximum specified user weight meets the test requirements of § 6.8. This is the same weight/value upon which many of the ASTM trampoline and enclosure tests are based.

However, values reported by the manufacturer and testing performed by the inventors may fall below or above the highest weight that a manufacturer could have specified while still complying with the test under exhibited an Enclosure Specified User Weight which was less than the Maximum User Weight of § 6.8 of ASTM F381-16. And, values reported by the manufacturer may understate or overstate the actual Enclosure Impact Weight Rating that could be determined by testing. Finally, values reported by testing products in the market or in use today performed by the inventors may overstate the actual Enclosure Impact Weight Rating that could be determined by testing. All products in the market or in use today for which the inventors performed testing exhibited an Enclosure Specified User Weight substantially less than the estimated Maximum User Weight of § 6.8 deduced from prior testing of other trampoline systems, whereas, for at least some of the disclosed embodiments, testing exhibited an Enclosure Specified User Weight which can be greater than the estimated Maximum User Weight of § 6.8 deduced from prior testing of other trampoline systems.

For purposes of our claims and specifications in this patent, the listed "Trampoline Weight Rating" for existing designs is believed, when based upon manufacturer's reporting, and known, when based upon inventor's testing, to be greater than the Enclosure Specified User Weight (i.e., the enclosure would fail the test at that trampoline weight rating) and for the disclosed design in row 2 the listed "Trampoline Weight Rating" is known, based upon inventor's testing, to be less than the Enclosure Specified User Weight (i.e., the enclosure would pass the test at that trampoline weight rating).

The newly disclosed enclosure system in row 2 has an enclosure subsystem mass of 15.4 lb and is able to provide an Enclosure Specified User Weight rating of at least 169 lb but we believe that many embodiments of the system would easily sustain a higher Enclosure Specified User Weight rating of 275 lb or much higher for some embodiments (e.g., 300, 305, 310, 315, 320 or 325 lb or even more). The foregoing yields a ratio of mass of enclosure subsystem to maximum user weight of 1:11 (9.1%) or less. In some advantageous embodiments, an Enclosure Specified User Weight rating of at least 171 lb is applicable and this rating gives a ratio of 9.0% or less. In some advantageous embodiments, an Enclosure Specified User Weight rating of at least 185 lb is applicable and this rating gives a ratio of 1:12 (8.3%) or less. In some advantageous embodiments, an Enclosure Specified User Weight rating of at least 193 lb is applicable and this rating gives a ratio of 8.0% or less. In some advantageous embodiments, an Enclosure Specified User Weight rating of at least 200 lb is applicable and this rating gives a ratio of 1:13 (7.7%) or less. In some advantageous embodiments, an Enclosure Specified User Weight rating of at least 205 lb is applicable and this rating gives a ratio of 7.5% or less. In some advantageous embodiments, an Enclosure Specified User Weight rating of at least 216 lb is applicable and this rating gives a ratio of 1:14 (7.1%) or less. In some advantageous embodiments, an Enclosure Specified User Weight rating of at least 220 lb is applicable and this rating gives a ratio of 7.0% or less. In some advantageous embodiments, an Enclosure Specified User Weight rating of at least 231 lb is applicable and this rating gives a ratio of 1:15 (6.7%) or less. In some advantageous embodiments, an Enclosure Specified User Weight rating of at least 237 lb is applicable and this rating gives a ratio of 6.5% or less. In some advantageous embodiments, an Enclosure Specified User Weight rating of at least 246 lb is applicable and this rating gives a ratio of 1:16 (6.3%) or less. In some advantageous embodiments, an Enclosure Specified User Weight rating of at least 257 lb is applicable and this rating gives a ratio of 6.0% or less. In some advantageous embodiments, an Enclosure Specified User Weight rating of at least 262 lb is applicable and this rating gives a ratio of 1:17 (5.9%) or less. In some advantageous embodiments, an Enclosure Specified User Weight rating of at least 277 lb is applicable and this rating gives a ratio of 1:18 (5.6%) or less. In some advantageous embodiments, an Enclosure Specified User Weight rating of at least 280 lb is applicable and this rating gives a ratio of 5.5% or less. In some advantageous embodiments, an Enclosure Specified User Weight rating of at least 293 lb is applicable and this rating gives a ratio of 1:19 (5.3%) or less. In some advantageous embodiments, an Enclosure Specified User Weight rating of at least 308 lb is applicable and this rating gives a ratio of 1:20 (5.0%) or less.

None of the existing systems on the market or in use today can achieve such an unexpectedly low ratio. A 9.1% ratio means that one may take the mass of the enclosure subsystem (or the mass of the safety net System) and divide it by the ratio, 9.1%, to compute a weight which may be successfully applied as the Enclosure Specified user weight rating and potentially meet the test requirements of § 6.8 of ASTM F381-16 and if it does meet them then necessarily it would also meet the requirements of the § 6.1 of the ASTM F 2225-15, and thus permitting the computed weight to be listed as the maximum specified user weight under ASTM F381-16 and ASTM F 2225-15.

FIG. 24 lists the standardized mass of a bed subsystem for various geometries of trampoline systems. The standardized mass of the bed subsystem reflects the mass of bed and springs for a typical 14' frame diameter model typically found on the market or in use and scaled proportionally up or down to the diameter or shape of the frame for each model. The standardized mass is the sum the following masses: bed fabric, bed edging, spring connectors FIG. 25 shows the ratio of the safety net system mass to a standardized mass of a bed subsystem for many representative products in the market or in use today along with one of the newly disclosed trampoline systems in row 2. Most of the disclosed enclosures advantageously have a safety net system mass that is less than 55% of the standardized mass of a bed subsystem and more advantageously less than 50% and even more advantageously less than 45% and even more advantageously less than 40%. For the representative trampoline systems surveyed all have a safety net system mass to a standardized mass of a bed subsystem ratio of at least 60%.

FIG. 26 shows the ratio of the mass of the safety net system to the gross shipping weight and to the gross shipping weight for a standardized gross weight for many representative products in the market or in use today along with one of the new disclosed trampoline systems in row 2. The standardized gross weight is the gross shipping weight of the trampoline system with the actual weight of the bed subsystem subtracted out and replaced with the standardized mass of the bed subsystem from FIG. 24 and an adjusted estimated box and packing material weight. In the disclosed embodiments, it is advantageous that the ratio of the mass of the enclosure subsystem to the gross shipping weight is less than or equal to 11% and even more advantageous to be less than or equal to 10% and even more advantageous to be less than or equal to 9%. It is also advantageous that the ratio of the mass of the enclosure subsystem to the standardized gross shipping weight be less than or equal to 10% and more advantageous to be less than or equal to 9% and even more advantageous to be less than or equal to 8%.

FIG. 27 shows the safety net system's mast and any required foam for many representative products in the market or in use today along with one of the new disclosed trampoline systems in row 2.

For a 150 lb jumper impacting the disclosed enclosure subsystem, the weight of poles, netting, and other enclosure subsystem parts which are necessary to safely protect the jumper is less than 65% of the weight of safety net systems (necessary to safely protect the jumper) in existing trampoline solutions that include jumper enclosing protections on the market or in use today.

As shown by the above, the disclosed embodiments provide trampoline systems that are substantially lighter (many of the disclosed embodiments weighing less than 20 lb and having less than 10% of the mass of the gross shipping weight of the whole trampoline system) and have much less volume (volume of box for poles and any needed foam padding less than 250 $in^3$ for many disclosed embodiments) than any solutions on the market or in use today while still maintaining similar quality, safety, and functional strength. Because reduced mass and volume both directly reduce the cost of shipping a trampoline to a customer, the disclosed invention provides a major advantage in the economy trampoline marketplace where the end-customer shipping represents a large percentage of the final cost to consumers.

Many of the disclosed embodiments include enclosure subsystems, whose netting, poles, and any required foam padding altogether combined weigh less than 25 lb, and are capable of passing the Enclosure Impact Weight Rating for a weight rating of at least 50 lb. The following table 8-1 discloses the representative mass for various disclosed embodiments and an Enclosure Impact Weight Rating they would be capable of meeting:

TABLE 8-6

| Enclosure Subsystem Mass | ASTM Weight Rating (lb) | Ratio |
|---|---|---|
| 16 | 175 | 9.1% |
| 17 | 187 | 9.1% |
| 18 | 200 | 9.0% |
| 19 | 210 | 9.0% |
| 20 | 225 | 8.9% |
| 21 | 240 | 8.8% |
| 22 | 250 | 8.8% |

The ratio improves in the above table due to most of the available netting curtain materials being able to withstand the highest ASTM enclosure impact weight ratings shown in this table and thus only the rods (or vertical support mast) and/or couplings need to be sized up, coupled together more through additional interconnect coupling between rods (or rods and vertical support masts), or increased rod (or vertical support mast) count to provide a greater ASTM enclosure impact weight rating.

The disclosed embodiments include enclosure subsystems whose poles and any required foam padding altogether combined are capable of fitting into a box with volume less than 325 $in^3$, and are capable of passing the Enclosure Impact Weight Rating for a weight rating of at least 169 lb. The following table 8-2 discloses the maximum volume for one of the various disclosed embodiments and the resulting Enclosure Impact Weight Rating as compared to the same system without the new enclosure subsystem design (using an old enclosure subsystem):

TABLE 8-7

| | Maximum Safety Net System Volume ($in^3$) | ASTM Weight Rating (lb) | Ratio |
|---|---|---|---|
| SkyBounce with New Enclosure Subsystem | 250 | 169 | 1.48 |
| SkyBounce with Old Enclosure Subsystem | 2457 | 220 | 11.17 |

The ratio of the new enclosure subsystem is better than traditional safety net systems in the market or in use as shown in the above table.

9. Further Details of Certain Disclosed Embodiments

The above and other objects, effects, features, and advantages of the present devices will become more apparent from the following description of the embodiments thereof taken in conjunction with the accompanying drawings.

The disclosed trampoline system provides a huge cost benefit because it reduces material costs by greatly reducing the amount of material that goes into the enclosure subsystem. In addition to material costs by reducing the diameter and density of the enclosure subsystem pole material, and also eliminating the space required by the pole padding, the product can fit into a much smaller box. The much smaller and lighter box can be shipped for a small fraction of the cost of a traditional enclosure subsystem.

9.1. Basic Embodiments

Figure 1A:
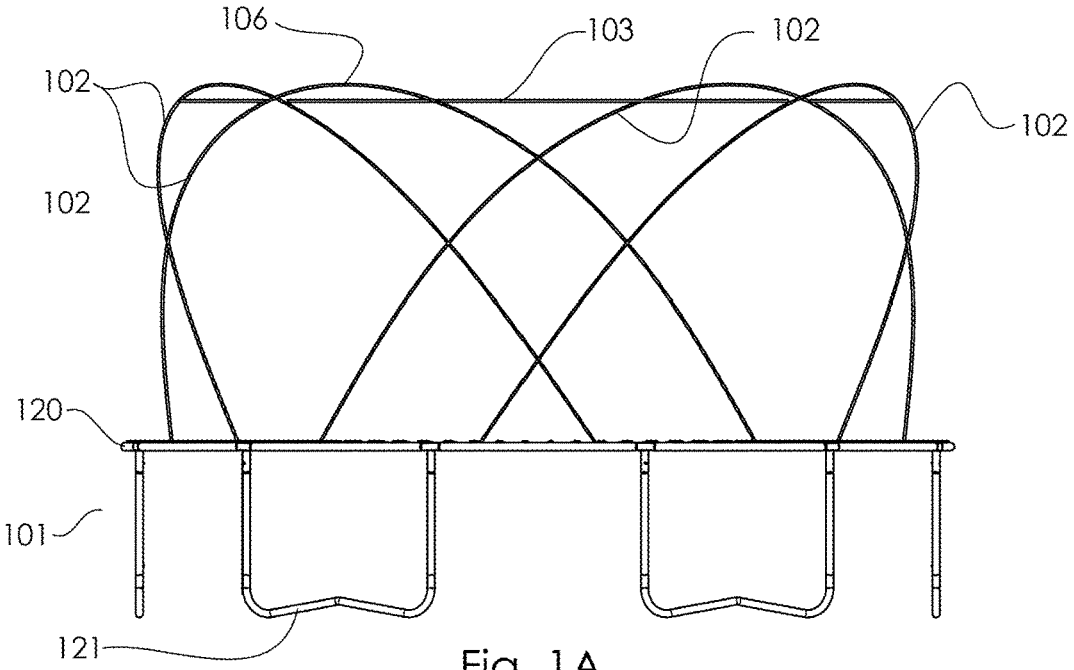
FIG. 1A is a front view of a lightweight trampoline enclosure system comprised of four arch members.
Figure 1B:
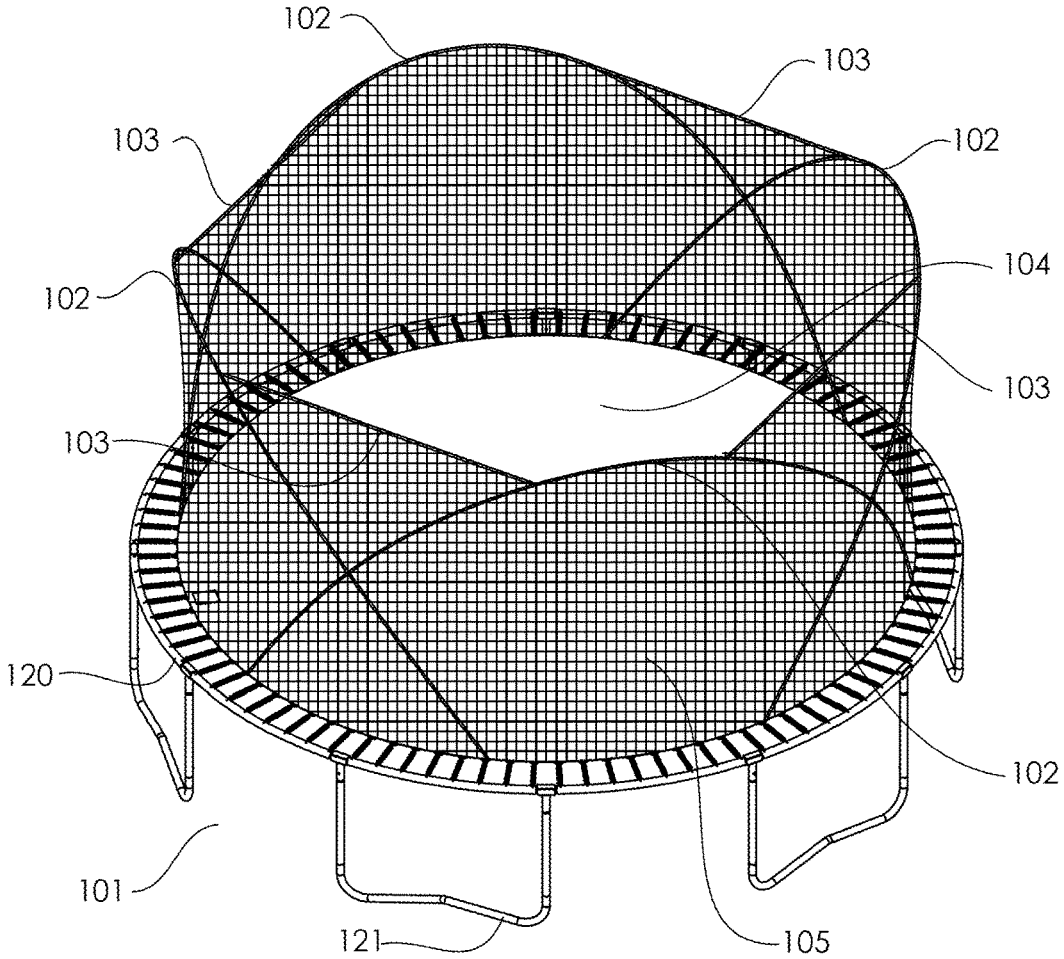
FIG. 1B is an isometric view of the trampoline enclosure system of FIG. 1A.

FIGS. 1A-1B show a front view and an isometric view of a trampoline system 101 with a lightweight enclosure subsystem comprised of four rods. The trampoline system 101 is comprised of a circular trampoline upper frame 120, six frame legs 121, four arched support rods 102, connecting top straps 103, and a trampoline mat 104. The arched support rods 102 reach a maximum height at apex 106. FIG. 1B shows the enclosure subsystem netting 105 that is held up by the rods 102 and top straps 103 and attached to the trampoline mat 104.

Figure 2A:
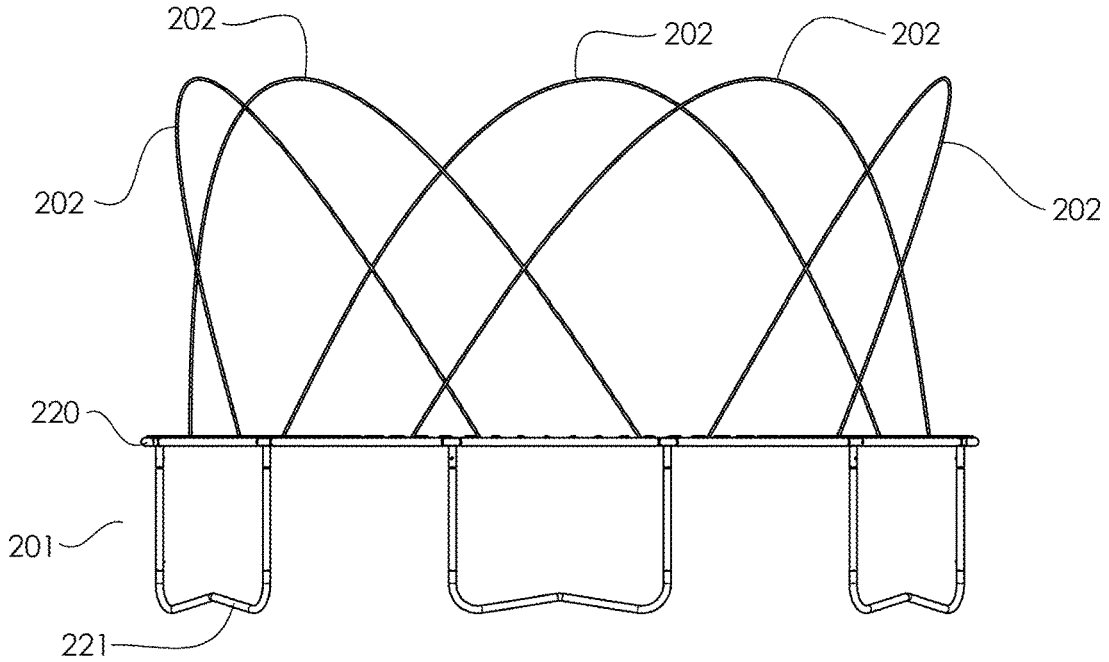
FIG. 2A is a front view of a trampoline enclosure system comprised of five arch members.
Figure 2B:
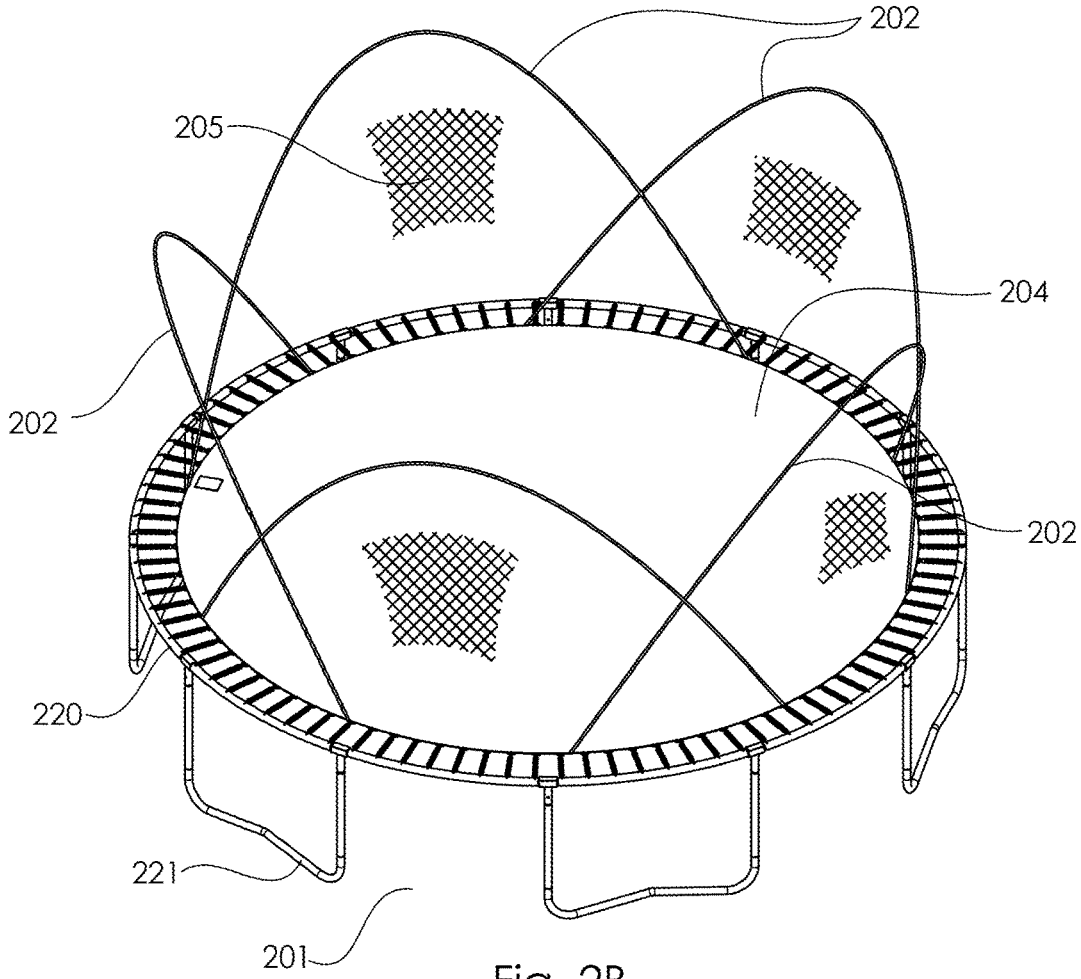
FIG. 2B is an isometric view of the trampoline enclosure system of FIG. 2A.

FIGS. 2A-2B show a front view and an isometric view of a trampoline system 201 with a lightweight enclosure subsystem. The trampoline system 201 is comprised of a circular trampoline upper frame 220, six frame legs 221, five arched support rods 202, an enclosure subsystem net 205, and a trampoline bed 204. The enclosure subsystem net 205 is supported by the rods 202 and attached to the trampoline bed 204.

Figure 3A:
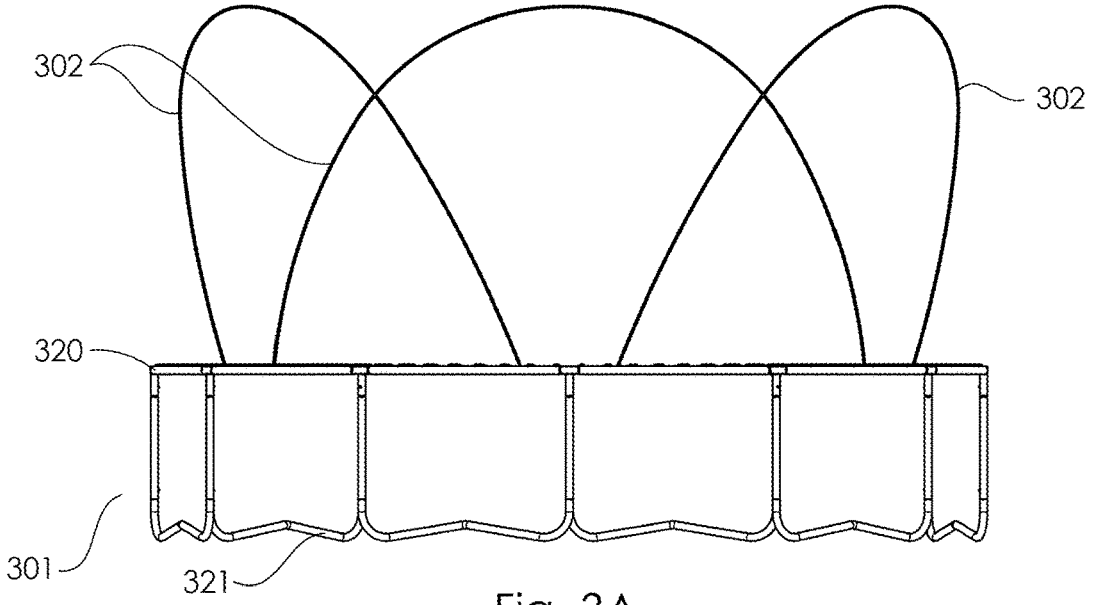
FIG. 3A is a front view of a trampoline enclosure system comprised of six arch members.
Figure 3B:
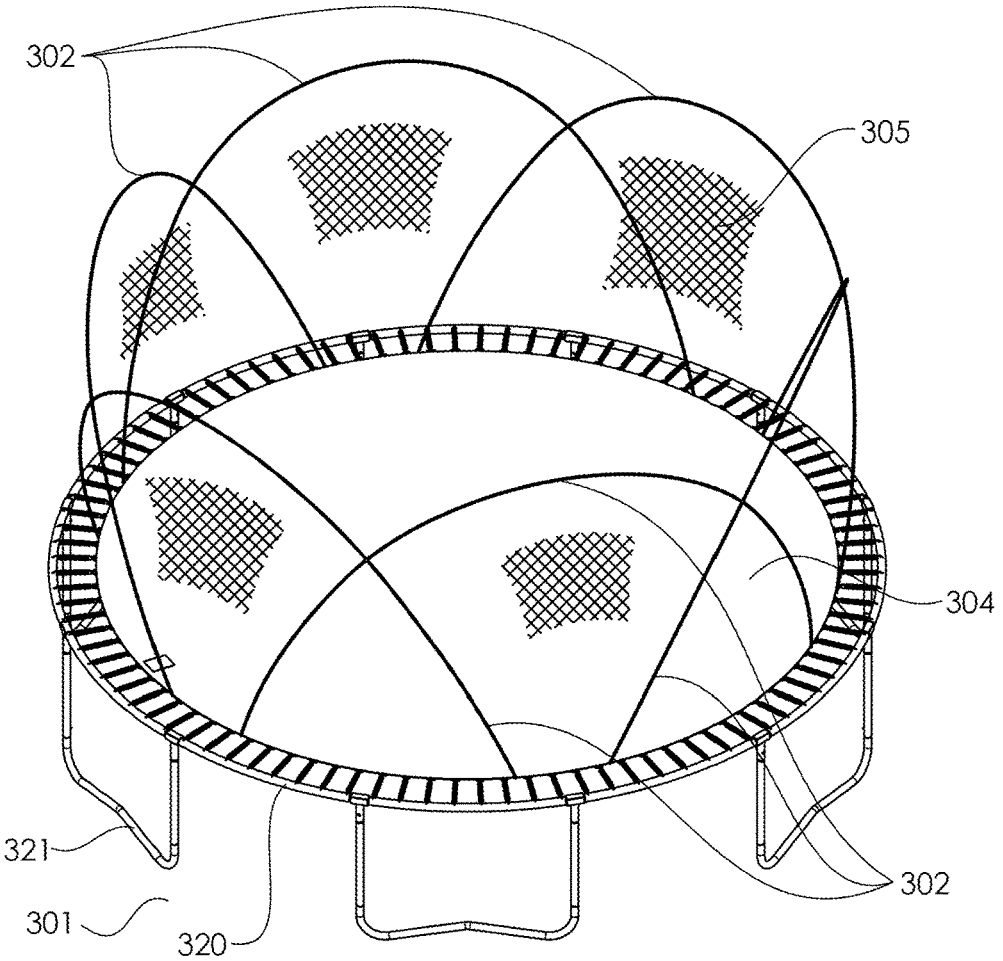
FIG. 3B is an isometric view of the trampoline enclosure system of FIG. 3A.

FIGS. 3A-3B show a front view and an isometric view of a trampoline system 301 with a lightweight enclosure subsystem. The trampoline system 301 is comprised of a circular trampoline upper frame 320, six frame legs 321, six arched support rods 302, an enclosure subsystem net 305, and a trampoline bed 304. The enclosure subsystem net 305 is supported by rods 302 and attached to trampoline bed 304.

Figure 4A:
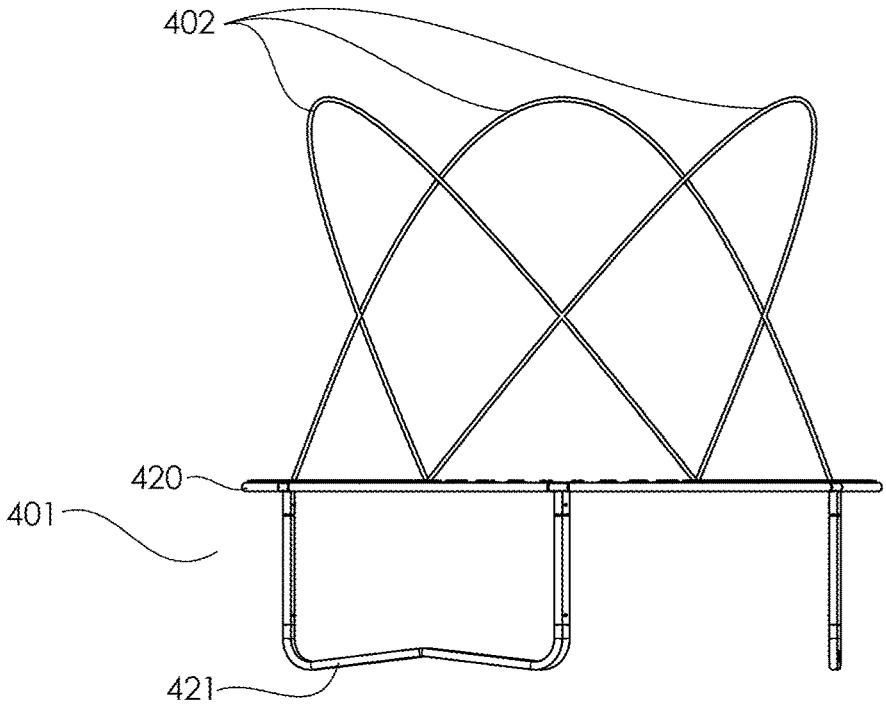
FIG. 4A is a front view of a trampoline enclosure system comprised of three arch members.
Figure 4B:
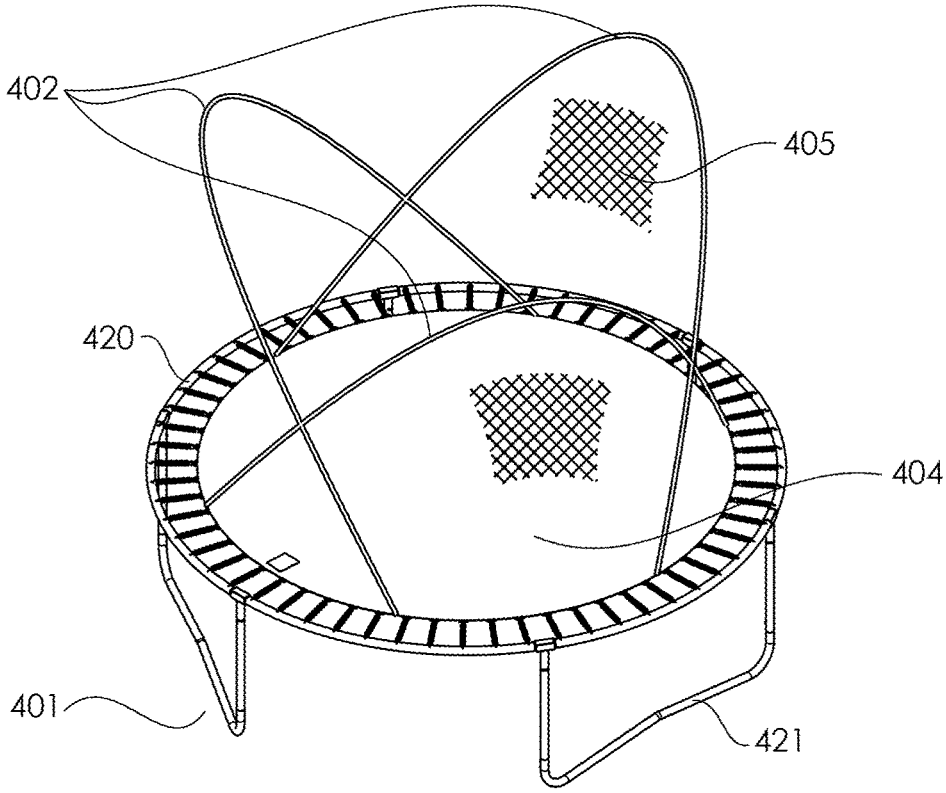
FIG. 4B is an isometric view of the trampoline enclosure system of FIG. 4A.

FIGS. 4A-4B show a front view and an isometric view of a trampoline system 401 with a lightweight enclosure subsystem. The trampoline system 401 is comprised of a small diameter circular trampoline upper frame 420, three frame legs 421, three arched support rods 402, an enclosure subsystem net 405, and a trampoline bed 404. When the trampoline system 401 is a smaller diameter it is viable to use fewer support rods 402. The enclosure subsystem net 405 is supported by rods 402 and attached to trampoline bed 404.

Figure 4C:
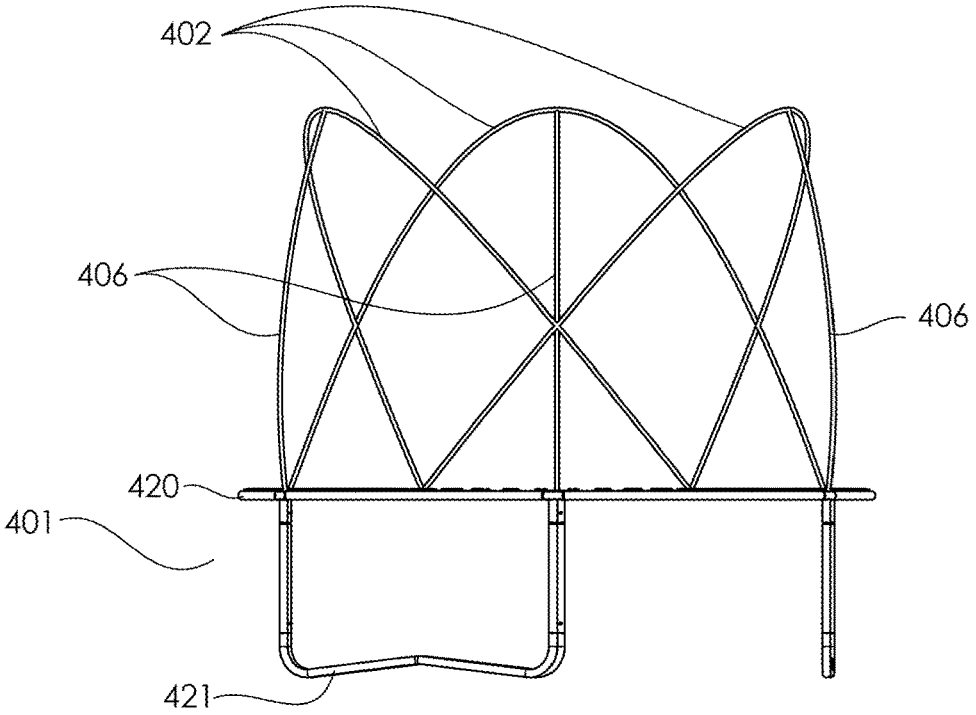
FIG. 4C is a front view of a trampoline enclosure system comprised of three arch members with vertical support masts.
Figure 4D:
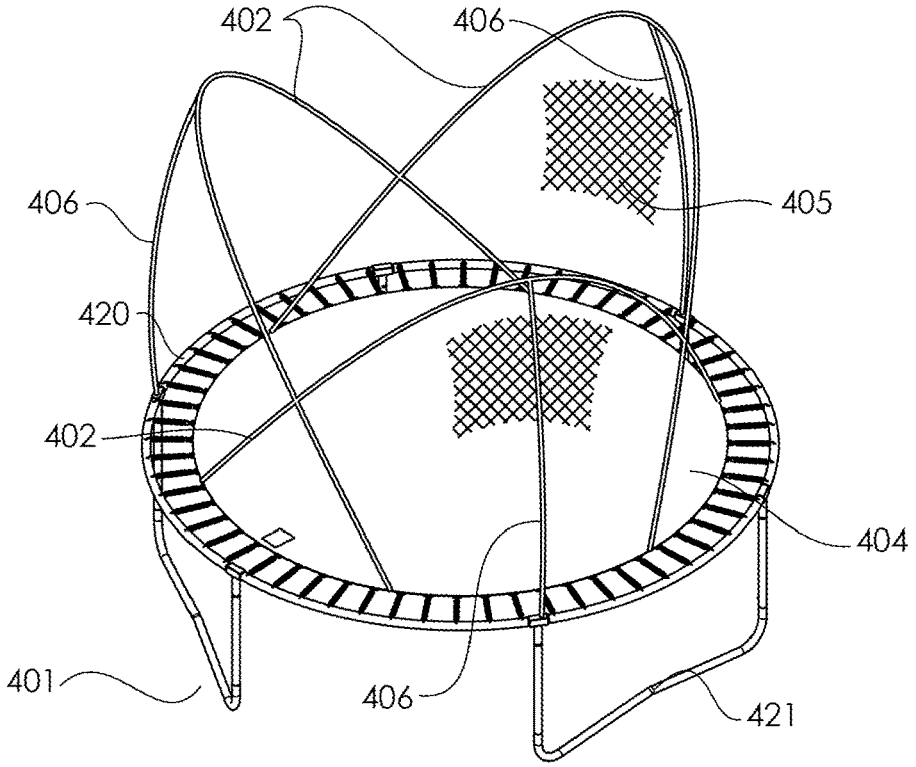
FIG. 4D is an isometric view of the trampoline enclosure system of FIG. 4C.

FIGS. 4C-4D show a front view and an isometric view of a trampoline system 401 with a lightweight enclosure subsystem. The trampoline system 401 is comprised of a small diameter circular trampoline upper frame 420, three frame legs 421, three arched support rods 402, three vertical support masts 406, an enclosure subsystem net 405, and a trampoline bed 404. When the trampoline system 401 is a smaller diameter it is viable to use fewer support rods 402. The enclosure subsystem net 405 is supported by rods 402 and vertical support masts 406 and attached to trampoline bed 404. The vertical support masts 406 are attached to the upper frame 420.

Figure 5A:
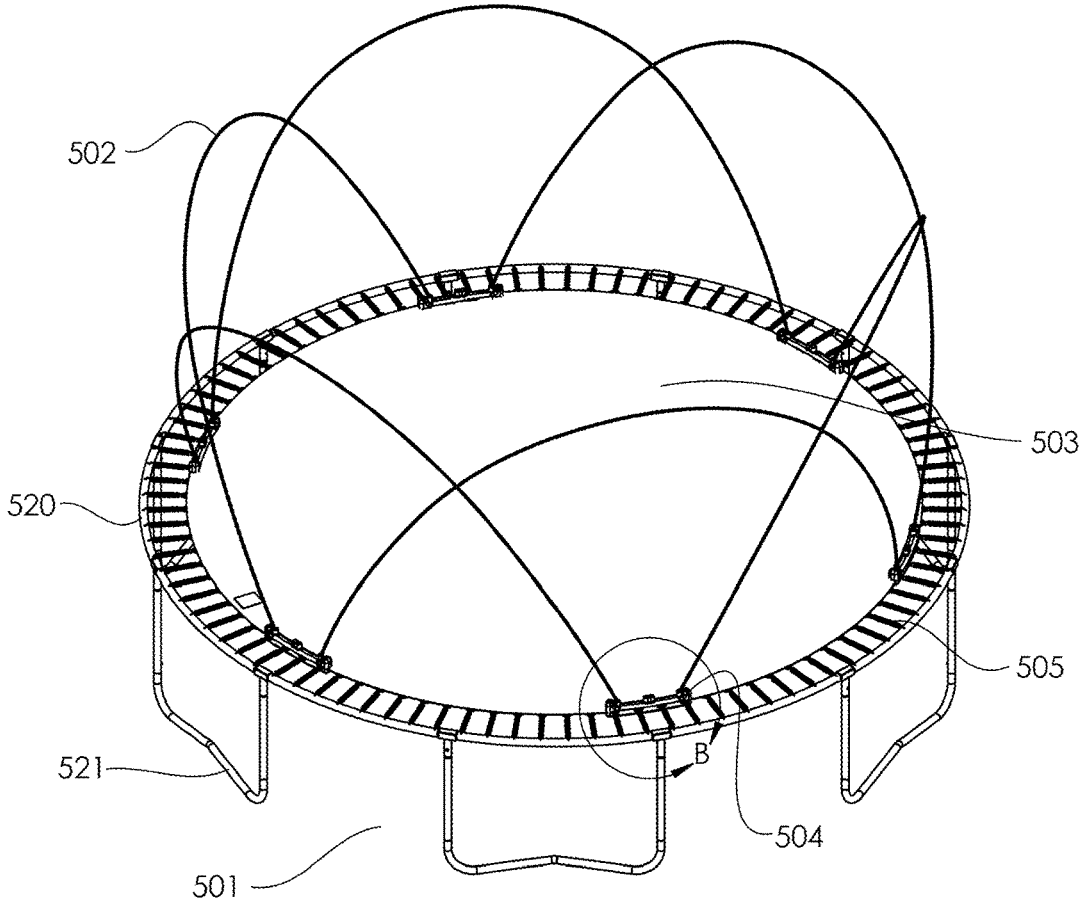
FIG. 5A is an isometric view of a trampoline enclosure system comprised of six arch members.

FIG. 5A is an isometric view of a circular trampoline system 501 with a lightweight enclosure subsystem. The trampoline system 501 is comprised of a circular trampoline upper frame 520, six frame legs 521, and six support rods 502 that mount in a base 504 attached to the edge of the trampoline bed 503. An enclosure subsystem net, not shown, is supported by rods 502. The trampoline springs 505 pass through the rod base 504 to secure the rod base 504 to the edge of the bed 503.

Figure 5B:
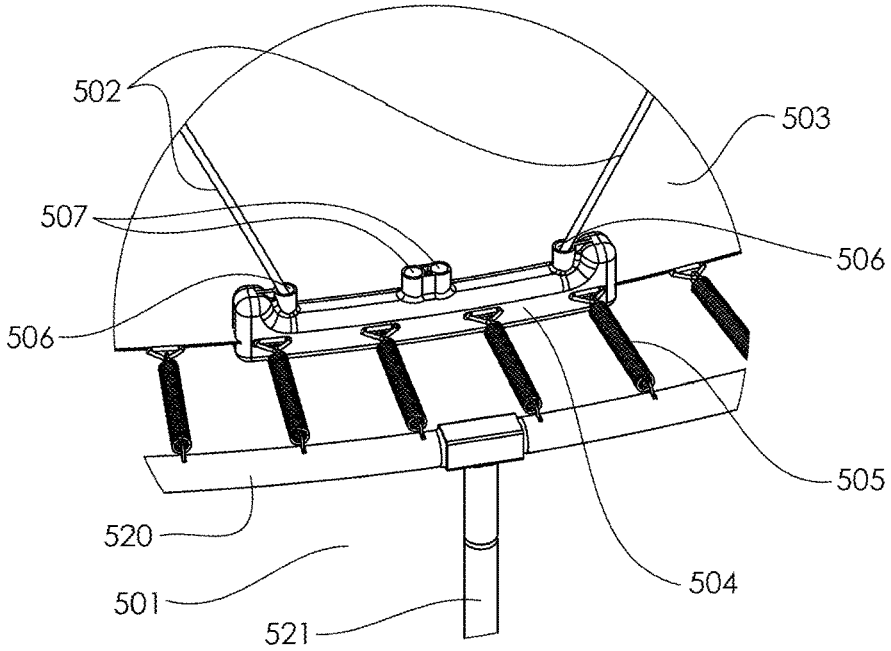
FIG. 5B is an isometric view showing further details of the region within the area B of the trampoline enclosure system of FIG. 5A.

FIG. 5B is a detailed isometric view showing further details of the region within area B of the trampoline system 501 of FIG. 5A. It shows the rod base 504 and how the springs 505 pass through it. It is also shown with two outside holes 506 and two inside holes 507. The rod base 504 has either multiple hole locations as shown for adjustability, or it has holes for only one optimized configuration. The configuration shown has the support rods 502 attaching to the two outer holes 506. The rod base 504 can be anything that connects to the edge of the mat and can provide a way to mount the rods 502. An ideal configuration for this rod base 504 is where it is only underneath the mat 503, and the mounting holes 506 and 507 are flush with the surface of the mat and are aligned on the outside of it in between the springs 505. This is an improvement because the mat protects a user from the rod base 504, and there is no need to have additional padding covering the base 504.

Figure 6A:
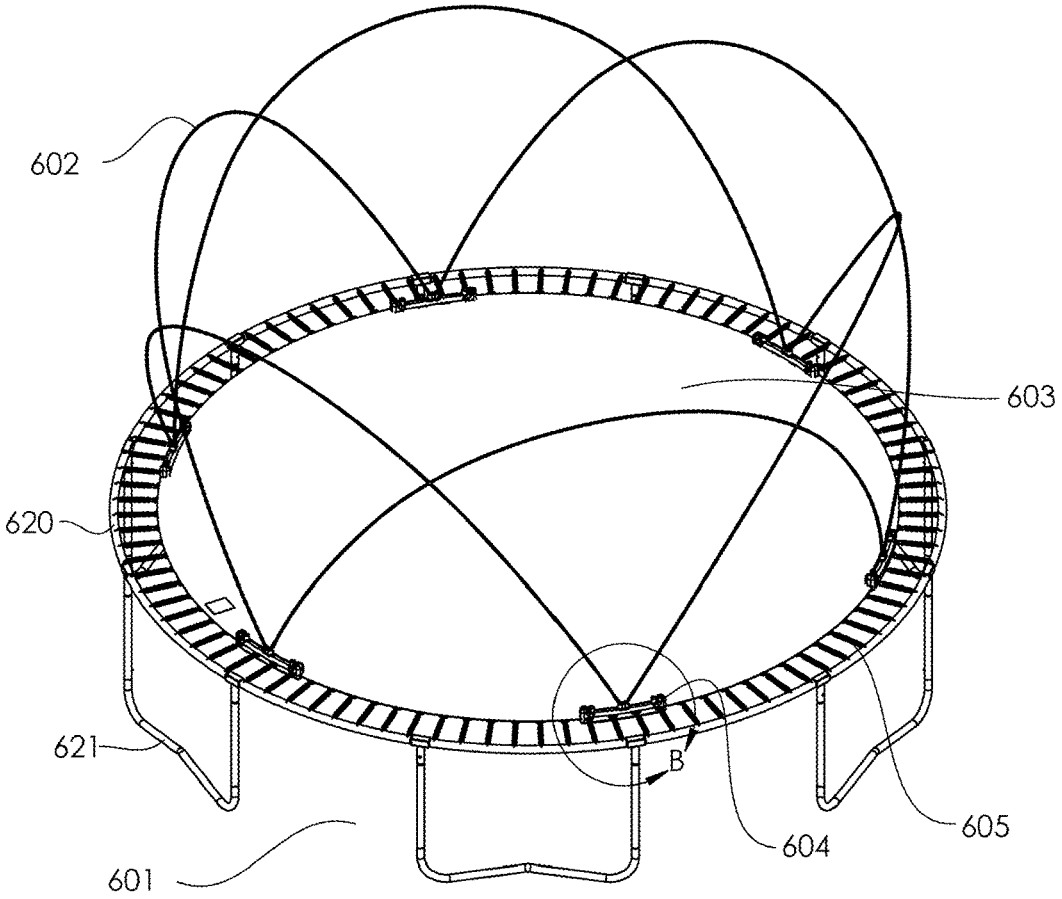
FIG. 6A is an isometric view of a trampoline enclosure system comprised of six arch members.

FIG. 6A is an isometric view of a circular trampoline system 601 with a lightweight enclosure subsystem. The trampoline system 601 is comprised of a circular trampoline upper frame 620, six frame legs 621, and six support rods 602 that mount in a base 604 attached to the edge of the trampoline bed 603. An enclosure subsystem net, not shown, is supported by rods 602. The trampoline springs 605 pass through the rod base 604 to secure the rod base 604 to the edge of the bed 603. This configuration shows the rods 602 attached to the center of the support base 604. This improves the performance of the enclosure subsystem against side impacts, but it comes at a cost of increased materials because the support rods 602 become longer.

Figure 6B:
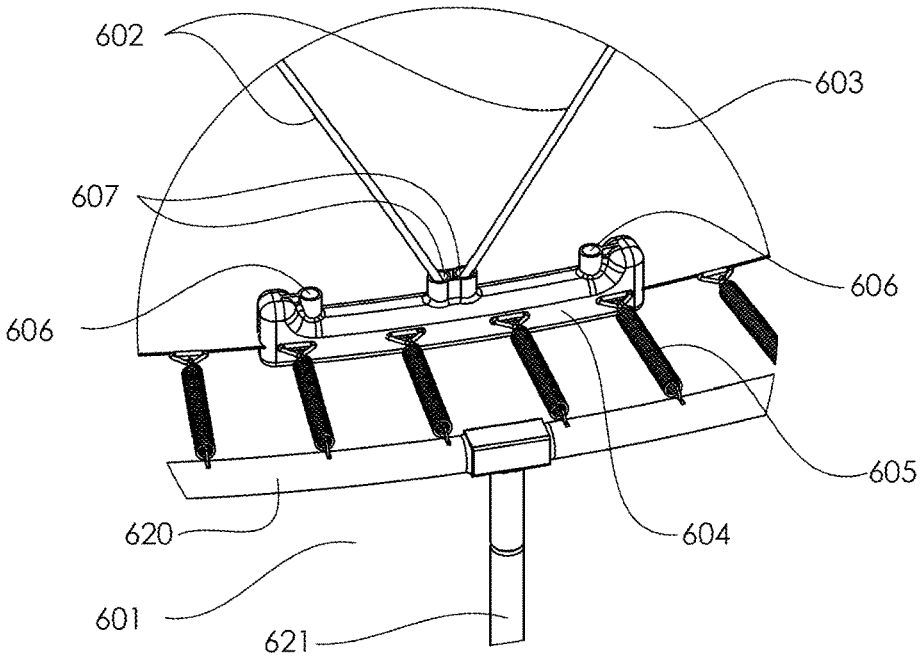
FIG. 6B is an isometric view showing further details of the region within the area B of the trampoline enclosure system of FIG. 6A.

FIG. 6B is a detailed isometric view showing further details within area B of the trampoline system 601 of FIG. 6A. It shows the rod base 604 and how the springs 605 pass through it. It is also shown with two outside holes 606 and two inside holes 607. The rod base 604 either has multiple hole locations as shown for adjustability, or it has holes for only one optimized configuration. The configuration shown has the support rods 602 attaching to the two inner holes 607.

Figure 7A:
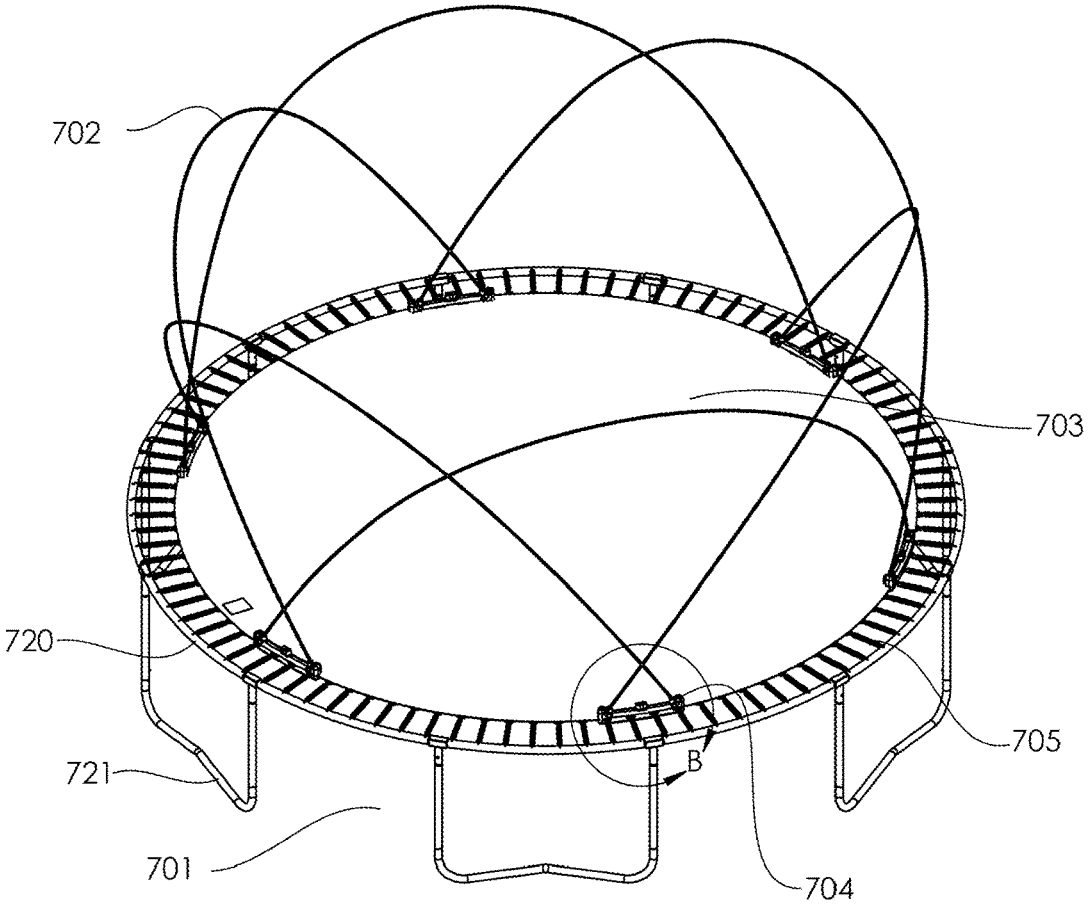
FIG. 7A is an isometric view of a trampoline enclosure system comprised of six arch members.

FIG. 7A is an isometric view of a circular trampoline system 701 with a lightweight enclosure subsystem. The trampoline system 701 is comprised of a circular trampoline upper frame 720, six frame legs 721, and six support rods 702 that mount in a base 704 attached to the edge of the trampoline bed 703. An enclosure subsystem net, not shown, is supported by rods 702. The trampoline springs 705 pass through the rod base 704 to secure the rod base 704 to the edge of the bed 703. (The V-rings 709 along the perimeter of bed 703 go through thin slots on the base 704, and the springs 705 hook onto the V-rings 709. This prohibits the base 704 from moving up or down because of the V-rings 709. This is because of the bed 703, and the base 704 cannot move out because the springs 705 are larger than the rod base 704 slot.) This configuration shows the rods 702 crossing each other and connecting to the outside holes of the support base 704. This improves the performance of the enclosure subsystem against side impacts even more than the middle connection shown in FIG. 6, but it comes at another cost of increased materials because the support rods 702 become longer still.

Figure 7B:
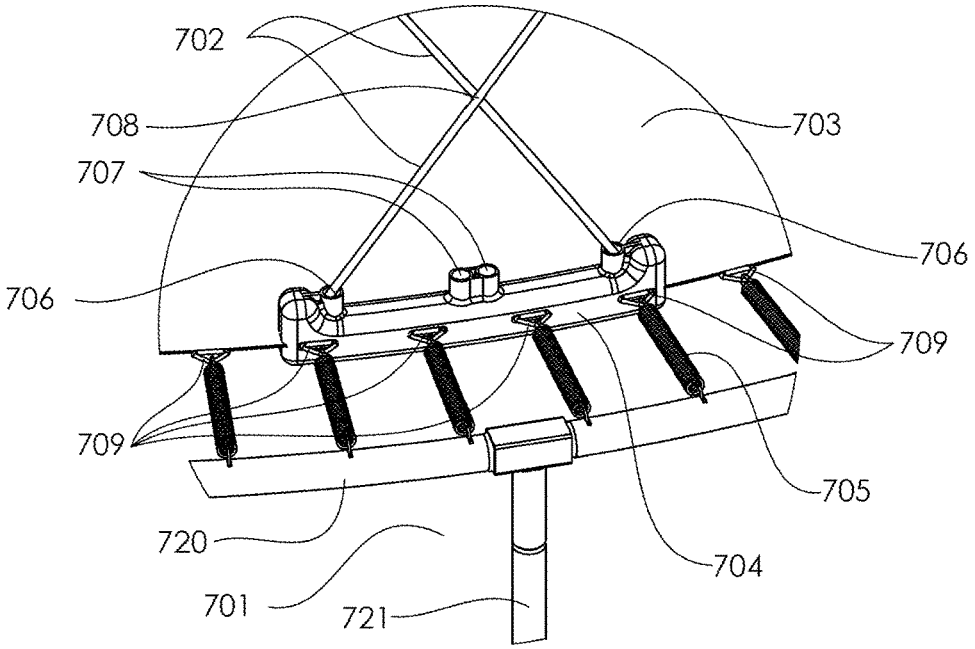
FIG. 7B is an isometric view showing further details of the region within the area B of the trampoline enclosure system of FIG. 7A.

FIG. 7B is a detailed isometric view showing further details within area B of the trampoline system 701 of FIG. 7A. It shows the rod base 704 and how the springs 705 pass through it. It is also shown with two outside holes 706 and two inside holes 707. The rod base 704 either has multiple hole locations as shown for adjustability, or it has holes for only one optimized configuration. The configuration shown has the support rods 702 crossing each other to form an x-shape at crossing point 708 and then attaching to the two outer holes 706.

Figure 8A:
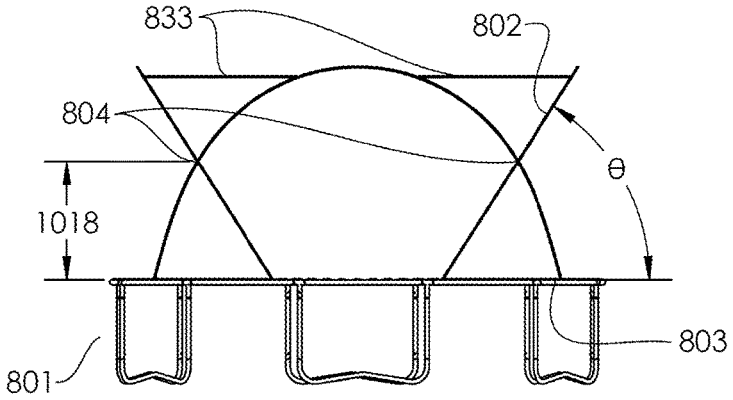
FIG. 8A is a side view of a trampoline enclosure system comprised of four arch members with a glancing angle, θ, of 57°.

FIG. 8A is a side view of a trampoline system 801 with four arched support rods 802 and connecting top straps 833. The rod glancing angle, θ, which is formed between the support arches 802 and the flat top of the trampoline frame 803, is 57 degrees and the height of where the rods 802 cross to form an x-shape 804 from the top of the trampoline frame 803 is 1018 mm. There are many variables that influence the resulting geometry of the enclosure subsystem including the number of arched rods 802, the diameter of the trampoline system 801, the spacing of where the rods 802 terminate, the curvature of the rods 802 and the height of the rods 802. Designing an enclosure subsystem requires making tradeoffs to find the optimal configuration. The optimal configuration also depends on the user's weight and target cost. For instance, decreasing the rod angle improves the performance of an impact at the center of the arched rod 802, but it also lowers the cross height, which reduces the performance of an impact where the rods cross 804. Other examples include adding more rod material which rigidifies the structure, but also increase the cost of the product.

Figure 8B:
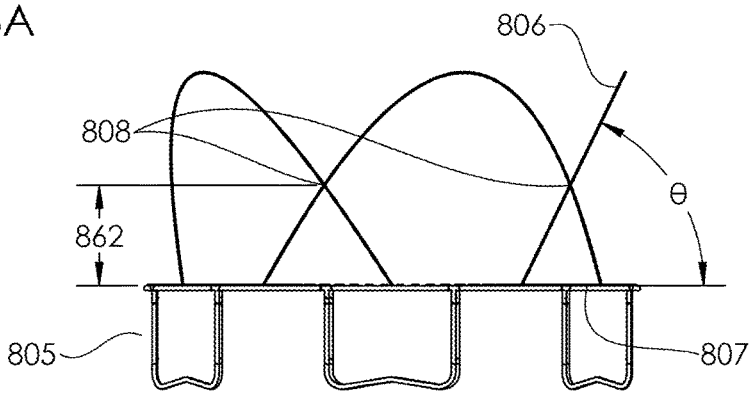
FIG. 8B is a side view of a trampoline enclosure system comprised of five arch members with a glancing angle, θ, of 64°.

FIG. 8B is a side view of a trampoline system 805 with five arched support rods 806. The rod glancing angle, θ, which is formed between the support arches 806 and the flat top of the trampoline frame 807, is 64 degrees and the height of where the rods 806 cross to form an x-shape 808 from the top of the trampoline frame 807 is 862 mm. Increasing the number of rods 806, increases the rod angle, and it also increases the height of cross 808, but the arches 806 shown in FIG. 8B have a sharper curvature than the rods 802 of FIG. 8A, so the resulting height of cross 808 is lower.

Figure 8C:
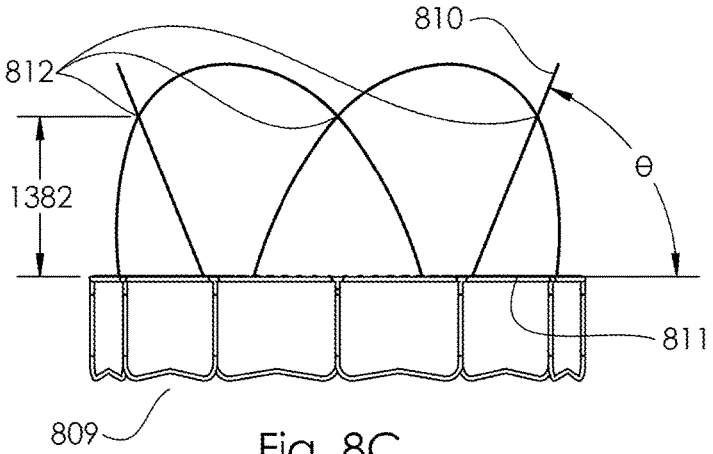
FIG. 8C is a side view of a trampoline enclosure system comprised of six arch members with a glancing angle, θ, of 68°.

FIG. 8C is a side view of a trampoline system 809 with six arched support rods 810. The rod glancing angle, θ, which is formed between the support arches 810 and the flat top of the trampoline frame 811, is 68 degrees and the height of where the rods 810 cross to form an x-shape 812 from the top of the trampoline frame 811 is 1382 mm. In this case, increasing the number of rods 810 increases the rod angle and also the height of cross 812.

Figure 8D:
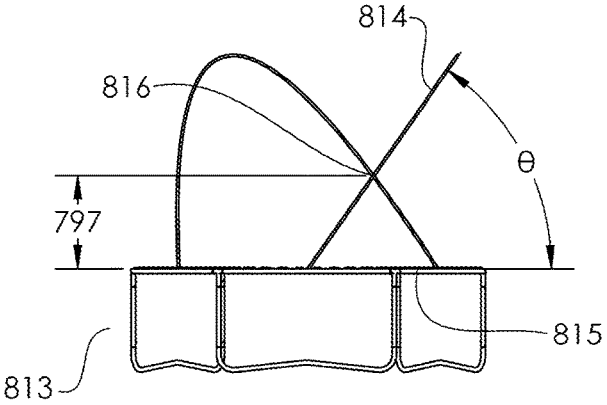
FIG. 8D is a side view of a trampoline enclosure system comprised of three arch members with a glancing angle, θ, of 55°.

FIG. 8D is a side view of a smaller diameter trampoline system 813 with three arched support rods 814. The rod glancing angle, θ, which is formed between the support arches 814 and the flat top of the trampoline frame 815, is 55 degrees and the height of where the rods 814 cross to form an x-shape 816 from the top of the trampoline frame 815 is 797 mm. By reducing the number of arches 814 to three, this system has significantly reduced the rod angle compared to the four-ached system in FIG. 8A, but because the diameter of the trampoline is also reduced, the resulting rod angle of 55 degrees is not far off from the original 57 degrees in 8A.

Figure 8E:
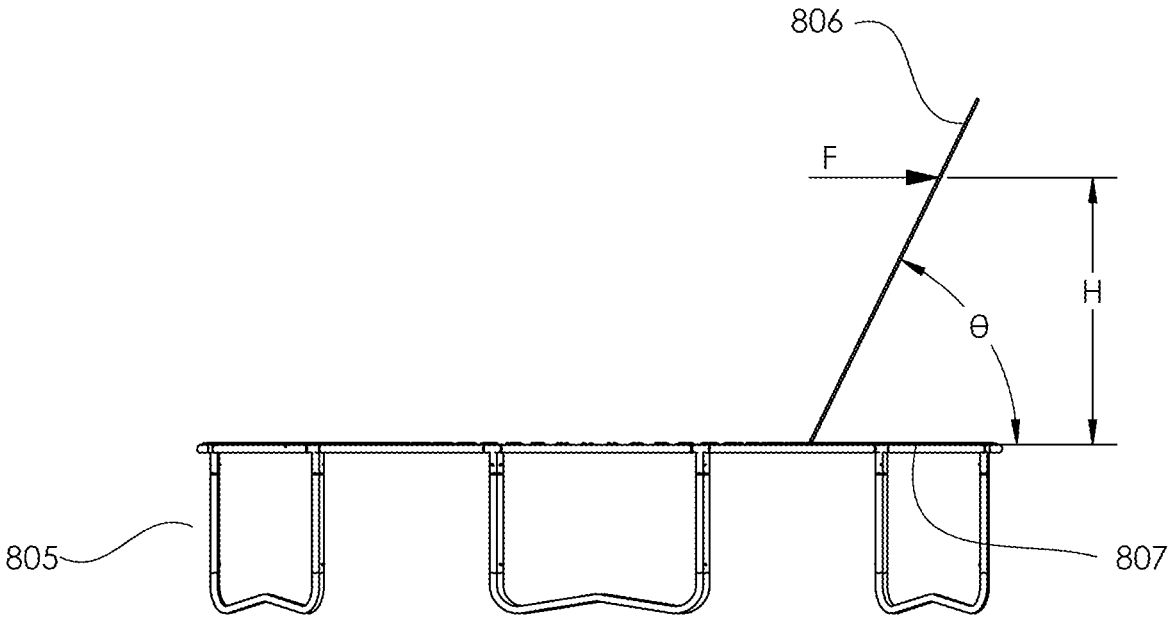
FIG. 8E is a side view of a trampoline enclosure system of FIG. 8B with only one arch member shown.

FIG. 8E is a side view of a lightweight trampoline system 805 of FIG. 8B with only one of the five arched support rods 806 shown when loaded with a horizontal impact force at height H above the plane of the bed and with horizontal impact force F. The rod glancing angle, θ, which is formed between the support arch 806 and the flat top of the trampoline frame 807.

Figure 8F:
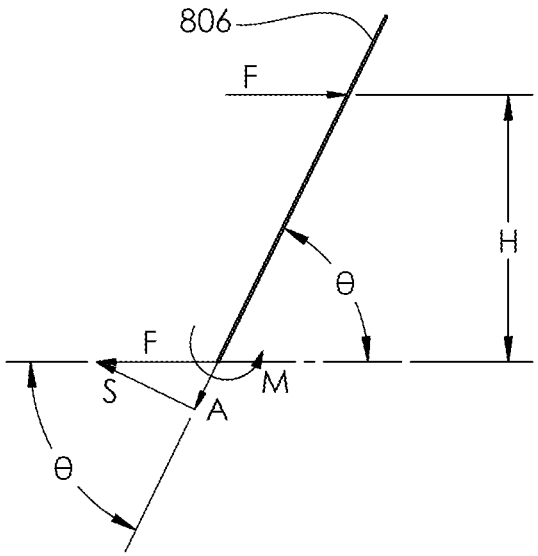
FIG. 8F depicts a free body diagram of the arch member shown in FIG. 8E when loaded with a horizontal impact force.

FIG. 8F depicts a free body diagram of the arch member 806 shown in FIG. 8E when loaded with a horizontal impact force at height H above the plane of the bed and with horizontal impact force F. To the degree that F is parallel to the plane of the rod, F causes an in plane bending stress and to the degree that F is perpendicular to the plane of the rod, F causes an out of plane bending stress. A is the tensile force at the base of the arch, S is the shear force at the base of the arch, and M is the bending moment at the base of the arch. This simplified model of the forces excludes the effect of the net and other poles of the enclosure subsystem but shows how the tensile force advantageously increases as the glancing angle decreases. The following table 9-1 provides the amount of tensile force in a rod for a horizontal impact force of 500 lb at a height of 4 ft for a rod configured at various glancing angles in this model.

TABLE 9-1

| Glancing Angle (θ) | Horizontal Impact Force | Impact Height | Tensile Force in Rod | Bending Moment at Supports |
|---|---|---|---|---|
| 90° | 500 lb | 4 ft | 0 lb | 2000 ft-lb |
| 80° | 500 lb | 4 ft | 87 lb | 2000 ft-lb |
| 70° | 500 lb | 4 ft | 171 lb | 2000 ft-lb |
| 60° | 500 lb | 4 ft | 250 lb | 2000 ft-lb |
| 50° | 500 lb | 4 ft | 321 lb | 2000 ft-lb |
| 40° | 500 lb | 4 ft | 383 lb | 2000 ft-lb |
| 30° | 500 lb | 4 ft | 433 lb | 2000 ft-lb |

FIG. 9A is an angled view showing a circular trampoline system 901 with a reinforced arched rod enclosure subsystem. The trampoline system 901 is comprised of a circular trampoline upper frame 920, six frame legs 921, arched rods 902, cross straps 903, trampoline mat 904, reinforcement cross patches 905, and below mat support sleeves 906. In an alternative embodiment, not shown, cross straps 903 can be replaced with a single substantially horizontal mast. The horizontal masts could be mounted anywhere between the top of the enclosure and the surface of the trampoline. In some embodiments it is advantageous to have two or three horizontal masts to strength the enclosure. An enclosure subsystem net, not shown, is supported by rods 902. These reinforcement straps 903, patches 905 and sleeves 906 are constructed out of rope, fabric, or webbing materials which are strong and rigid when loaded in tension. These reinforcing materials can be carefully located so that they significantly rigidify the arched rods 902. During a horizontal impact, the cross straps 903 reduce bending of the arched rods 902, keeping them from flattening significantly and increasing the amount of load transferred via tensile force. (The strap 903 directly prevents the rod's 902 arch from flattening. This reduces the amount of bending within the plane of the netting curtain, but it also reduces the amount the arch bends outward, outside the plane of the netting curtain, because when a jumper impacts an arch, it also pulls and flattens the adjacent arches. By preventing the arches from flattening, it effectively stiffens the arch against bending outwards, reducing how far a jumper travels away from the center of the bed.) The cross straps 903 fix two points of the rods 902 together where they form an x-shape and these points must move apart for the rods 902 to flatten. The cross strap 903 holds the points together and withstands the impact loads in tension. The reinforcement cross patches 905 prevent and minimize movement of the crossing rods 902 relative to each other. The patches are made out of solid pieces of webbing that are sewn together, alternatively they are fabric pieces with webbing reinforced edges, or they are webbing strips sewn into the netting material. Alternatively, not shown, fabric sleeves can be integrated into the netting curtain and run for long extents, enclosing rod portions covering up to 10%, 20%, 30%, 40%, 50%, 60%, 70%, 80%, 90%, or even 100% of a rod's path along the netting curtain depending upon the level of strengthening and rigidity desired. Such fabric sleeves tend to increase the amount of in plane bending stress resulting from an impact. The below mat support sleeves 906 hold the bottom of the rods 902 and prevents them from rotating. (Because of all the strapping, the rods 902 are prevented from bending in any direction except for outwards, which the rods 902 would not do when impacted from the inside.) The sleeves 906 are supported by additional supports 907 which are either webbing straps, or solid pieces of fabric. The additional reinforcement 907 connects the ends of the sleeves 906 to multiple points on the trampoline bed 904 which prevents the rods 902 and sleeves 906 from rotating side-to-side. Additionally, leg straps 908 connect the ends of the sleeves 906 to the frame legs 921 and are used to control the sleeves 906 and prevent the ends of each of the rods 902 from rotating inward and add greater capacity for the rod 902 as a whole to store energy through added bending stress during an impact. The leg straps 908 are attached to a portion of the rod that is below the rebounding bed surface, so that when the enclosure subsystem is impacted, some of the bending stress of the impact against the rods transfers to the portion of the rods below the bed. Finally, inter-sleeve supports 909 connects the ends of adjacent sleeves 906 to each other to further prevent the rods 902 and sleeves 906 from rotating side-to-side.

FIG. 9B is a front view showing the trampoline system 901 of FIG. 9A with a reinforced arched rod enclosure subsystem.

FIG. 9C is an angled view of a circular trampoline system 901 with a reinforced arched rod lightweight enclosure subsystem. The trampoline system 901 is comprised of a circular trampoline upper frame 920, six frame legs 921, six arched rods 902, cross straps 903, a trampoline mat 904, sewn fabric reinforcement cross patches 915, below mat sewn fabric support patches 911, and above mat sewn fabric support patches 912. The above and below sewn fabric support patches 911 and 912 have fabric sleeves 910 sewn on for holding the ends of the rods 902. Additionally, retention clamps can be added to the rods 902 which sit under the edge of the bed 904 which prevent the rods 902 from being pulled out of the sleeves 910. An example of this would be to glue small bushings onto the rod ends 902, and then clamp on a flanged cover in between the mat 904 and the bushing. The bushing presses on the flanged cover, and the flanged end of the cover cannot pass though the mat 904. Other potential retention methods include clamping onto the rods 902 directly, clamping with set screws, using friction-based rubber sleeves, or having a threaded connection where you can install a plate which is supported by the mat 904. Both above and below mat sewn fabric support patches are shown but potentially only one or the other is required. Together, the system of sleeves 910 and fabric support patches 911 and 912 help prevent twisting of the rods 902. Sewn fabric reinforcement cross patches 915 are simply two pieces of fabric that are sewn together such that they form crossing passageways that you can slide the crossing rods 902 through. This prevents the rods 902 from sliding and squeezing together during an impact and helps maintain the angle created by the x-shape formed by the crossing rods. Maintaining the x-shape helps prevent the rods from collapsing so that more load is transferred via axial force and less via shear force.

FIG. 9D is a front view showing the trampoline system 901 with a reinforced arched rod enclosure subsystem of FIG. 9C FIG. 9E is an isometric view of a circular trampoline system 901 with a lightweight enclosure subsystem. The trampoline system 901 is comprised of a circular trampoline upper frame 920, six frame legs 921, six arch rods 913, diagonal straps 914, and trampoline bed 904. The diagonal straps 914 help prevent collapsing of the rods 913. On a horizontal impact with a jumper, the straps 914 result in the transfer of more energy into the bed subsystem by causing the adjacent rods 913 to be pulled out of the plane of their relaxed state ellipse via bending stress on these rods that are more distant from the point of impact. This bending, remote from impact location, results in tensile force, transferring more energy to the bed subsystem at additional locations. Alternatively, the diagonal straps (not shown) could be configured to connect to practically any point along the perimeter of bed 904, depending upon the angle of the strapping.

FIG. 9F is a front view of the trampoline system 901 of FIG. 9E with a lightweight enclosure subsystem.

FIG. 10A is an angled view showing a circular trampoline system 1001 with a lightweight enclosure subsystem. The trampoline system 1001 is comprised of a circular trampoline upper frame 1020, six frame legs 1021, and six trapezoidal rods 1002.

FIG. 10B is a front view of a two-segment arch which results in a triangular shaped rod.

FIG. 10C is a front view of a three-segment arch which results in the trapezoidal rod 1002 shown in FIG. 10A.

FIG. 10D is a front view of a four-segment arched rod.

FIG. 10E is a front view of a five-segment arched rod.

FIG. 10F is an angled view of a circular trampoline system 1001 with a lightweight enclosure subsystem. The trampoline system 1001 is comprised of a circular trampoline upper frame 1020, six frame legs 1021, and multiple x-shaped crossing rod structures 1003.

FIG. 10G is a front view of the trampoline system 1001 shown in FIG. 10F showing vertical support masts 1006 and rod structures 1003 which are interconnected with a top strap 1005 and a mid-strap 1004. In some embodiments, a top strap 1005 or a mid-strap 1004 may be used without the other strap. Additional strapping can be added if needed to sufficiently rigidify and unify the system to help transfer energy more efficiently to distant areas of the enclosure subsystem and bed subsystem. For example, diagonal straps 914 such as shown in FIGS. 9E-9F. The strapping may be substituted by a rigid coupler which helps to prevent collapse of the enclosure subsystem. The shapes shown in FIGS. 10B-10E may be applied to the embodiments shown in FIGS. 10F-10G to create additional embodiments.

9.2. Alternate Embodiments

FIG. 11A is a front view of an oval trampoline system 1101 with an arched rod enclosure subsystem. The oval trampoline system 1101 is comprised of an oval trampoline upper frame 1120, four frame legs 1121, end rods 1102, and side rods 1103. Analogously to FIGS. 11E-11F, vertical support masts, not shown, supported by upper frame 1120, may optionally be added to support the apex or other intersecting point near the apex of side rods 1103.

Figure 11B:
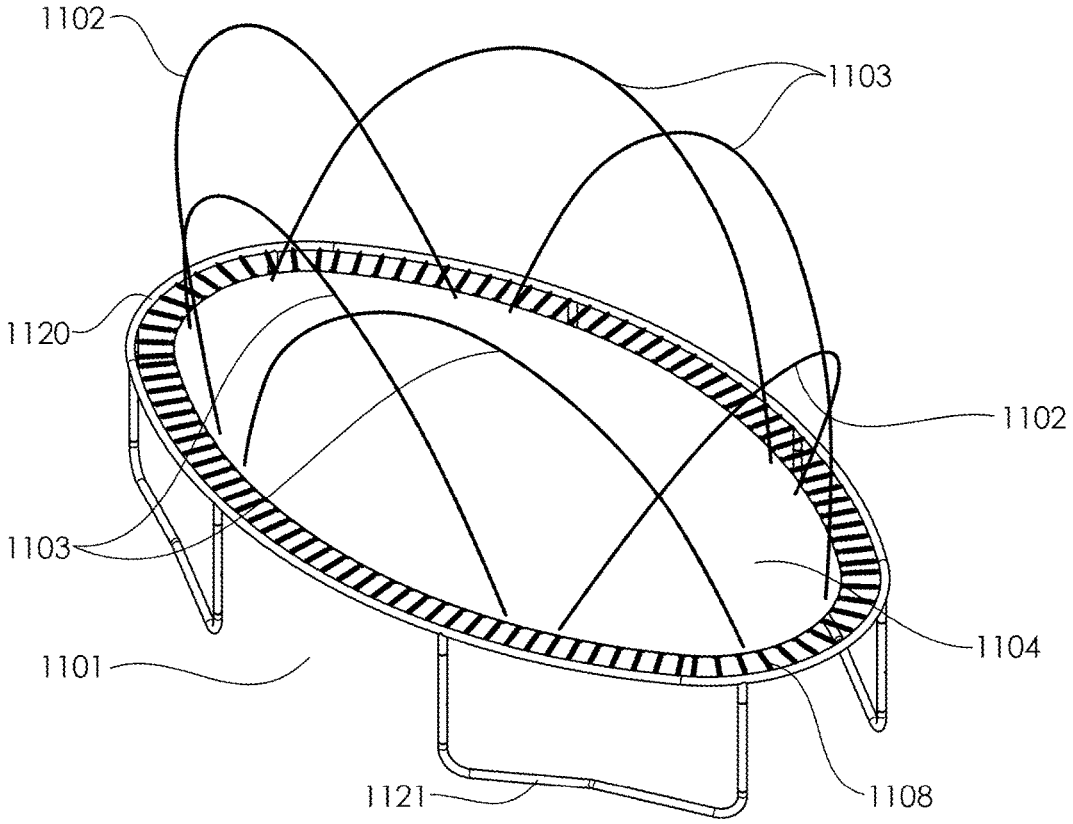
FIG. 11B is an isometric view of the oval trampoline of FIG. 11A.

FIG. 11B is an isometric view of the oval trampoline system 1101 of FIG. 11A with an arched rod enclosure subsystem. The oval trampoline system 1101 is comprised of an oval trampoline bed 1104, upper frame 1120 and trampoline springs 1108. It is shown having two different size rods, smaller end rods 1102 at the end of the trampoline 1101 and greater spanning side rods 1103 at the long sides of the trampoline 1101.

Figure 11C:
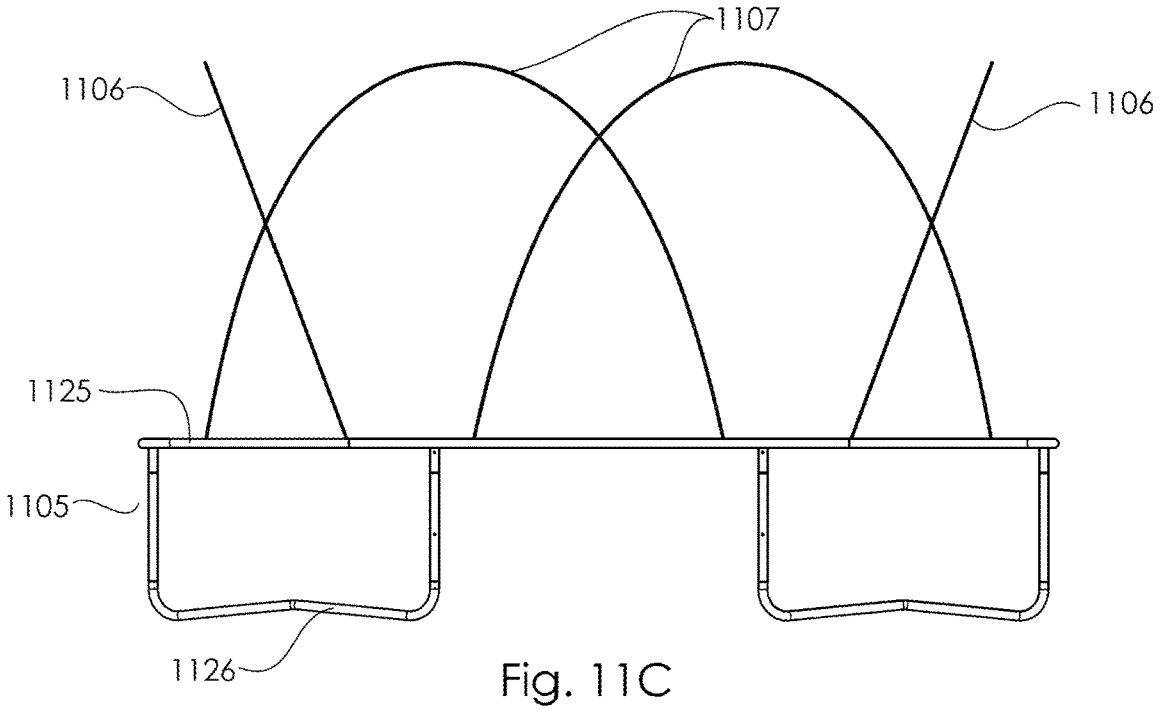
FIG. 11C is front view of a rectangular trampoline with a trampoline enclosure system comprised of six arched members.

FIG. 11C is a front view of a rectangular trampoline system 1105 with an arched rod enclosure subsystem. The rectangular trampoline system 1105 is comprised of a rectangular trampoline upper frame 1125, four frame legs 1126, end rods 1106, and side rods 1107.

Figure 11D:
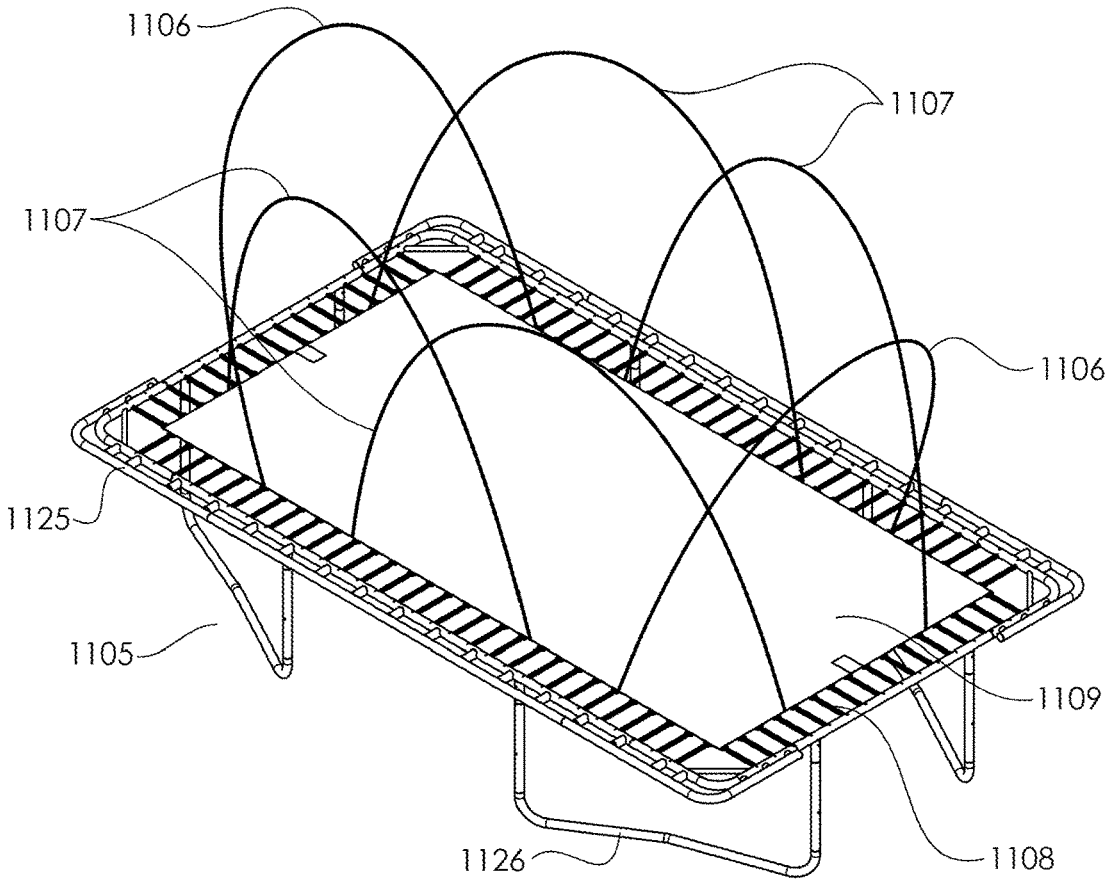
FIG. 11D is an isometric view of the rectangular trampoline of FIG. 11C.

FIG. 11D is an isometric view of the rectangular trampoline system 1105 of FIG. 11C comprising an arched rod enclosure subsystem, rectangular trampoline bed 1109, and trampoline springs 1108. It is shown having two different size rods, smaller end rods 1106 at the end of the trampoline system 1105 and greater spanning side rods 1107 at the long sides of the trampoline system 1105.

Figure 11E:
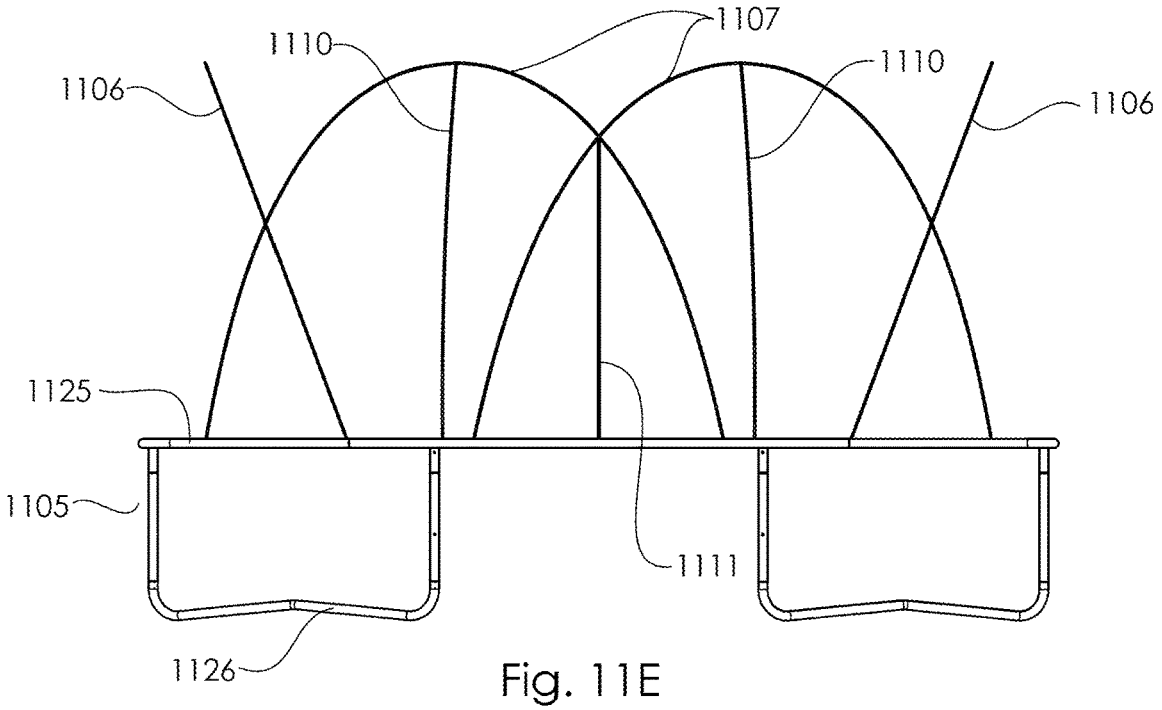
FIG. 11E is front view of a rectangular trampoline with a trampoline enclosure system comprised of six arched members and vertical support masts.

FIG. 11E is a front view of a rectangular trampoline system 1105 with an arched rod enclosure subsystem. The rectangular trampoline system 1105 is comprised of a rectangular trampoline upper frame 1125, four frame legs 1126, end rods 1106, side rods 1107, apex vertical support masts 1110, and intersection vertical support masts 1111.

Figure 11F:
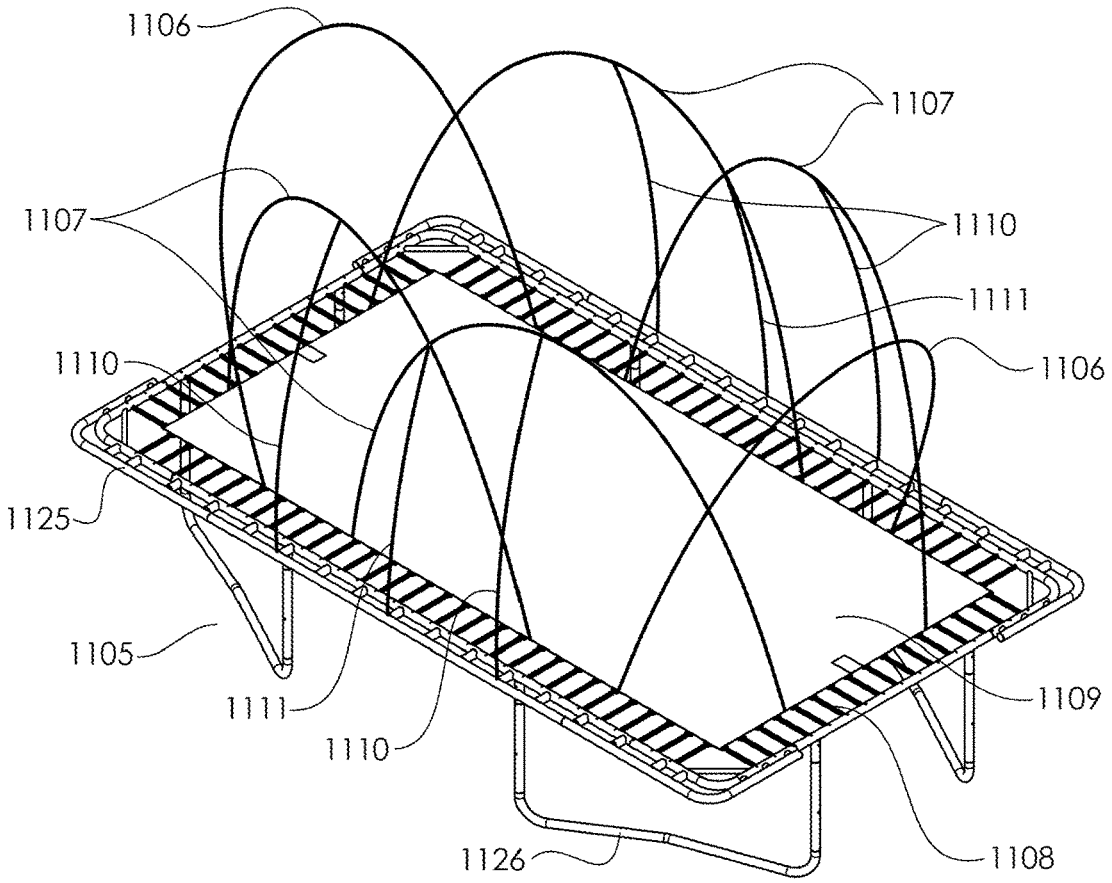
FIG. 11F is an isometric view of the rectangular trampoline of FIG. 11E.

FIG. 11F is an isometric view of the rectangular trampoline system 1105 of FIG. 11E with an arched rod enclosure subsystem, rectangular trampoline bed 1109, and trampoline springs 1108. It is shown having two different size rods, smaller end rods 1106 at the end of the rectangular trampoline system 1105 and greater spanning side rods 1107 at the long sides of the trampoline system 1105. The greater spanning side rods 1107 are supported at their apex by vertical support masts 1110 and supported at their intersection by vertical support masts 1111. The vertical support masts 1110 and 1111 are attached to the upper frame 1125.

Figure 11G:
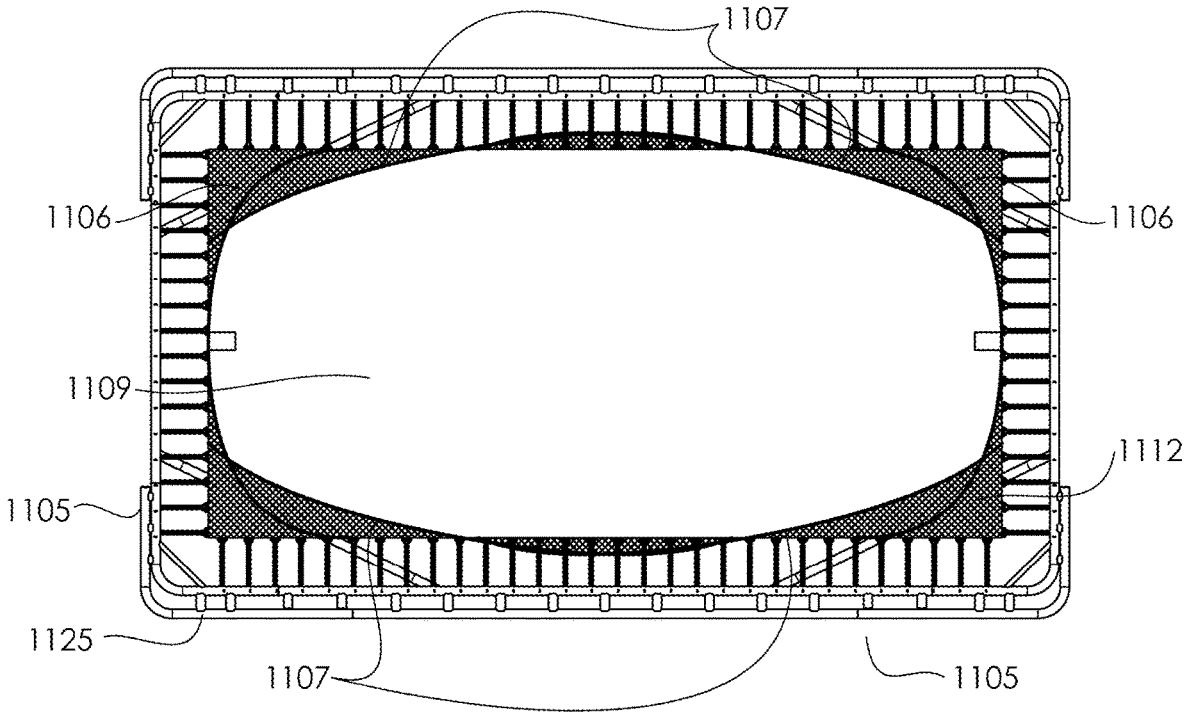
FIG. 11G is a top view of the rectangular trampoline of FIG. 11E.

FIG. 11G is a top view showing the upper frame 1125 of the rectangular trampoline system 1105 of FIG. 11E with an arched rod enclosure subsystem, rectangular trampoline bed 1109, and trampoline springs 1108. It is shown having two different size rods, smaller end rods 1106 at the end of the trampoline system 1105 and greater spanning side rods 1107 at the long sides of the trampoline system 1105. A netting curtain 1112 is suspended by end rods 1106 and side rods 1107 and attached at the bottom to the perimeter of bed 1109 in the area where the bed 1109 is coupled to the springs 1108. Because as viewed from above the end rods 1106 pass inside of and outside of the perimeter of bed 1109, the netting curtain 1112 is visible inside of end rods 1109 near the rods' center and visible outside of end rods 1109 near the rod's functional ends where the netting curtain 1112 approaches the surface of bed 1109.

9.3. Rod Embodiments

FIG. 12A is a front view of a solid cylindrical arched member (or rod).

FIG. 12B is a side cross section view along line B of the solid cylindrical arched member of FIG. 12A.

FIG. 12C is a front view of a solid cross-shaped arched member (or rod).

FIG. 12D is a side cross section view along line D of the solid cross-shaped arched member of FIG. 12C.

FIG. 12E is a front view of a solid square-shaped arch member (or rod).

FIG. 12F is a side cross section view along line F of the solid square-shaped arched member of FIG. 12E.

FIG. 12G is a front view of a hollow cylindrical arched member (or rod).

FIG. 12H is a side cross section view along line H of the hollow cylindrical arched member of FIG. 12G.

FIG. 12I is a front view of a grouped cylindrical arched member (or rod) composed of three cylindrical adjacent segments. Other numbers of adjacent segments may be grouped (not shown) together such as two, four, five, or six segments. Segments with different cross-sectional shapes may be grouped (not shown) such as square-shaped or cross-shaped. The grouped segments may be staggered relative to each other (not shown), with the extent of one segment along the arch extending beyond the end of another segment. Such grouped segments may be coupled together by fasteners that hold the grouped bundle of segments together (not shown) or run together along fabric sleeves that contain the grouped bundle of segments (not shown).

FIG. 12J is a side cross section view along line J of the grouped cylindrical arched member of FIG. 12I.

FIGS. 12K and 12L show rods with variable cross sections. The cross section of FIG. 12K gradually tapers from the base to the top. This evenly distributes bending stresses and it can be used to fine tune the stiffness and response of the rod. FIG. 12L shows an alternative where the rod is comprised of discreet bars of different diameter which form to make a stepped rod. This provides most of the benefit of FIG. 12K while avoiding manufacturing difficulty and it has the advantage of permitting a smaller shipping box due to the maximum length of any section of bars being less than that of a single rod that is not comprised of discreet bars or segments.

FIG. 12M is a front view of a rod constructed from a single unitary piece of material that has an isolated at rest straight shape of length L, two functional ends 1203, two end areas 1201, each of length L/3, and a middle area 1202 of length L/3.

FIG. 12N is a front view of a flexible rod constructed from a single unitary piece of material that has an isolated at rest elliptical-like shape of length L, two functional ends 1203, two end areas 1201, each of length L/3, and a middle area 1202 of length L/3.

FIG. 12O is a front view of a flexible rod constructed from a single unitary piece of material that has an isolated at rest shape having a smaller radius of curvature than the rod of FIG. 12N of length L, two functional ends 1203, two end areas 1201, each of length L/3, and a middle area 1202 of length L/3.

FIG. 12P is a front view of a flexible rod constructed from a single unitary piece of material that has an isolated at rest shape optimized for packing in a box whose longest dimension is less than L/3 where the rod has a length of L and has two functional ends 1203, two end areas 1201, each of length L/3, and a middle area 1202 of length L/3.

FIG. 12Q is a front view of the flexible rod of FIG. 12O of length L under forces applied to each functional end 1203 that bend the rod to approximate a half circular shape whose diameter is $2L/\pi$.

FIG. 12R is a front view of the flexible rod of FIG. 12O under forces applied to each functional end 1203 that bend the rod to approximate a smaller half circular shape whose diameter is $L/\pi$.

FIG. 12S is a front view of a semi-rigid rod whose functional ends 1203 are at a distance of L from each other when the rod is in an isolated at rest state.

FIG. 12T is a front view of the rod of FIG. 12N under forces applied to each functional end 1203 that bend the rod in order to move the functional ends 5 in closer to each other than their isolated at rest distance apart in order to be at a distance of L−5 from each other.

FIG. 12U is a front view of the rod of FIG. 12N under forces applied to each functional end 1203 that bend the rod in order to move the functional ends 5 in farther apart from each other than their isolated at rest distance apart in order to be at a distance of L+5 from each other.

FIG. 12V is a front view of a looped rod with a circular isolated at rest shape. The rod has length L between its two functional ends 1203 in the direction through the apex 1204 and which has two end areas 1201, each of length L/3, and a middle area 1202 of length L/3. The function ends 1203 are where the rod would be coupled to the frame or bed subsystem shown at a line 1205 when assembled (not shown) in a trampoline system.

FIG. 12W is a front view of a looped rod with a flattened isolated at rest shape. The rod has length L between its two functional ends 1203 in the direction through the apex 1204 and which has two end areas 1201, each of length L/3, and a middle area 1202 of length L/3. The function ends 1203 are where the rod would be coupled to the frame or bed subsystem shown at a line 1205 when assembled (not shown) in a trampoline system.

Although not shown in these specific drawings of FIGS. 12A-12W, additional solid shapes are advantageous in reaching different performance characteristics. For example, solid centers can also be used with hexagonal or octagonal shaped arched members (or rods). Although not shown in these specific drawings of FIGS. 12A-12W, additional hollow shapes are advantageous in reaching different performance characteristics. For example, hollow centers can also be used with square, hexagonal, or octagonal shaped arched members (or rods). Although not shown in these specific drawings of FIGS. 12A-12W, these rods can have their arched curve shape adapted to instead serve the purpose of a vertical support mast.

9.4. Additional Embodiments and Miscellaneous

FIG. 13A shows a front view of a trampoline system 1301 comprised of a circular trampoline upper frame 1320, six frame legs 1321, and six arched rods 1302 which attach to the trampoline upper frame 1320.

FIG. 13B is an isometric view of the trampoline system 1301 of FIG. 13A which shows the arched rods 1302 attach to the trampoline upper frame 1320 at the end point connections 1304. This system does not employ the trampoline mat to add compliance to the system like in previous embodiments shown, but this system is similar in that the enclosure subsystem rods 1302 are angled so that they transfer loads to remote sections of the frame during impacts. The stiffness of the rods 1302 are tuned to have the optimal amount of compliance (and consequently to have an optimal amount of bending rigidity) even when they are attached to the rigid upper frame 1320. In this configuration the top of the netting curtain 1308 is attached to the upper parts of the arched rods 1302 and then the bottom of the netting curtain 1308 attaches near or at the perimeter 1307 of the mat 1306. Such a configuration with rods attached to the frame and the bottom of the net attached near or at the perimeter couples the bending and spring action of the rods to the rebounding of the bed subsystem with the benefit that the spring rods have the added function of adding to the rebounding effect of the bed subsystem.

FIG. 13C is a cross-section view along line C of the trampoline system 1301 of FIG. 13A with netting curtain 1308 supported by arched rods 1302 that connect at end point connections 1304 to the trampoline upper frame 1320 which is supported by six frame legs 1321. The netting curtain 1308 is attached to the perimeter 1307 of the mat 1306 with diameter MAT OD.

FIG. 13D is an isometric view of the trampoline system 1301 of FIG. 13A with the netting curtain 1308 attached to the upper frame 1320. The enclosure subsystem 1310 has an added netting flap 1309 connected to the netting curtain 1308 at a constant height above the mat 1306. The netting flap 1309 couples the enclosure subsystem 1310 to the rebounding effect of the bed subsystem by attaching to the perimeter 1307 of mat 1306. FIG. 13D shows a trampoline 1301 where fabric panels 1309 are sewn midway up the net 1308 and attaches to the trampoline mat edge 1307. The enclosure poles 1302 attach to the frame 1320 at connection points 1304. The purpose of the fabric panel 1309 is to prevent the user from hitting the springs 1311. This results in the trampoline not needing pads to cover the springs 1311. The fabric panel 1309 or netting curtain 1308 can be reinforced with a rod (not shown) the runs along the circumference of the net, at height anywhere from the rod 1302 apex, down to the netting curtain constant height above the mat 1306, or even below on either the netting curtain 1308 or netting flap 1309. The panels 1309 can also be supported by webbing straps sewn into the net 1308. The straps could run vertically or at angles or horizontally.

FIG. 13E is a variation of the trampoline shown in FIG. 13D where it has protective fabric panels 1309 that connect the edge of the mat 1307 to midway up the enclosure net 1308. It also has the net 1308 extend fully down and attach to the frame 1320. This creates an upside-down V shape between the fabric panels 1309 and the bottom part of the netting 1308.

FIG. 13F is another view showing the trampoline of FIG. 13E. This shows the springs 1311 are fully enclosed in between the fabric panels 1309 and the enclosure net 1308.

FIG. 14A shows a front view of a trampoline system 1401 comprised of a circular trampoline upper frame 1420, six frame legs 1421, and six arched rods 1402 where each rod attaches to both the trampoline upper frame 1420 and to the trampoline mat.

FIG. 14B is an isometric view of the trampoline system 1401 of FIG. 14A which shows each arched rod 1402 has one frame end 1404 which attaches to the trampoline upper frame 1420, and one mat end 1405 which attaches near or at the perimeter 1407 of trampoline mat 1406. This configuration provides a combination of the rigid support of the frame mounted enclosure subsystem for FIG. 13 with the compliance and shock absorption of the mat mounted enclosure subsystems. The mat end 1405 of each arched rod 1402 is able to move with the suspended mat which helps to absorb impacts. The frame end 1404 of each arched rod 1402 is fixed to the upper frame 1420 which provides a strong anchor. The rod end pattern shown in this configuration is where the rod ends alternate every two ends. The resulting pattern is frame end 1404, frame end 1404, then mat end 1405, mat end 1405, which then repeats around the trampoline. The combination of the two mounting locations results in an enclosure subsystem that can absorb impacts safely while also limiting motion enough to keep jumpers within the chamber of the enclosure subsystem during an impact. In this configuration the top of the netting curtain 1408 is attached to the upper parts of the arched rods 1402 and then the bottom of the netting curtain 1408 attaches near or at the perimeter 1407 of the mat 1406.

Figure 15A:
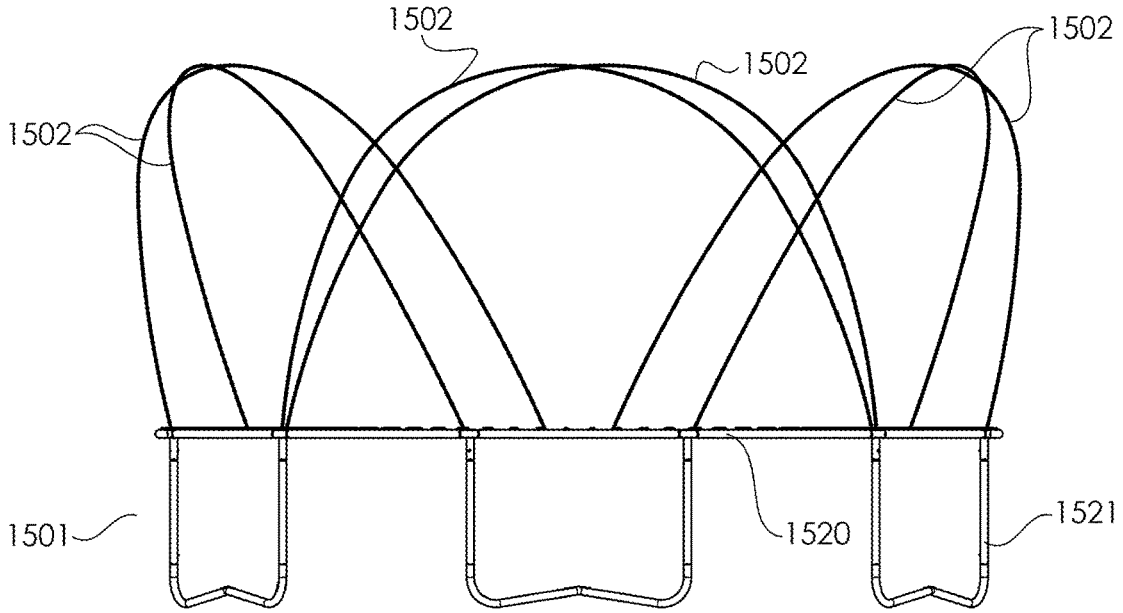
FIG. 15A is a front view of a trampoline enclosure system comprised of six arch members each attached to both the frame and the mat in a different alternating configuration than the one shown in FIG. 14A.

FIG. 15A shows a front view of a trampoline system 1501 comprised of a circular trampoline upper frame 1520, six frame legs 1521, and six arched rods 1502 where each rod attaches to both the trampoline upper frame 1520 and to the trampoline mat.

Figure 15B:
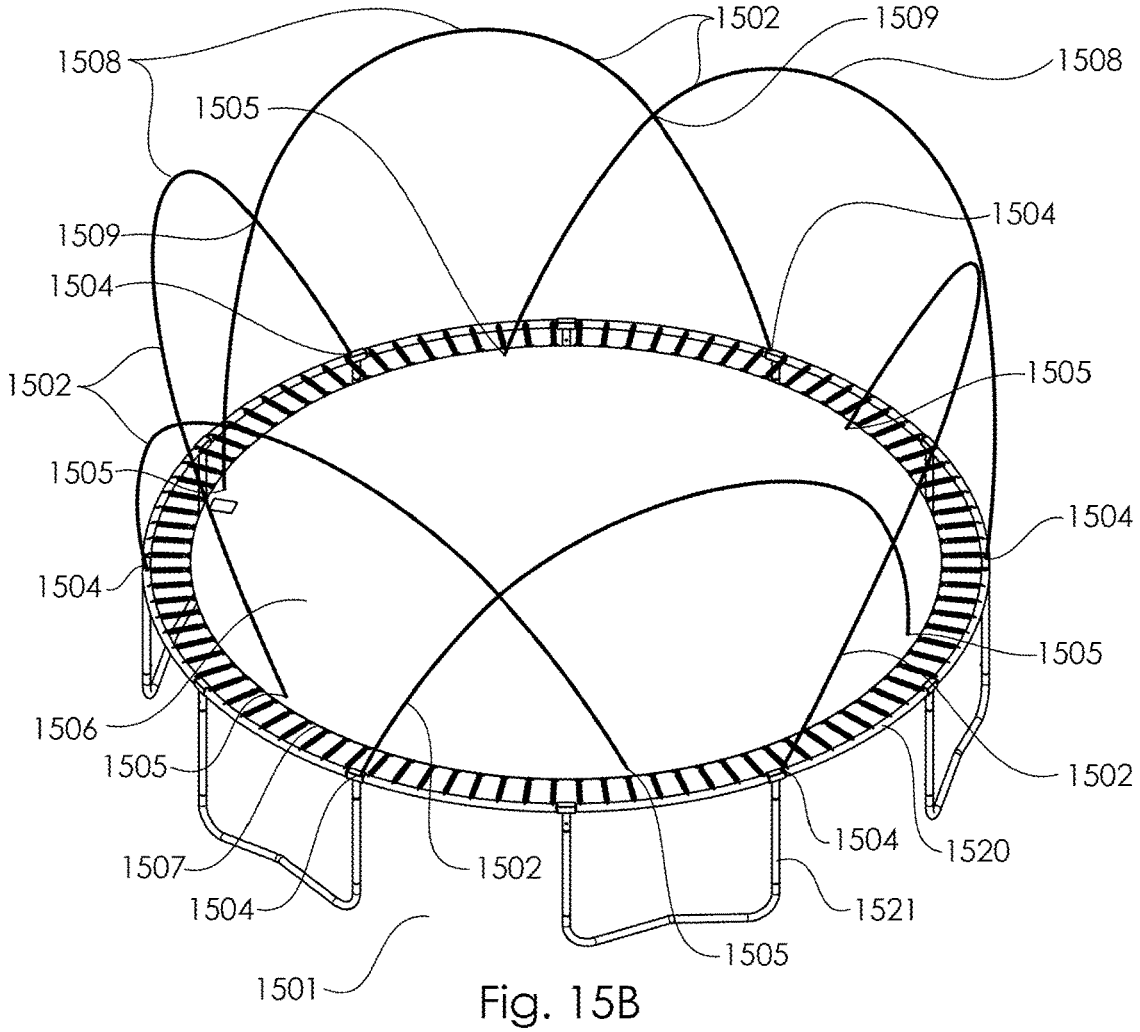
FIG. 15B is an isometric view of the trampoline enclosure system of FIG. 15A

FIG. 15B is an isometric view of the trampoline system 1501 of FIG. 15A which shows each arched rod 1502 has one frame end 1504 which attaches to the trampoline upper frame 1520 and one mat end 1505 which attaches near or at the perimeter 1507 of trampoline mat 1506. This configuration is different from the one shown in FIG. 14 because the pattern of the rod ends is alternating such that each adjacent rod end mounting point alternates between a frame end 1504 and a bed end 1505. In this configuration, the top of the net, not shown, would be attached to the upper parts of the arched rods 1502 and then the bottom of the net would attach near or at the perimeter 1507 of the mat 1506.

Figure 16A:
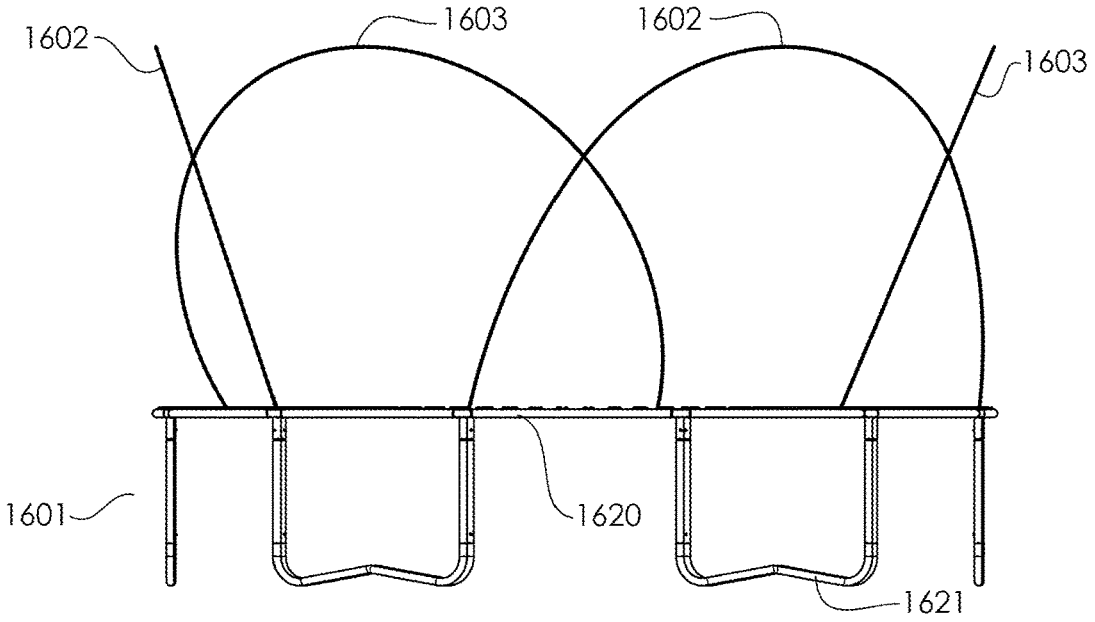
FIG. 16A is a front view of a trampoline enclosure system comprised of six arch members, half of which are attached to the frame and half attached to the mat in an alternating configuration.

FIG. 16A shows a front view of a trampoline system 1601 comprised of a circular trampoline upper frame 1620, six frame legs 1621, three arched rods 1602 where each rod attaches to the trampoline upper frame 1620, and three arched rods 1603 where each rod attaches to the trampoline mat 1606 (not visible).

Figure 16B:
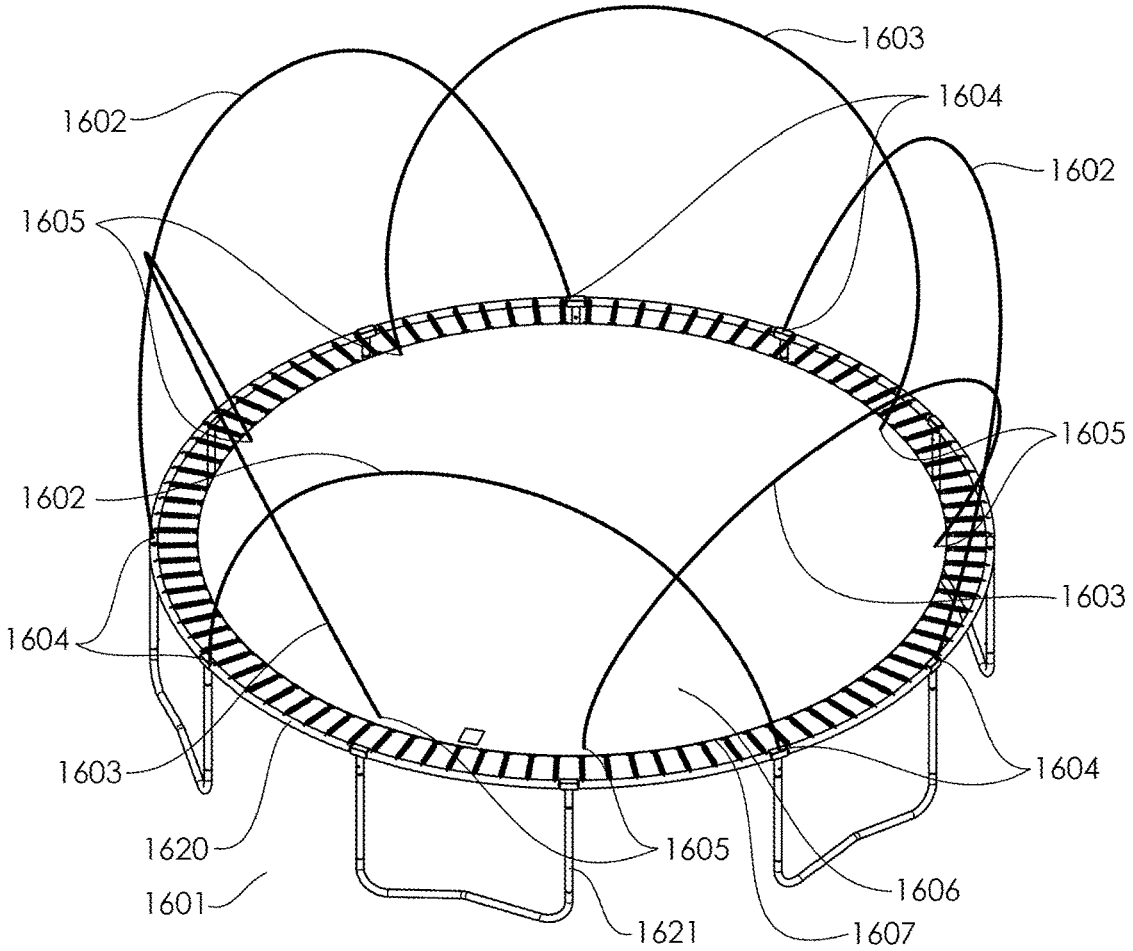
FIG. 16B is an isometric view of the trampoline enclosure system of FIG. 16A

FIG. 16B is an isometric view of the trampoline system 1601 of FIG. 16A which shows each arched rod 1602 has two frame ends 1604 which attach to the trampoline upper frame 1620 and each arched rod 1603 has two mat ends 1605 which attach near or at the perimeter 1607 of trampoline mat 1606. This configuration is different from the one shown in FIGS. 14-15 because the pattern of the rod ends is alternating such that each adjacent rod end mounting point connections together alternate between both being frame ends 1604 and both being bed ends 1605. In this configuration, the top of the net, not shown, would be attached to the upper parts of the arched rods 1602 and arched rods 1603 and then the bottom of the net would attach near or at the perimeter 1607 of the mat 1606.

Figure 17A:
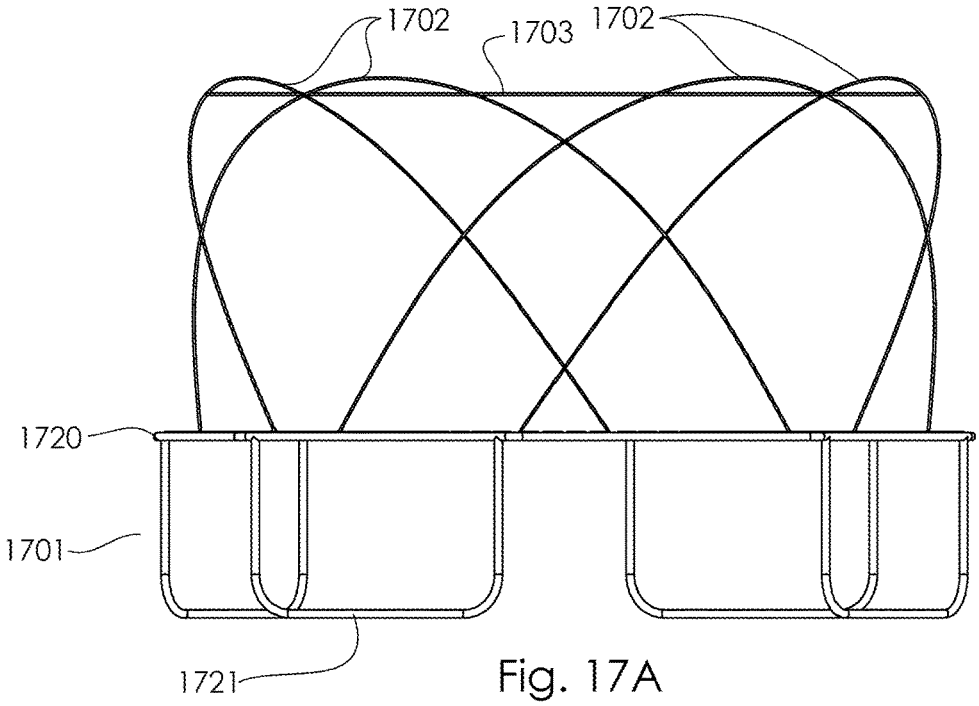
FIG. 17A is a front view of an octagonal trampoline with a trampoline enclosure system comprised of four arch members.

FIG. 17A shows a front view of an octagonal trampoline system 1701 comprised of an octagonal trampoline upper frame 1720, four frame legs 1721, four arched rods 1702, and four connecting top straps 1703.

Figure 17B:
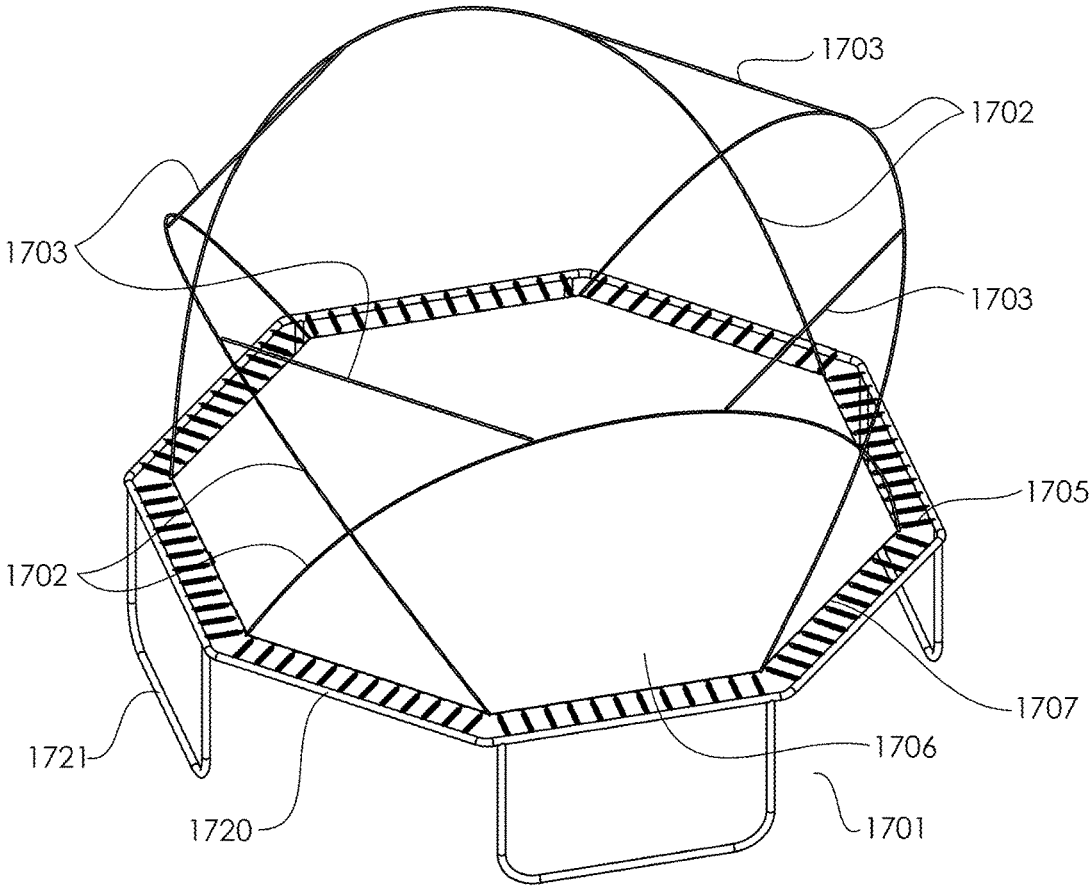
FIG. 17B is an isometric view of the octagonal trampoline of FIG. 17A

FIG. 17B is an isometric view of the octagonal trampoline of FIG. 17A which shows each arched rod 1702 has two mat ends which attach near or at the perimeter 1707 of trampoline mat 1706 and that are cross-supporting each other through the connecting top straps 1703.

Figure 17C:
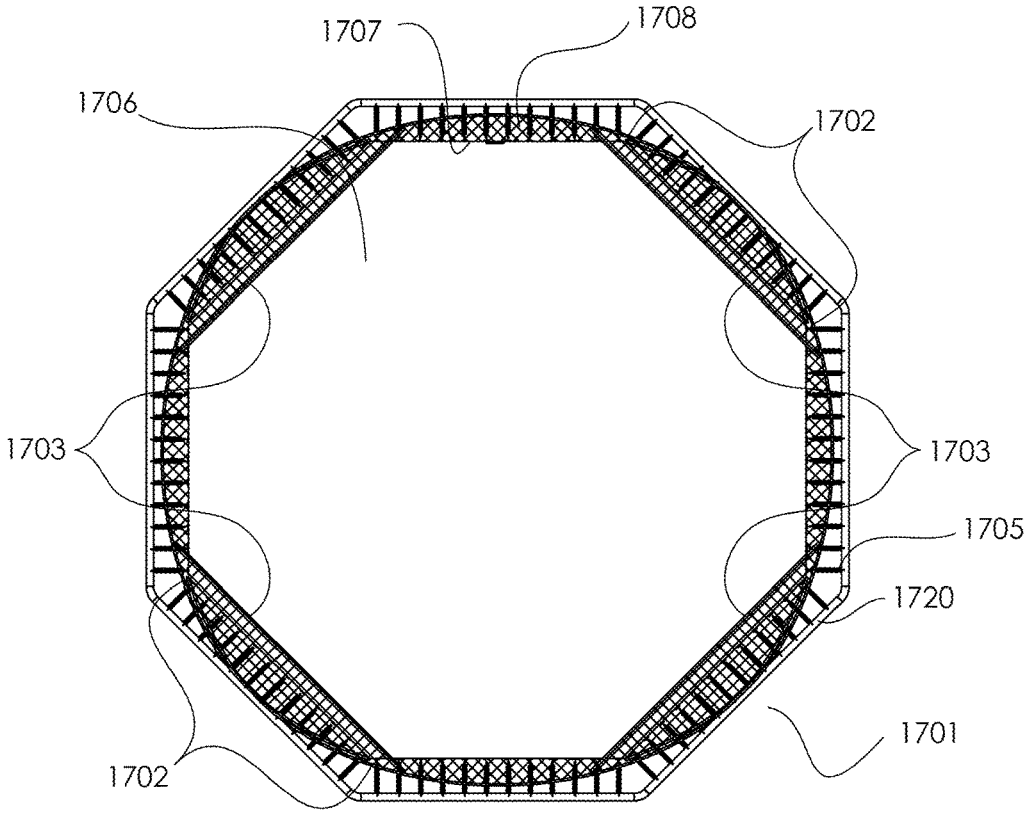
FIG. 17C is a top view of the octagonal trampoline of FIG. 17A.

FIG. 17C is a top view showing the upper frame 1720 of the octagonal trampoline system 1701 of FIG. 17A with an arched rod enclosure subsystem, octagonal trampoline bed 1706, and trampoline springs 1705. A netting curtain 1708 is suspended by rods 1702 and top straps 1703 and attached at the bottom to the perimeter of bed 1707 in the area where the bed 1706 is coupled to the springs 1705. The end areas of the rods 1702 are attached near the vertices of the octagonal trampoline bed 1706. Because as viewed from above the rods 1702 pass outside of the perimeter of bed 1707, the netting curtain 1708 as it approaches the surface of bed 1706 is visible inside of rods 1702 near the rods' center and visible outside of rods 1702 near the rod's functional ends where the netting curtain 1708 approaches the apex of other rods 1702 and top straps 1703.

Figure 17D:
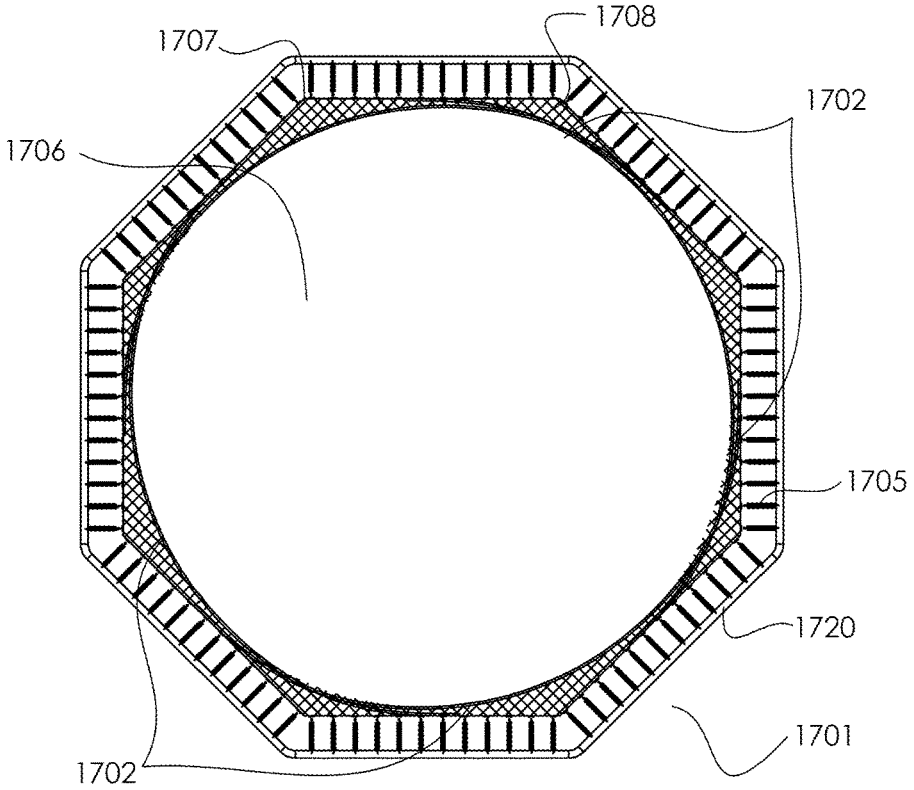
FIG. 17D is a top view of an alternative embodiment of the trampoline system of FIG. 17C.

FIG. 17D is top view showing an alternative embodiment of the trampoline system 1701 of FIG. 17C where the rods' paths are all inside the perimeter of the octagonal bed 1706. The octagonal trampoline system 1701 has an arched rod enclosure subsystem, upper frame 1720, octagonal trampoline bed 1706, and trampoline springs 1705. A netting curtain 1708 is suspended by rods 1702 and attached at the bottom to the perimeter of bed 1707 in the area where the bed 1706 is coupled to the springs 1705. The end areas of the rods 1702 are attached near the center of each side of the octagonal trampoline bed 1706. Because as viewed from above the rods 1702 pass wholly inside of the perimeter of bed 1707, the netting curtain 1708 as it approaches the surface of bed 1706 is visible outside of rods 1702 at both the rods' center and near the rod's functional ends where the netting curtain 1708 approaches the apex of other rods 1702.

Figure 17E:
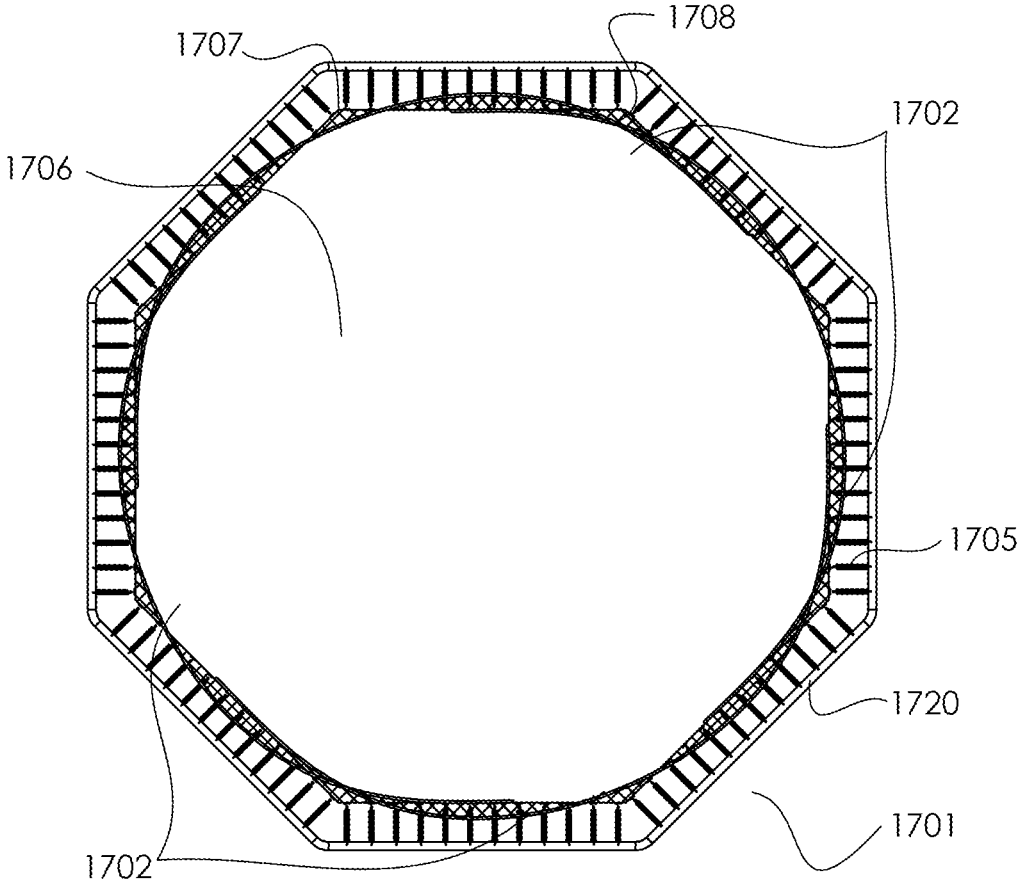
FIG. 17E is a top view of an alternate embodiment of the trampoline system of FIG. 17C.

FIG. 17E is top view showing an alternative embodiment of the trampoline system 1701 of FIG. 17C where the rods' paths cross over the perimeter of the octagonal bed 1706 in the areas surrounding the vertices of the octagon of the bed perimeter in a manner analogous to the rectangular trampoline of FIG. 11G. The octagonal trampoline system 1701 has an arched rod enclosure subsystem, upper frame 1720, octagonal trampoline bed 1706, and trampoline springs 1705. A netting curtain 1708 is suspended by rods 1702 and attached at the bottom to the perimeter of bed 1707 in the area where the bed 1706 is coupled to the springs 1705. The end areas of the rods 1702 are attached near the center of each side of the octagonal trampoline bed 1706. Because as viewed from above the rods 1702 pass inside and outside of the perimeter of bed 1707, the netting curtain 1708 as it approaches the surface of bed 1706 is visible outside of rods 1702 near a rods' center and visible inside of rods 1702 near the rod's functional ends where the netting curtain 1708 approaches the apex of other rods 1702.

Figure 18A:
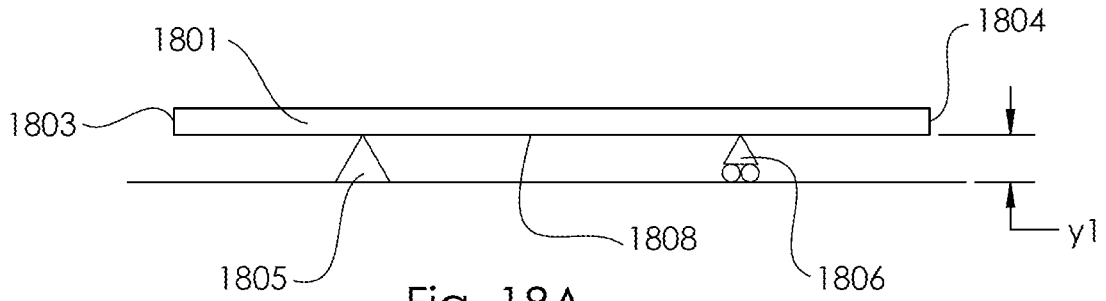
FIG. 18A is a front view of a rod sample supported at its two ends.

FIG. 18A is a front view of a rod sample supported at its two ends.

Figure 18B:
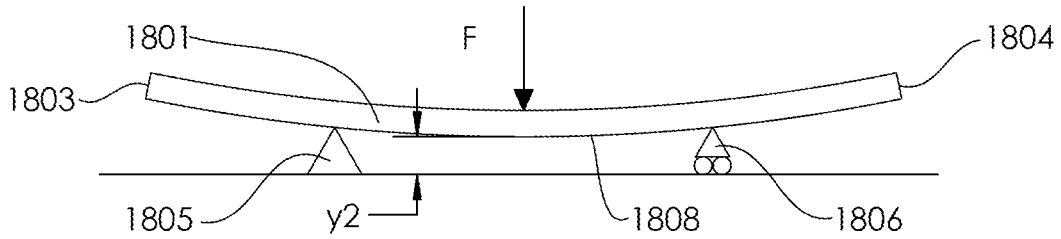
FIG. 18B is a front view of a rod sample supported at its two ends and bending due to a centrally applied load.

FIG. 18B is a front view of a rod sample supported at its two ends and bending due to a centrally applied load.

FIG. 19A is a top view of a round trampoline system showing the perimeter area 1917 in relation to the bed perimeter 1907. P1 is a point above the centroid of the jump surface at a height H, creating a plane that is parallel to the jump surface. Another point P3, exists on the same plane as P1 at radial distance of L2 from P1. L1 extends radially from P1 and can be 15% longer, shorter and anywhere in between of the distance L2; P2 is at the end of L1 and lies on the same plane as P1 and P3. Additionally, alpha ($\alpha$) is the angle between L1 and L2 and is 30° or greater.

Figure 19B:
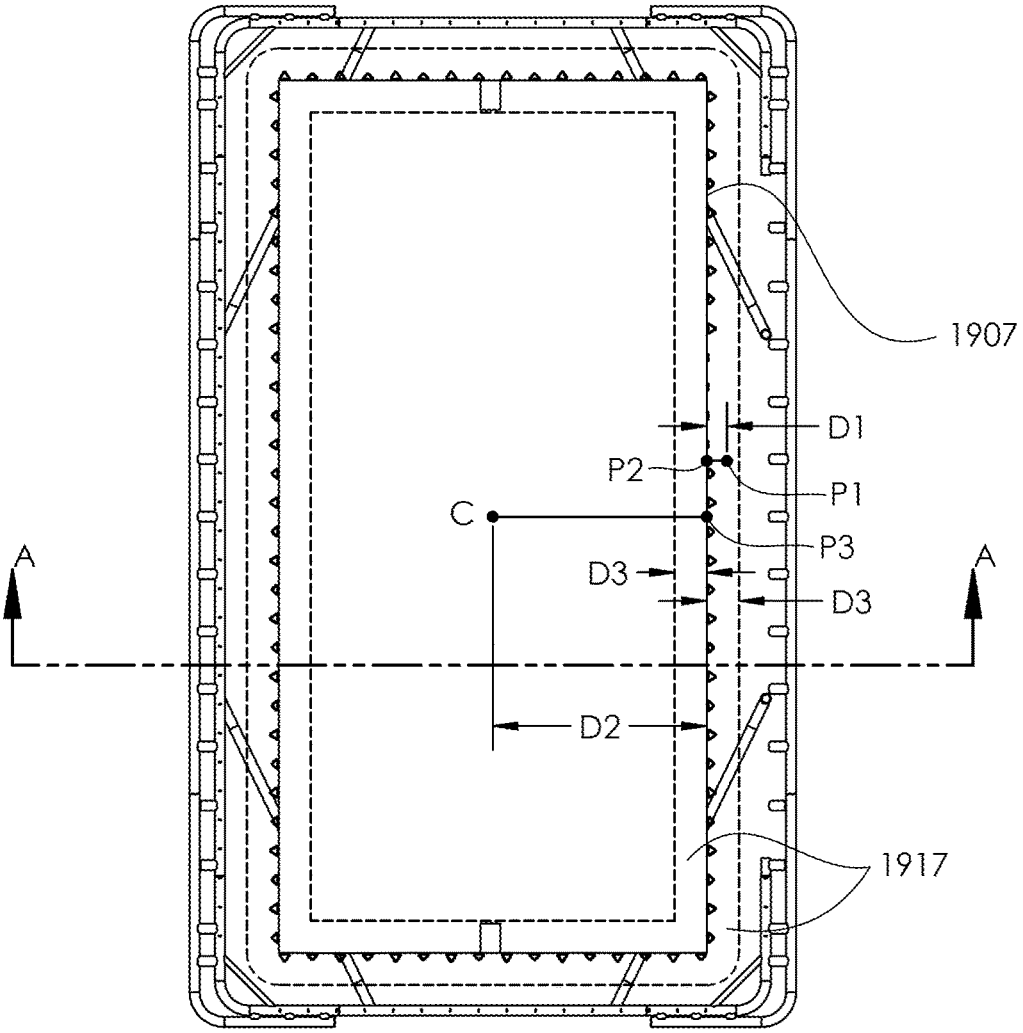
FIG. 19B is a top view of a rectangular trampoline system showing the perimeter area.

FIG. 19B is a top view of a rectangular trampoline system showing the perimeter area 1917. D2 is the shortest distance from the center of the jumping surface (point C) to any point along the bed perimeter 1907 of the jumping surface (shown by point P3). D3 is the radial distance, measured perpendicularly from the bed perimeter 1907 of the jumping surface and which has a length that is 15% of D2. P1 is a point that lies within the boundary created by the distance D3, where P1 is at a distance D1 from P2, the closest point along the bed perimeter 1907 of the jumping surface.

Figure 19C:
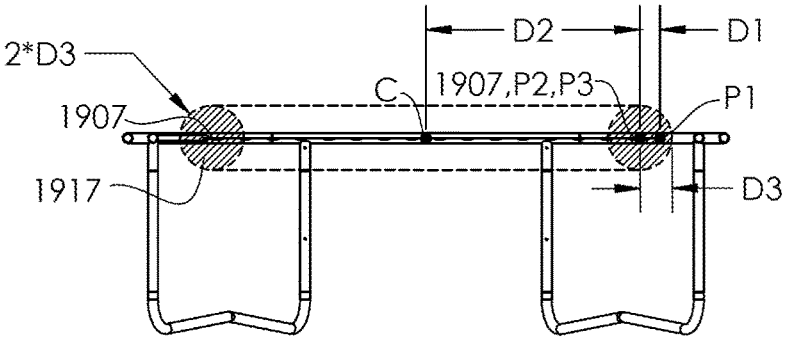
FIG. 19C is a top view of a rectangular trampoline system showing the perimeter area.

FIG. 19C is a front-sectional view along line A of the rectangular trampoline system of FIG. 19B showing the perimeter area 1917. The section view shows the radial distance of D3

FIG. 20 shows various ways to couple rod segments together. Multiple rod segments may be needed to assemble into a single long rod so that the rods can be shipped in smaller boxes.

Figure 20A:
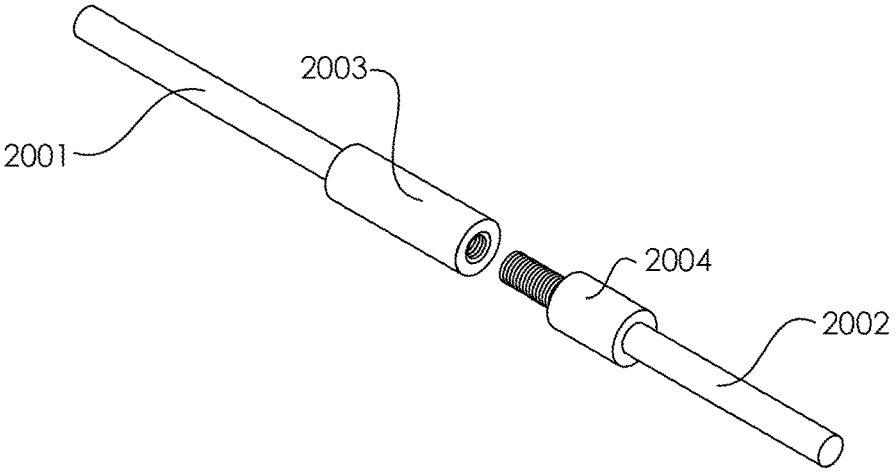
FIG. 20A is an isometric view of a threaded rod coupler.

FIG. 20A shows a threaded rod coupler where one rod segment 2001 has a threaded female coupler 2003 attached to its end which fastens to a threaded male coupler 2004 which is attached to the end of a second rod segment 2002. The threaded couplers could be fixed to the rods or one or both of the couplers could be free to rotate. This would allow the couplers to be threaded together without having to rotate either of the rod segments.

Figure 20B:
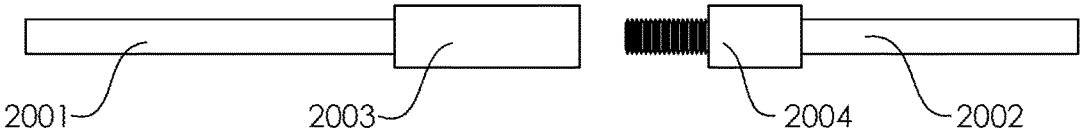
FIG. 20B is a side view of a threaded rod coupler.

FIG. 20B is a side view of the threaded rod coupler of FIG. 20A.

Figure 20C:
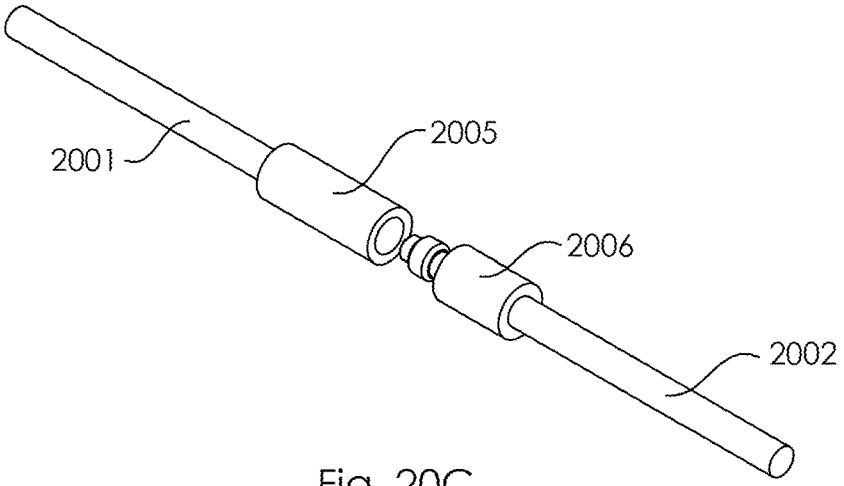
FIG. 20C is an isometric view of a quick release rod coupler.

FIG. 20C shows a quick release rod coupler where one rod segment 2001 has a quick release female coupler 2005 attached to its end which attaches to a quick release male coupler 2006 which is attached to the end of a second rod segment 2002. The quick release female coupler 2005 can attach to the male coupler 2006 by snap fingers, spring loaded detents, twisting lock wedges or it could attach using many other types of mechanisms.

Figure 20D:
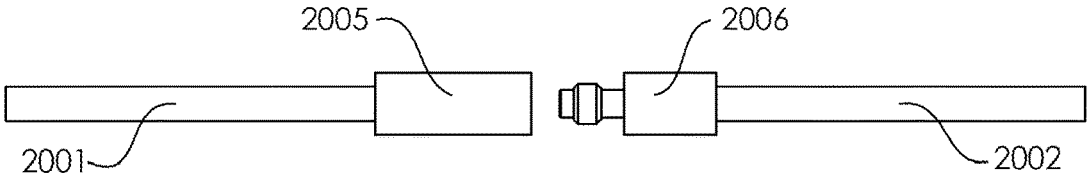
FIG. 20D is a side view of a quick release rod coupler.

FIG. 20D is a side view of the quick release rod coupler of FIG. 20C.

Figure 20E:
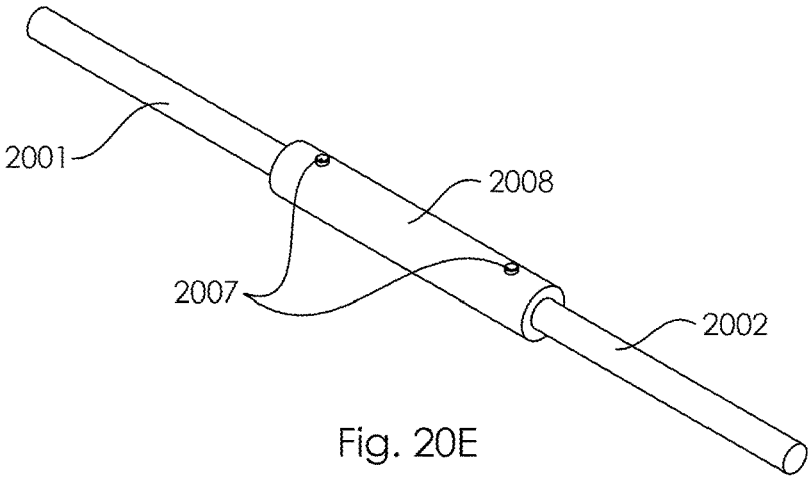
FIG. 20E is an isometric view of a pinned rod coupler.

FIG. 20E shows a pinned rod coupler where one rod segment 2001 inserts into one end of a pinned rod coupler 2008 and a second rod segment 2002 inserts into the other end of a pinned rod coupler 2008. The pins 2007 are shown extending out of the pinned rod coupler 2008. These pins 2007 could be snap buttons, cotter pins, shoulder bolts, spring pins, or any number of other parts for affixing the rod segments to the coupler.

Figure 20F:
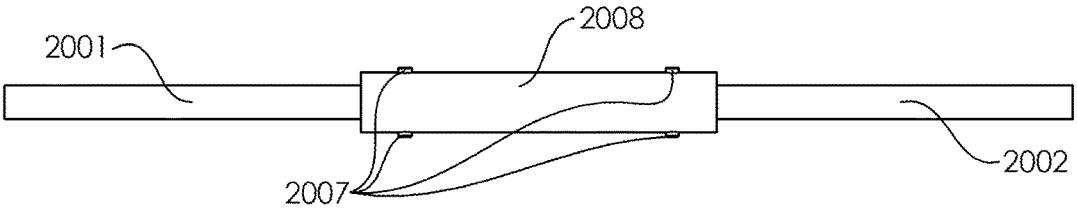
FIG. 20F is a side view of a pinned rod coupler.

FIG. 20F is a side view of the pinned rod coupler of FIG. 20E.

Figure 20G:
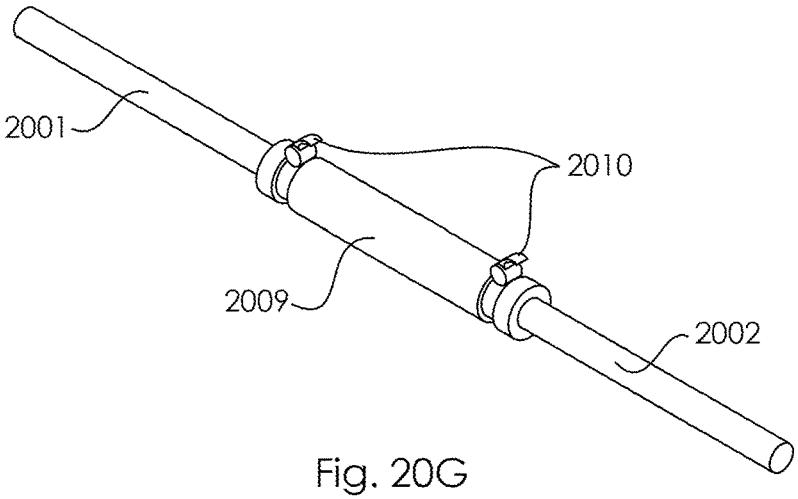
FIG. 20G is an isometric view of a clamp collar rod coupler.

FIG. 20G shows a clamp collar rod with a rod coupler 2009 where one rod segment 2001 inserts into one end of a clamp collar rod coupler 2009 and a second rod segment 2002 inserts into the other end of a clamp collar rod coupler 2009. The locking mechanisms 2010 are activated which clamp the rod segments so they are held in the coupler. The clamps could be cam levers, wedge screws, latch clamps, or any other type of locking mechanism.

Figure 20H:
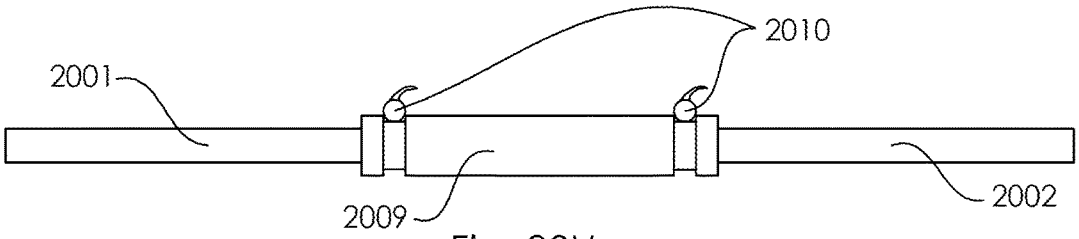
FIG. 20H is a side view of a clamp collar rod coupler.

FIG. 20H is a side view of the clamp collar rod of FIG. 20G.

Figure 21A:
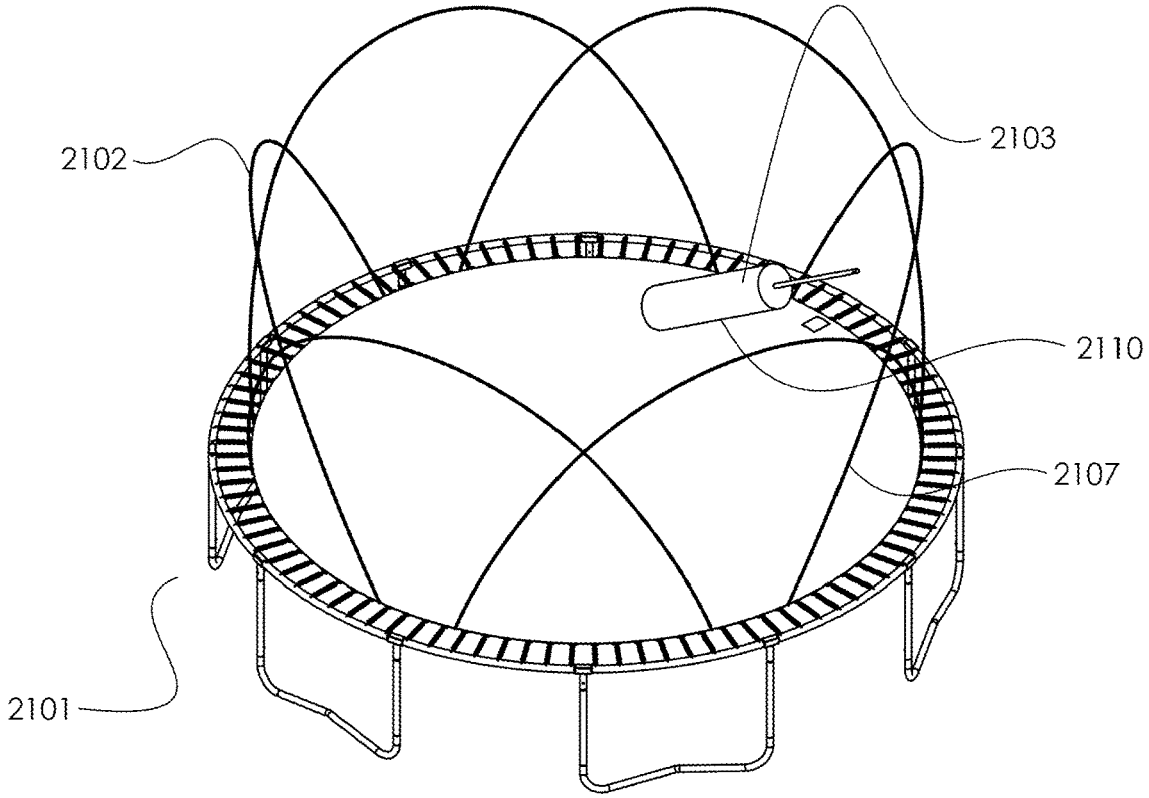
FIG. 21A is an isometric view of a test setup configured for a standard rod impact with the weight in the lifted position.

FIG. 21A shows a trampoline 2101 with a weighted bag 2103 suspended from a pivot point and held at an angle for conducting a standard rod impact test. The bag 2103 pivot point would be fixed above the trampoline enclosure per § 6.1 of the ASTM F 2225-15. The bag 2103 is aligned with a location on the enclosure such that the center of mass 2110 of the bag's impact face is applied against the enclosure support pole at an impact center location 2107 with height mid-distance between the top and bottom of the enclosure barrier where a rod 2102 cross and the pivot point is located such that the center of mass the bag's face 2110 hits the enclosure at an impact center location 2108 at a height equal to half of its total height.

Figure 21B:
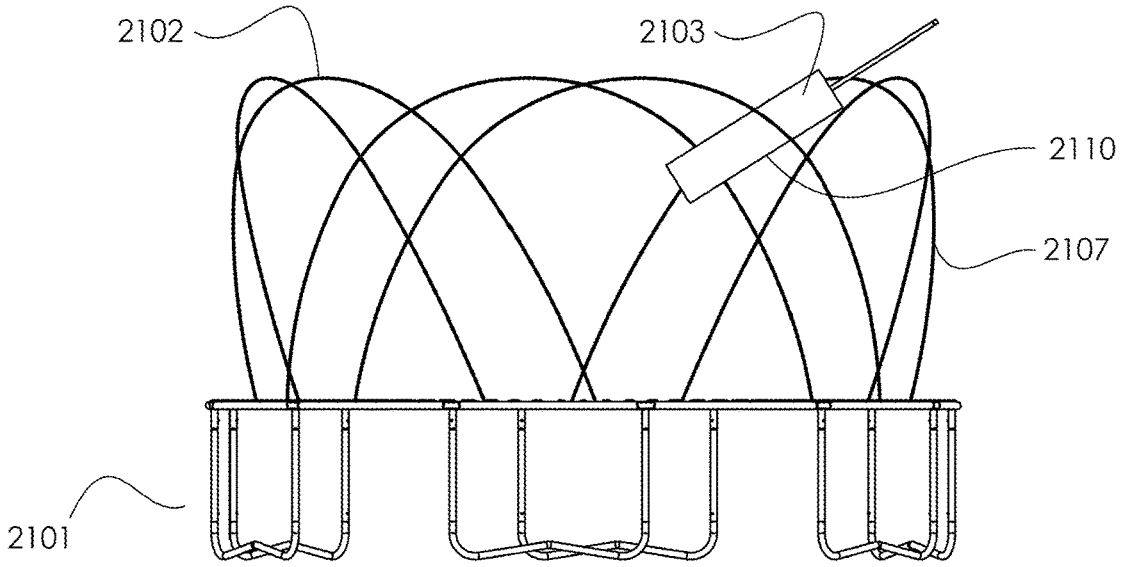
FIG. 21B is a side view of the trampoline shown in FIG. 21A

FIG. 21B is a side view of the trampoline 2101 of FIG. 21A.

Figure 21C:
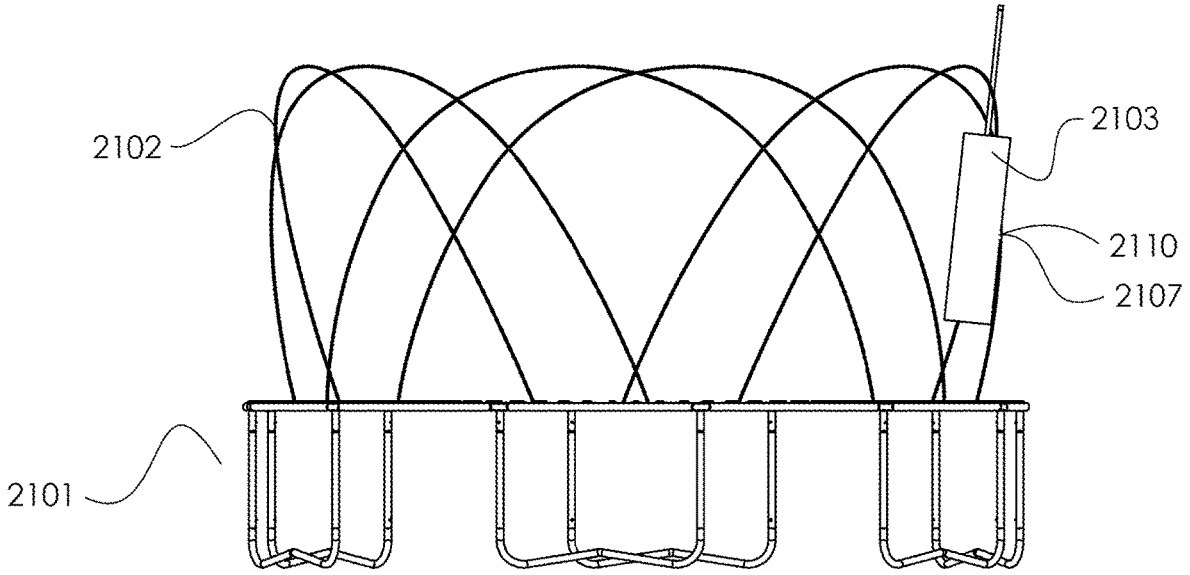
FIG. 21C is a side view of the trampoline of FIG. 21A with the weight in the impact position of a standard rod impact.

FIG. 21C shows the trampoline of FIG. 21A in a state when the bag 2103 has been released and swings down and the center of mass of the bag's face 2110 is impacting the enclosure rods 2102 at impact center location 2107.

Figure 21D:
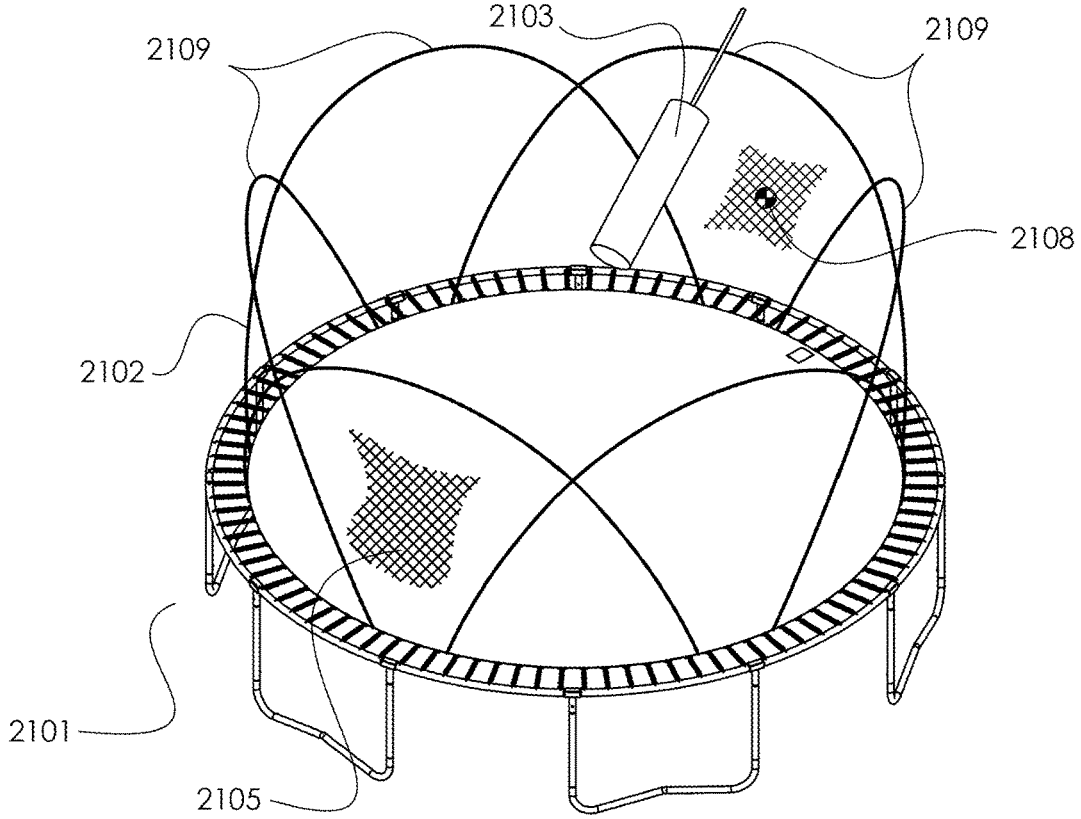
FIG. 21D is an isometric view of a test setup configured for a standard net impact with the weight in the lifted position.

FIG. 21D shows a trampoline 2101 with a weighted bag 2103 suspended from a pivot point and held at an angle for conducting a standard net impact test. The bag 2103 pivot point is fixed above the trampoline enclosure per the § 6.1 of the ASTM F 2225-15. The bag 2103 is aligned with a location on the enclosure at the apex 2109 of the enclosure rods 2102 and the pivot point is located such that the middle of the bag hits the enclosure net 2105 at an impact center location 2108 at height equal to half of its total height, midway between rods 2102, and below an apex 2109.

Figure 21E:
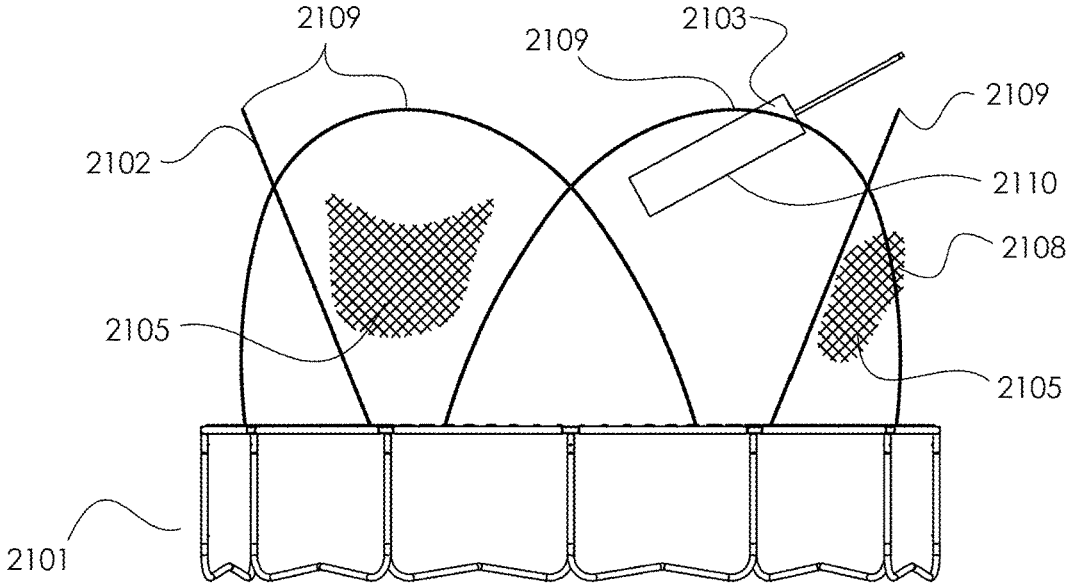
FIG. 21E is a side view of the trampoline shown in FIG. 21D

FIG. 21E is a side view of the trampoline 2101 of FIG. 21D and shows the center of mass of the bag's face 2110 which will hit the enclosure at an impact center location 2108 midway between poles 2102 and below apex 2109.

Figure 21F:
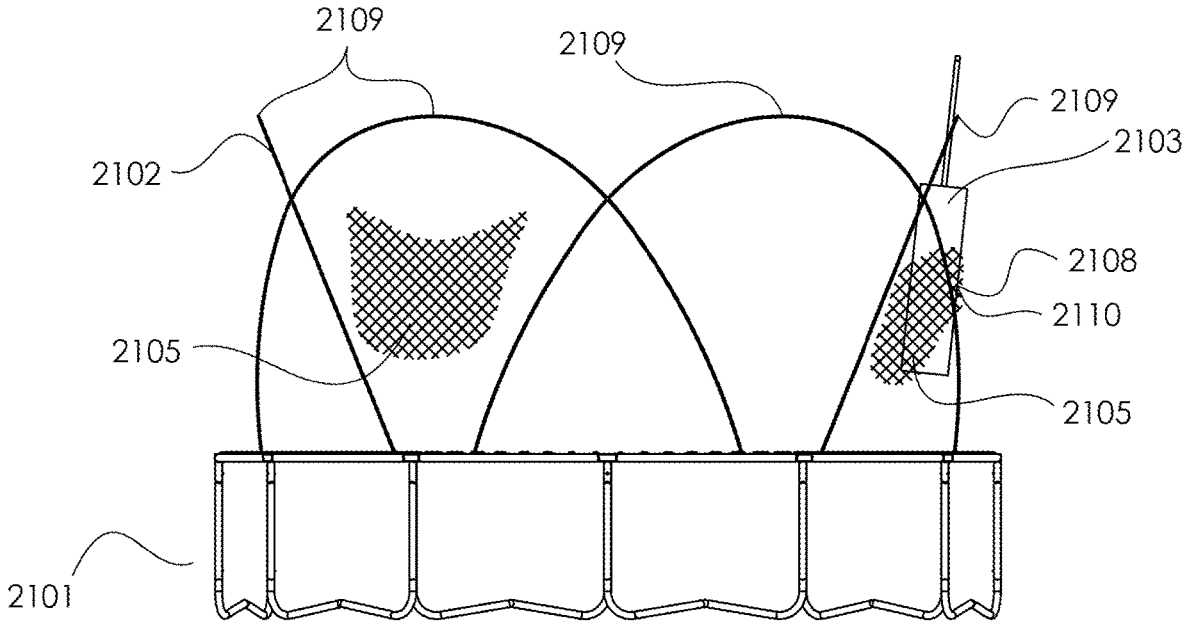
FIG. 21F is a side view of the trampoline of FIG. 21D with the weight in the impact position of a standard net impact.

FIG. 21F shows the trampoline of FIG. 21A in a state when the bag 2103 has been released and swings down and the center of mass of the bag's face 2110 is impacting the enclosure net 2105 at impact center location 2108 which is below an apex 2109 and midway between two rods 2102.

FIG. 22A is an isometric view of a trampoline 2201 depicting the locations of strain gauges 2215 through 2220 and impact locations 2207, 2208, and 2211 that are pertinent to the testing of the enclosure. Odd numbered gauges (2215, 2217, 2219) are aligned in plane to the arch and positioned on the outer radius of one of the rods 2202. Even numbered gauges (2216, 2218, 2220) are aligned out of plane to the arch and positioned on the surface facing the center of the trampoline of one of the rods 2202. Strain gauges 2215 and 2216 are located at the apex 2209 of the rod 2202. Strain gauges 2217 and 2218 are located at the mid-stress location below and near the midpoint between the top and bottom of the netting 2205, at a height between 41% and 49% of the way up toward the top from the bottom of the enclosure barrier. Strain gauges 2219 and 2220 are located near the bottom of the netting 2205 close to the surface of mat 2206. Impact locations 2207, 2208, and 2211 show the different areas targeted during impact testing of the enclosure. Impact location 2208 is below rod apex 2209. Impact location 2211 is below crossing point 2210. Impact location 2207 is along rod 2202, halfway between the top and bottom of net 2205.

FIG. 22B is a panoramic view from the center of the trampoline 2201 from FIG. 22A showing the rods 2202. The relevant rods 2202 isolated, also show the locations of strain gauges 2215-2220 and impact locations 2207, 2208, and 2211. The impact locations 2207, 2208, and 2211 are located halfway between the top (at rod apex 2209) and the bottom 2221 of the net barrier (near mat 2206). Impact location 2207 is a standard rod impact. Impact location 2208 is a standard net impact. Impact location 2211 is a standard stress net impact and is below crossing point 2210.

Miscellaneous Specifications

Embodiments of some of the disclosed trampoline systems advantageously have an enclosure subsystem to frame and bed subsystem mass ratio of less than 0.25 and in some embodiments more advantageously have an enclosure subsystem to frame and bed subsystem mass ratio of less than 0.125. Such a mass ratio is the total mass of the enclosure subsystem divided by the total mass of the frame subsystem and the bed subsystem. The mass ratio refers only to the portion of the enclosure, frame, and bed subsystems actually shipped to customers and/or dealers in practice and does not include any portions that the end customer and/or dealer is instructed to add (e.g., customer is instructed to add sand or water to weigh down a subsystem).

Many of the disclosed trampoline systems advantageously have an enclosure subsystem mass no greater than 9.1% of an Enclosure Impact Weight Rating of which the enclosure subsystem is capable of meeting and more advantageously no greater than 8.3% and even more advantageously no greater than 7.7%.

Some of the disclosed embodiments of a trampoline system comprising a frame and bed subsystem and an enclosure subsystem, including poles and any required foam padding, where the poles and the any foam padding are capable of fitting into a first set of one or more boxes with a total combined volume whose ratio to a second set of one or more boxes with a total combined volume, capable of containing the frame and bed subsystem, where the ratio of the two total combined volumes is advantageously less than 0.333. That is, the volume of the one or more boxes to contain the enclosure subsystem is less than one-third of the volume of the one or more boxes to contain both the frame subsystem and the bed subsystem.

A trampoline system having an enclosure subsystem, including poles and any required foam padding, where the poles and the any foam padding are capable of fitting into one or more boxes with a total combined volume in cubic inches, where the magnitude of the volume is no greater than the magnitude of an Enclosure Impact Weight Rating in pounds of which the enclosure subsystem is capable of meeting.

Not independent poles: When you impact the enclosure subsystem at a given point at least one point where you impact it causes at least one of the poles to transfer energy through that pole to two remote locations (opposite ends of pole) on the bed subsystem. The portion of impact energy transmitted into pole is distributed to two remote locations through one pole, directly into the bed. Disclosed are the ideal angles of the poles for various embodiments. With many of the disclosed configurations, a jumper impacting the enclosure subsystem just below the apex of an arched pole is limited from moving too far outside the assembled at rest shape of the enclosure subsystem. You limit the arches from collapsing by enclosing them in an arch seam with a horizontal strapping material going from one side of arch connecting one x-point to the next. By preventing arch from collapsing you can use lighter weight poles to transfer energy directly to the bed subsystem and less energy to flexing of poles to keep a user from moving farther outside of bed and increasing likelihood of the user being pulled back into bed because more energy is transferring into the spring system of the bed subsystem which subsequently recoils to pull them back onto bed more effectively. The bending of masts to absorb energy in traditional safety net systems are weak springs compared to the typical count of 96 springs of the bed subsystem used to absorb energy in the disclosed trampoline systems. The patches prevent x-shape from easily collapsing during impact with the square patch around the x-shape of sleeve.

Flaps transfer energy from the bottom of a pole to remote locations on either side of the bottom of the pole. Double flaps that fold up and down pulling up on one side and down on other engaging a larger portion of the bed subsystem to help prevent collapse of enclosure subsystem and to help keep the poles upright. This results in a greater portion of bed subsystem receiving energy and thus a greater amount of energy to be transferred into the bed subsystem. Poles may optionally be screwed into a base.

In view of the many possible embodiments to which the principles of the disclosed trampoline systems may be applied, it should be recognized that the illustrated embodiments are only examples of the trampoline systems disclosed herein and should not be taken as defining the scope of the invention.

The invention claimed is:

1. A trampoline system comprising:

a frame subsystem;

a bed subsystem supported by the frame subsystem; and an enclosure subsystem supported by the bed subsystem or the frame subsystem or both, the mass of the enclosure subsystem being less than 55% of a standardized mass of the bed subsystem, wherein the enclosure subsystem comprises a net and a plurality of rods that support the net, and wherein at least one of the of rods has a first end area and a second end area, the first end area being coupled to the bed subsystem, and the second end area being coupled to at least the bed subsystem or the frame subsystem.

2. The trampoline system of claim 1 wherein the trampoline system is able to provide an enclosure impact weight rating of 11 times the mass of the enclosure subsystem.

3. The trampoline system of claim 2 wherein:

at least one of the rods extends upwardly at a glancing angle of less than or equal to 80 degrees.

4. The trampoline system of claim 1 wherein the second end area of at least one of the rods is coupled to the bed subsystem.

5. The trampoline system of claim 1 wherein the bed subsystem supports at least 30% of the loaded weight of the rods.

6. A trampoline system comprising:

a frame subsystem;

a bed subsystem that comprises a rebounding bed and that is supported by the frame subsystem; and an enclosure subsystem that comprises a net and a plurality of arched rods, the enclosure subsystem being coupled to the bed subsystem, at least one of the rods extending above the level of the rebounding bed and having a first end area and a second end area, the first end area being coupled to at least the frame subsystem or the bed subsystem, and the second end area being coupled to at least the bed subsystem, and the net being supported by the rods and extending above the level of the rebounding bed, wherein the coupling of the enclosure subsystem to the bed subsystem is configured such that upon an impact to the bed subsystem by a jumping user, the bed subsystem moves downwardly from an original bed subsystem location, which causes the enclosure subsystem to bend and move away from an original enclosure subsystem location and thereby store energy in the enclosure subsystem, after which the enclosure subsystem springs back toward the original enclosure subsystem location, releases energy and thereby urges the bed subsystem back toward the original bed subsystem location.

7. The trampoline system of claim 6 wherein the first end area of at least one rod is coupled to the bed subsystem.

8. The trampoline system of claim 7 wherein both the first end area and the second end area are coupled to the bed subsystem in the perimeter area.

9. The trampoline system of claim 6 wherein the first end area of at least one rod is coupled to the frame subsystem.

10. The trampoline system of claim 6 wherein the bed subsystem supports at least 30% of the loaded weight of the rods.

11. The trampoline system of claim 6 wherein the enclosure subsystem has a mass that is less than 55% of a standardized mass of the bed subsystem.

12. The trampoline system of claim 6 wherein the trampoline system is able to provide an enclosure impact weight rating of 11 times the mass of the enclosure subsystem.

13. The trampoline system of claim 6 wherein a first one of the rods crosses a second one of the rods at a crossing point.

14. The trampoline system of claim 6 wherein at least one of the rods is a flexible rod or semi-rigid rod, has a flexural rigidity between 1,000 and 18,500 $lb \times in^2$, and has a median effective diameter no greater than 0.75 in.

15. The trampoline system of claim 6 wherein at least one of the rods extends upwardly at a glancing angle of less than 78.5 degrees.

16. A trampoline system comprising:

a frame subsystem;

a bed subsystem comprising a rebounding bed that is coupled to the frame subsystem; and an enclosure subsystem comprising a net and a plurality of arched rods that extend above the level of the rebounding bed, at least one of the of rods having a flexural rigidity between 1,000 and 18,500 $lb \times in^2$ and having a first end area and a second end area, the first end area being coupled to at least the bed subsystem or the frame subsystem, and the second end area being coupled to at least the bed subsystem or the frame subsystem, the net being coupled to the bed subsystem, being suspended by the rods, extending above the level of the rebounding bed, and defining a chamber above the rebounding bed, wherein, the first end area of at least one rod is coupled to the bed subsystem, the bed subsystem is configured to have a rebounding effect such that upon an impact to the bed subsystem by a jumping user, the bed subsystem moves downwardly from an original bed subsystem location and then springs back toward the original bed subsystem location, and the enclosure subsystem is coupled to the bed subsystem in a configuration such that downward movement of the bed subsystem causes the enclosure subsystem to bend and move away from an original enclosure subsystem location and thereby store energy in the enclosure subsystem, after which the enclosure subsystem springs back toward the original enclosure subsystem location, releases energy and thereby urges the bed subsystem to return toward the original bed subsystem location such that at least a portion of the rebounding effect of the bed subsystem is derived from the rebounding effect of the enclosure subsystem.

17. The trampoline system of claim 16 wherein the at least one of the rods extends upwardly at a glancing angle of less than or equal to 80 degrees.

18. The trampoline system of claim 17 wherein at least one of the rods is configured within the enclosure subsystem when assembled at rest to have a radius of curvature at all points along the path of the rod that is greater than or equal to 0.20 of an effective radius of the rebounding bed.

19. The trampoline system of claim 16 wherein the enclosure subsystem has a mass that is less than 55% of a standardized mass of the bed subsystem.

20. The trampoline system of claim 16 wherein at least one of the rods is coupled to at least one other rod.

21. The trampoline system of claim 16 wherein the trampoline system is capable of providing an enclosure impact weight rating of 11 times the mass of the enclosure subsystem.

22. A trampoline system comprising:

a frame subsystem;

a bed subsystem supported by the frame subsystem, the bed subsystem comprising a bed perimeter that defines a perimeter area; and an enclosure subsystem coupled to the bed subsystem, the enclosure subsystem comprising a net and a plurality of arched rods that support the net, at least one of the of rods having a first end area and a second end area, the first end area being coupled to the bed subsystem, and the second end area being coupled to at least the bed subsystem or the frame subsystem, the mass of the enclosure subsystem being less than 11% of the mass of the shipping weight of the trampoline system.

23. The trampoline system of claim 22 wherein the trampoline system is able to provide an enclosure impact weight rating of 11 times the mass of the enclosure subsystem.

24. The trampoline system of claim 22 wherein the at least one of the rods extends upwardly at a glancing angle of less than or equal to 80 degrees.

25. The trampoline system of claim 22 wherein the enclosure subsystem has a mass that is less than 55% of a standardized mass of the bed subsystem.

26. The trampoline system of claim 22 wherein the bed subsystem supports at least 30% of the loaded weight of the rods.

* * * * *